US007202019B2

(12) United States Patent
Usagawa et al.

(10) Patent No.: US 7,202,019 B2
(45) Date of Patent: Apr. 10, 2007

(54) PHOTOTHERMOGRAPHIC IMAGING MATERIAL

(75) Inventors: Yasushi Usagawa, Hino (JP); Narito Goto, Hino (JP); Takeshi Habu, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 34 days.

(21) Appl. No.: 10/686,062

(22) Filed: Oct. 15, 2003

(65) Prior Publication Data

US 2004/0101794 A1 May 27, 2004

(30) Foreign Application Priority Data

Oct. 25, 2002 (JP) ..... 2002-310910
Oct. 28, 2002 (JP) ..... 2002-312555
Jul. 22, 2003 (JP) ..... 2003-199555

(51) Int. Cl.
*G03C 1/498* (2006.01)
*G03C 1/34* (2006.01)

(52) U.S. Cl. ..... 430/619; 439/264; 439/531; 439/598; 439/607; 439/609; 439/620

(58) Field of Classification Search ..... 430/619, 430/531, 598, 264, 620, 607, 609
See application file for complete search history.

(56) References Cited

U.S. PATENT DOCUMENTS 5,686,228 A * 11/1997 Murray et al. ..... 430/350
6,413,712 B1 * 7/2002 Yoshioka et al. ..... 430/619
6,586,170 B1 * 7/2003 Yamada et al. ..... 430/617

* cited by examiner

*Primary Examiner*—Thorl Chea
(74) *Attorney, Agent, or Firm*—Lucas & Mercanti, LLP

(57) ABSTRACT

A photothermographic imaging material having a support; a photosensitive layer containing photosensitive silver halide particles on one face of the support; and a non-photosensitive layer provided on a side of the support where the photosensitive layer is provided. At least one of the photosensitive layer and the non-photosensitive layer contains an organic silver salt, a reducing agent, a compound represented by the Formula (1) and a compound represented by the Formula (2a).

(1)

(2a)

36 Claims, 1 Drawing Sheet

PHOTOTHERMOGRAPHIC IMAGING MATERIAL

BACKGROUND OF THE INVENTION

1. Field of the Invention

The present invention relates to a photothermographic imaging material which forms an image by thermal development, and particularly to a photothermographic imaging material with high sensitivity and low photographic fog, which is excellent in image storage stability after the development. Further, the present invention relates to a photothermographic imaging material, and particularly to a photothermographic imaging material which is high density, is excellent in light radiated image storage stability and image storage stability at the time of storage with high temperature, wherein increase of photographic fog is small in silver color tone and with time, and which is excellent in film transport and environmental suitability.

2. Description of Related Art

In earlier technology, in the fields of medical care and print plate making, waste solutions involved in wet-type processing of image formation materials have been problematic in terms of working property, and recently reduction of processing waste solutions has been strongly desired in the light of environmental preservation and saving space.

Recently, photothermal photographic materials where no waste solution involved in wet-type processing is produced have been strongly desired in terms of environmental protection and working property in the fields of medical care and printing. Particularly, technology where clear black images with high resolution can be formed by thermal development, concerning photothermal photographic materials of the intended use for photographic technology has been commercialized and rapidly prevailed. Since these photothermal photographic materials are typically developed at a temperature of 80° C. or above, they are referred to as photothermographic imaging materials in distinction from photosensitive materials in earlier technology which are liquid-developed at the range of 25 to 45° C. Thus, the photothermographic imaging materials where image formation can be performed only by adding heat have come into practical use and rapidly prevailed in the above fields.

In earlier technology, this type of the photothermographic imaging material is made up of a photosensitive layer comprising highly sensitive silver halide particles spectrally sensitized with dyes, an organic silver salt and a reducing agent, an irradiation prevention layer (AI layer) which prevents that light irradiated to the photosensitive layer is not absorbed, passes through, and reflects diffusely on an interface, an intermediate layer and an adhesion layer of a support or a backing layer (BC layer) provided at an opposite site of the support. Additionally, a protection layer is provided on the photosensitive layer and BC layer to prevent scratch at handling.

Since generally, in the photothermographic imaging material, the image is formed only by thermal development after exposure, the processing is simple, but since there is no photographic fixing step, it becomes important to improve image storage stability after the development. To improve the image storage stability after the development, the image could be generated by the development at high temperature, but if the development temperature is excessively high, photographic fog is easily produced and the sensitivity is reduced. Thus, generally, the development is performed at the temperature around 120±10° C.

The use of mercapto compounds to reduce the photographic fog is disclosed, for example, in JP-A-63-301037, JP-A-5-341432, JP-T-5-509182 and JP-A-2000-19681 or the like.

However, in these mercapto compounds, all have less effect on inhibition of the photographic fog, high sensitivity cannot be obtained, and there has been a limit to improve the image storage stability after the development.

Further, the use of certain propenenitrile compounds as photographic fog inhibitors is disclosed (e.g., see JP-T-2000-515995), and also the use of the certain alkene compound is disclosed (e.g., see JP-A-2002-207273). However, improvement effects of the image storage stability after the development have not been still sufficient in these compounds.

Further, it is disclosed that the use of the certain bisphenol compounds affords the good image in color tone (e.g., see JP-A-2002-169249), but these compounds have not been sufficient to improve the image storage stability after the development.

Since polyhalomethane compounds can release halogen radicals by photo or thermal excitation to reduce the photographic fog, they are proposed as inhibitors of the photographic fog of the photothermographic imaging materials. Examples thereof can include U.S. Pat. No. 3,874,946, U.S. Pat. No. 4,452,885, U.S. Pat. No. 4,546,075, U.S. Pat. No. 4,756,999, U.S. Pat. No. 5,340,712, JP-B-54-165, JP-A-50-137126, JP-A-7-2781, JP-A-9-265150 and JP-B-2-32614.

Various chemical structures for the groups which bind to polyhalomethane group have been designed in order to enhance releasing effects of halogen, but it can not be said yet that sufficient performance has been obtained. Because the sensitivity is often reduced when releasing ability of halogen is high whereas it becomes difficult to inhibit the photographic fog and it becomes difficult to improve the image storage stability when the releasing ability of halogen is small.

The photothermographic imaging material (hereinafter, simply also referred to as a photothermographic material or imaging material) per se has been already proposed since a long time ago (see, e.g., U.S. Pat. No. 3,152,904 Specification; U.S. Pat. No. 3,457,075 Specification; D. Morgan; Dry Silver Photographic Material; D. H. Klosterboer; Thermally Processed Silver System; Imaging Processes and Materials Neblette, 8th revision, Sturge, V. Walworth, A. Shepp edited, 279 page, 1989).

This photothermographic material is processed by a thermal development apparatus which adds stable heat to the photothermographic material to form the image, typically called a thermal developing apparatus. As mentioned above, in conjunction with the recent rapid prevalence, this thermal development apparatus has been supplied in the market in large quantities. In the meanwhile, there has been problematic in that slipping property between the photosensitive material and a transport roller or processing members of the thermal development apparatus changes, and transport failure and density unevenness occur. Also there has been problematic in that the density of the photothermographic imaging material varies with time. It has been found that these phenomena noticeably occur in the photothermographic imaging materials where image exposure is performed by laser light and subsequently the image is formed by thermal development. Further, recently, compaction of laser imager and acceleration of photographic processing have been required.

Therefore, property improvement of the photothermographic imaging material becomes essential. For the compaction of the thermal development apparatus, it is more advantageous to use a heat drum manner than to use a horizontal transport manner, but there has been problematic in that powder drop-off, density unevenness and roller mark easily occur. Further, even when the rapid processing is carried out, to obtain sufficient density of the photothermographic imaging material, it is effective to use those with small average particle size as silver halide to increase covering power or to use a high contrast agent such as hydrazine compounds and vinyl compounds (see, e.g., JP-A-11-295844 and JP-A-11-352627). However, when these technologies are used, trouble matters have occurred where density change with time after the thermal development (print out property) becomes large and the density unevenness at the thermal development deteriorates. Also, it is possible to improve the print out property by reducing an amount of a reducing agent or by reducing the amount of coated silver, but the trouble matter has occurred where the image density is decreased with time. Further, the trouble matter has occurred where silver color tone become greatly different from that of conventional wet-type X-ray film due to making silver halide fine particles. Disclosed are improving technology for the print out property (see, e.g., JP-A-2001-133925), modulation technology for the silver color tone (see, e.g., JP-A-2002-169249 and JP-A-2002-236334), and the technology where the increase of the photographic fog is inhibited at undeveloped states and during storage after the development (see, e.g., U.S. Pat. No. 5,686,228 Specification, U.S. Pat. No. 6,171,767 Specification and JP-A-2002-236335). But it could not say that they are sufficient to solve the above trouble matters.

SUMMARY OF THE INVENTION

The present invention has been performed in view of the above problems. An object of the present invention is to provide a photothermographic imaging material with high sensitivity and low photographic fog, which is excellent in image storage stability after thermal development.

Further, another object of the invention is to provide a photothermographic imaging material which is high density and is excellent in silver color tone, light radiated image storage stability, image storage stability at the time of storage with high temperature and photographic fog property with time.

In order to achieve the above-described objects, according to a first aspect of the present invention, the photothermographic imaging material of the present invention comprises a support; a photosensitive layer containing photosensitive silver halide particles on at least one face of the support; and a non-photosensitive layer provided on a side of the support where the photosensitive layer is provided;

wherein at least one of the photosensitive layer and the non-photosensitive layer contains an organic silver salt, a reducing agent, a compound represented by the Formula (1) and a compound represented by the Formula (2a).

(1)

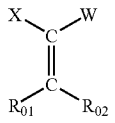

-continued (2a)

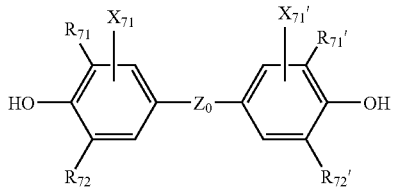

Here, in the above-described Formula (1), the X and the $R_{01}$ are represented in the form of cis, however, the form where the X and the $R_{01}$ are trans is included.

In the photothermographic imaging material of the present invention, the X includes an acyl group, and the acyl group of each of the X and the W is preferable to be substantially free from a formyl group.

Further, according to a second aspect of the present invention, the photothermographic imaging material of the present invention comprises: a support; a photosensitive layer containing organic silver, silver halide and reducing agent, the photosensitive layer being provided on the support; a polymer containing at least one repeated unit of an aliphatic monomer having a halogen radical releasing group; and a compound represented by the following Formula (2).

(2)

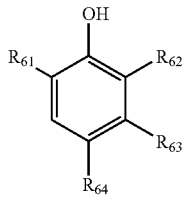

According to the photothermographic imaging material of the present invention, it becomes high density and excellent in light radiated image storage stability, and moreover, silver tone can be improved and environmental suitability (accumulation property in vivo) can be improved.

In the photothermographic imaging material of the present invention, preferably, the aliphatic monomer having the halogen radical releasing group is a monomer represented by formula (11).

(11)

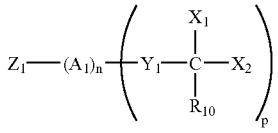

Furthermore, according to a third aspect of the present invention, the photothermographic imaging material of the present invention comprises: a support; a photosensitive layer containding organic silver, silver halide and reducing agent, the photosensitive layer being provided on the support; a polymer containing at least one repeated unit of a monomer represented by the following Formula (12); and a compound represented by the above-described Formula (2).

(12)

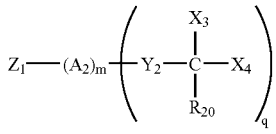

Further, according to a fourth aspect of the present invention, the photothermographic imaging material of the present invention comprises: a support; a photosensitive layer containing organic silver, silver halide and reducing agent, the photosensitive layer being provided on the support; a polymer containing at least one repeated unit represented by the following Formula (15) in polyvinyl butyral; and a compound represented by the above-described Formula (2).

(15)

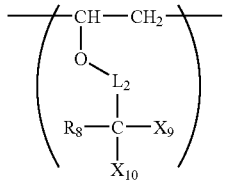

In the above-describe second to fourth aspects, preferably, a glass transition temperature Tg of the binder is between 70° C. and 150° C. Thereby, the image storage stability at the time of conservation at high temperature can be further improved.

More preferably, the compound represented by the Formula (2) is a compound represented by the following Formula (2a).

(2a)

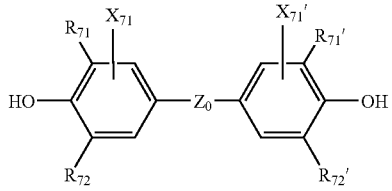

Further, the material is preferable to contain at least one compound selected from the following Formula (A-8).

$$(Rf\text{-}(L_1)_{n1}\text{-})_p\text{-}(Y)_{m1}\text{-}(A)_q \quad \text{(A-8)}$$

The Rf represents a fluorine atom-containing substituent, the $L_1$ represents a bivalent linkage group free from a fluorine atom, the Y represents a bivalent to tetravalent linkage group free from a fluorine atom, the A represents an anion group or a salt group thereof, each of the n1 and the m1 represents an integer of 0 or 1, the p represent an integer of 1 to 3, and the q represents an integer of 1 to 3, and when the q is 1, the n1 and the m1 are not 0 simultaneously.

Thereby, the film transport and the environmental suitability (accumulation in vivo) can be further improved.

Moreover, a side of a layer including the photosensitive layer of the material may contain at least one kind of silver saving agent selected from a vinyl compound, a hydrazine derivative, a silane compound and quaternary onium salt.

Preferably, the material contains silver halide having a mean particle size of 10 nm to 40 nm as the silver halide.

The mean particle size of the silver halide is preferable to be between 10 nm and 35 nm. When the mean particle size of the silver halide is smaller than 10 nm, there is a case that the image density lowers or the light radiated image storage stability deteriorates. Further, when it exceeds 40 nm, there is a case that the image density lowers. The mean particle size here means the length of the edge of the silver halide particle when the silver halide particle is a so-called normal crystal of cube or octahedron. Further, when the silver halide particle is a flat plate-like particle, the mean particle size is the diameter when the project area of the main surface is converted to a circle image having the same area as the project area. When it is another, but not a normal crystal, for example, when it is a spherical particle, rod-like particle or the like, the diameter when considering a sphere equivalent to the volume of the silver halide particle is calculated as the particle size. Measurement is performed by using an electron microscope, and it is preferable to calculate a mean particle size by averaging the measurement values of 300 particle sizes.

Further, the material is preferable to contain silver halide having a mean particle size of 10 nm to 40 nm and silver halide having a mean particle size of 45 nm to 100 nm as the silver halide.

Thus, the silver halide having a mean particle size of 45 nm to 100 nm is used together with the silver halide having a mean particle size of 10 nm to 40 nm. Thereby, the image density can be improved, and lowering of the image density with time can be improved (made small). Preferably, the mass ratio of the silver halide having a mean particle size of 10 nm to 40 nm and the silver halide having a mean particle size of 45 nm to 100 nm as the silver halide is between 95:5 and 50:50, more preferably, between 90:10 and 60:40.

Furthermore, the material is preferable to contain silver halide chemically sensitized by a chalcogen compound as the silver halide. Further, an amount of silver contained in the photosensitive layer is preferable to be between 0.3 and 1.5 g/m$^2$.

Further, in the above-described first aspect, preferably, at least one of the X and the W represents a cyano group, or the X and the W are bound one another to form a cyclic structure. Further, preferably, at least one of the photosensitive layer and the non-photosensitive layer contains a compound represented by the following Formula (3) or a hydrazine compound.

(3)

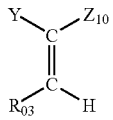

Here, the Y and the $Z_{10}$ may be bound one another to form a cyclic structure. In addition, in the above-described Formula (3), the Y and the $R_{03}$ are represented in the form of cis, however, the form where the Y and the $R_{03}$ are trans is included.

Thus, by using the compound represented by the Formula (3) or the hydrazine compound together, a photothermographic imaging material having high sensitivity and low photographic fog, and excellent in image storage stability after development can be provided.

In addition, the image storage stability after thermal development here means heat resistance (for preventing increase of photographic fog) and light resistance (for preventing deterioration of maximum density and change of silver tone) after thermal development.

Further, the organic silver salt is preferable to be prepared by using organic acid potassium salt obtained from potassium hydroxide and organic acid.

Further, preferably, the photothermographic imaging material in the first to fourth aspects of the present invention contains reducing agent represented by the following Formula (A-1), (A-4), (A-5) or (7).

(A-4)

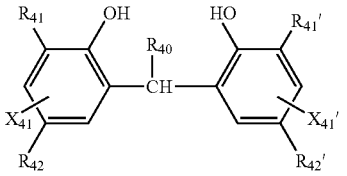

(A-5)

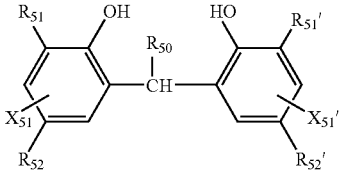

(7)

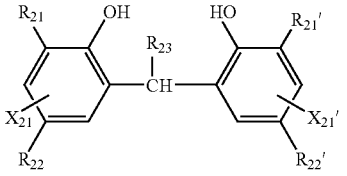

Here, the $R_{40}$ represents the following Formula (A)

(A)

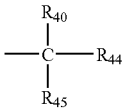

More preferably, the reducing agent represented by Formula (A-1) is reducing agent represented by the following Formula (A-2).

(A-2)

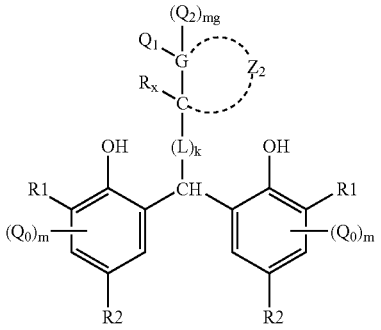

Furthermore, the non-aromatic ring represented by the $Z_2$ in Formula (A-2) is preferable to be a six member.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

DETAILED DESCRIPTION OF THE INVENTION

Figure 1:
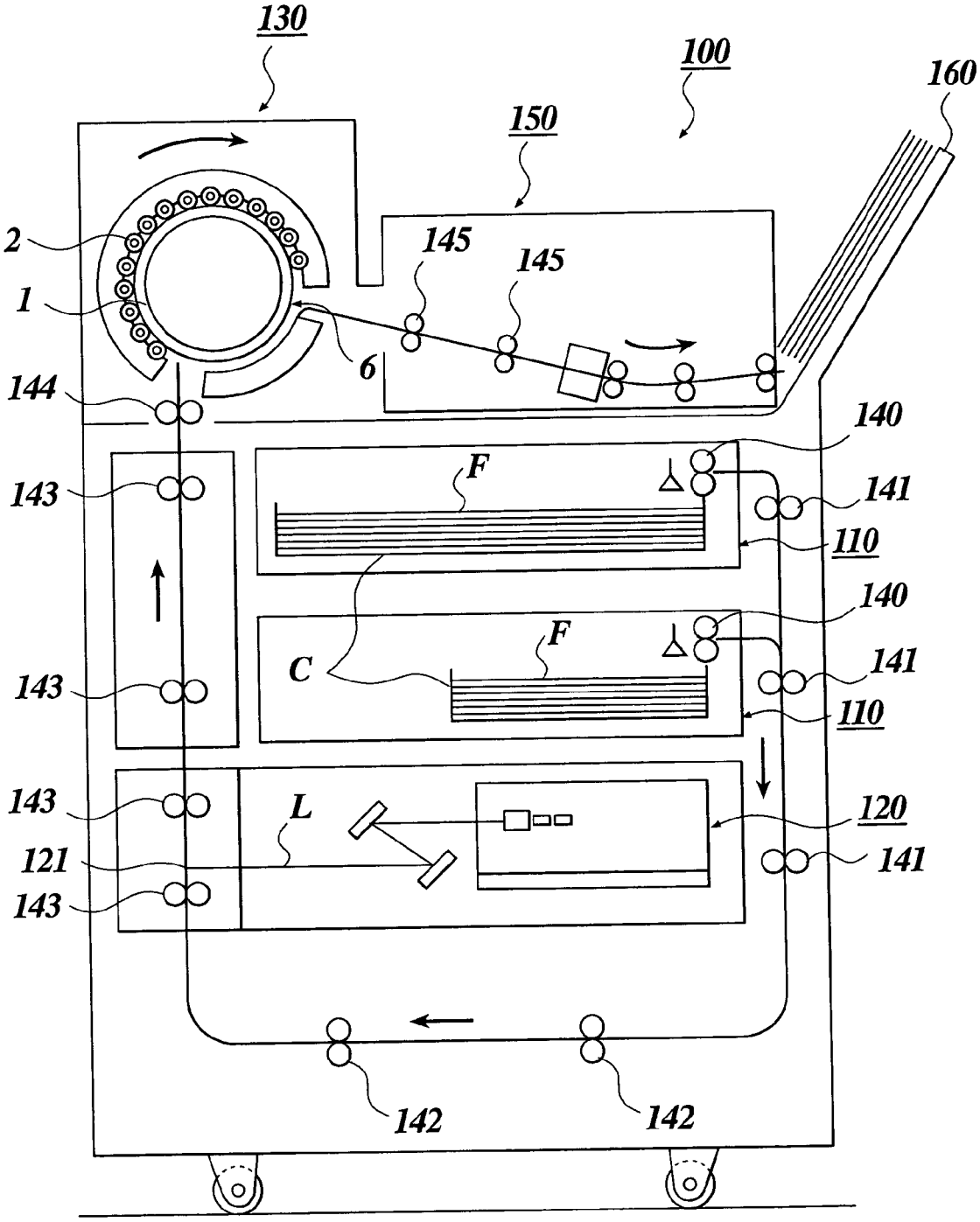
FIG. 1 is a view showing a concrete example of a thermal development treatment apparatus.

Hereinafter, the present invention is described in detail. First, the compounds represented by the Formula (1) of the present invention are described in detail. An electron withdrawing group represented by X is a substituent where Hammett's substituent constant up can be a positive value. Specifically, included are substituted alkyl groups (halogen substituted alkyl, etc.), substituted alkenyl groups (cyanovinyl, etc.), substituted, unsubstituted alkynyl groups (trifluoromethylacetylenyl, cyanoacetylenyl, formylacetylenyl, etc.), substituted aryl groups (cyanophenyl, etc.), substituted, unsubstituted heterocyclic groups (pyridyl, triazinyl, benzoxazolyl, etc.), halogen atoms, cyano groups, acyl groups (acetyl, trifluoroacetyl, formyl, etc.), thioacyl groups (thioformyl, thioacetyl, etc.), oxalyl groups (methyloxalyl, etc.), oxyoxalyl group (ethoxalyl, etc.), —S-oxalyl groups (ethylthioxalyl, etc.), oxamoyl groups (methyloxamoyl, etc), oxycarbonyl groups (ethoxycarbonyl, carboxyl, etc.), —S-carbonyl groups (ethylthiocarbonyl, etc.), carbamoyl, thiocarbamoyl, sulfonyl, sulfinyl groups, oxysulfonyl groups (ethoxysulfonyl, etc.), —S-sulfonyl groups (ethylthiosulfonyl, etc.), sulfamoyl, oxysulfinyl groups (methoxysulfinyl, etc.), —S-sulfinyl groups (methylthiosulfinyl, etc.), sulfinamoyl, phosphoryl, nitro, imino groups (imino, N-methylimino, N-phenylimino, N-pyridylimino, N-cyanoimino, N-nitroimino, etc.), N-carbonylimino groups (N-acetylimino, N-ethoxycarbonylimino, N-ethoxalylimino, N-formylimino, N-trifluoroacetylimino, N-carbamoylimino, etc.), N-sulfonylimino groups (N-methanesulfonylimino, N-trifluoromethanesulfonylimino, N-methoxysulfonylimino, N-sulfamoylimino, etc.), ammonium, sulfonium, phosphonium, pyrilium, immonium groups and the like, and also comprised are heterocyclic groups where ammonium, sulfonium, phosphonium, immonium and the like form the ring. As a σp value, the value of 0.2 or more is preferable, and the value of 0.3 or more is more preferable.

W includes a hydrogen atom, alkyl groups (methyl, ethyl, trifluoromethyl, etc.), alkenyl groups (vinyl, halogen substituted vinyl, cyanovinyl, etc.), alkynyl groups (acetylenyl, cyanoacetylenyl, etc.), aryl groups (phenyl, chlorophenyl, nitrophenyl, cyanophenyl, pentafluorophenyl, etc.), heterocyclic groups (pyridyl, pyrimidyl, pyrazinyl, quinoxalyl, triazinyl, succinimide, tetrazolyl, triazolyl, imidazolyl, benzoxazolyl, etc.), and further as described in the above X, halogen atoms, cyano, acyl, thioacyl, oxalyl, oxyoxalyl, —S-oxalyl, oxamoyl, oxycarbonyl, —S-carbonyl, carbamoyl, thiocarbamoyl, sulfonyl, sulfinyl, oxysulfonyl, —S-sulfonyl, sulfamoyl, oxysulfinyl, —S-sulfinyl, sulfinamoyl, phosphoryl, nitro, imino, N-carbonylimino, N-sulfonylimino, ammonium, sulfonium, phosphonium, pyrilium, immonium and the like.

In addition, as acyl groups represented by X and W, preferably included are alkyl carbonyl groups (acetyl, trifluoroacetyl etc.), alkenyl carbonyl groups (3-cyanopropenoyl etc.), alkynyl carbonyl groups (acetylene carbonyl etc.) and aryl carbonyl groups (p-cyanobenzoyl etc.).

As W, the above aryl and heterocyclic groups are also preferable in addition to the electron withdrawing groups where the σp value which is Hammett's substituent constant can be the positive value.

Further, X and W may be bound one another to form a cyclic structure. As the ring formed by X and W, included are saturated or unsaturated carbocyclic or heterocycles which may have condensed rings, and may be cyclic ketone. As the heterocycles, preferred are those comprising one or more, further one to two of at least one atom in N, O and S.

$R_{01}$ includes hydroxyl group or organic or inorganic salts of hydroxyl group. Specific examples of alkyl, alkenyl, alkynyl, aryl and heterocyclic groups represented by $R_{02}$ include respective examples of alkyl, alkenyl, alkynyl, aryl and heterocyclic groups exemplified as W.

Further, in the present invention, all of X, W, and $R_{02}$ may comprise an anti-diffusion group. The anti-diffusion group is called a ballast group in couplers for photographs, and makes the added compound a bulky molecular weight not to migrate in film of the imaging material.

Further, in the present invention, X, W, and $R_{02}$ may comprise an absorption facilitating group to the silver salt. The absorption facilitating groups to the silver salt include thioamide, aliphatic mercapto, aromatic mercapto, heterocyclic mercapto groups, and the groups represented by 5- to 6-membered nitrogen-containing heterocycles such as benzotriazole, triazole, tetrazole, indazole, benzimidazole, imidazole, benzothiazole, thiazole, benzoxazole, oxazole, thiadiazole, oxadiazole and triazine.

In the present invention, it is preferred that at least one in X and W represents cyano group or that X and W are bound one another to form the cyclic structure.

Further, in the present invention, the compounds comprising thioether group (—S—) in the substituents represented by X, W and $R_{02a}$re preferable.

Further, preferred are those where at least one in X and W has alkene group represented by the following Formula (1a).

$$—C(R_{04})=C(Y_{10})(Z_{11}) \quad (1a)$$

$R_{04}$ represents a hydrogen atom or a substituent, and $Y_{10}$ and $Z_{11}$ each represents hydrogen atoms or substituents, but at least one in $Y_{10}$ and $Z_{11}$ represents an electron withdrawing group.

Examples of the electron withdrawing groups in the substituents represented by $Y_{10}$ and $Z_{11}$ include those included as the electron withdrawing groups of X and W mentioned above in addition to cyano and formyl groups.

X and W represented by the above Formula (1a) include the following groups.

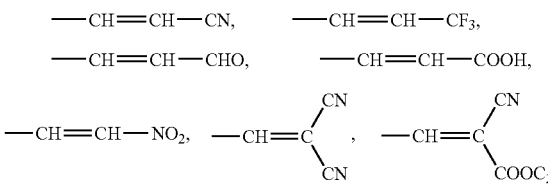

-continued

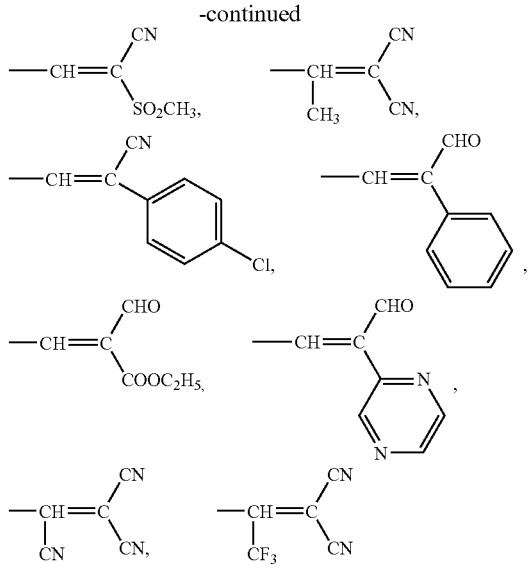

Further, preferred are those where at least one in X and W has the following alkyne group.

$$—C≡C—R_5$$

$R_5$ represents a hydrogen atom or a substituent, as the substituent, preferred are the electron withdrawing groups included in X and W mentioned above. X and W represented by the above Formula (1a) include, for example, the following groups.

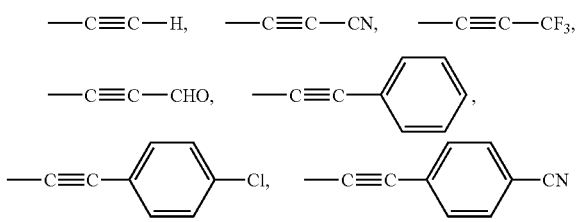

Further, preferred are those where at least one in X and W has acyl group selected from substituted alkylcarbonyl, alkenylcarbonyl, and alkynylcarbonyl groups, and as X and W included are, for example, the following groups.

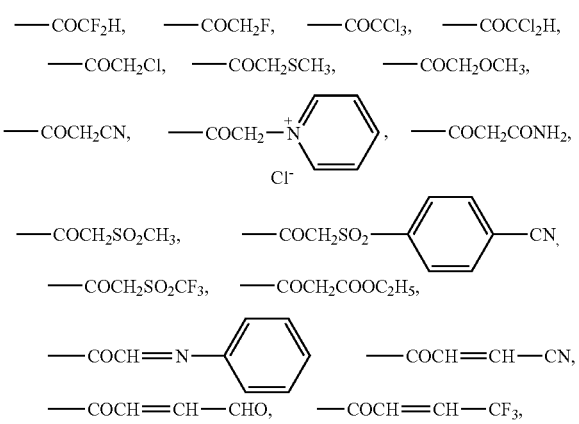

-continued

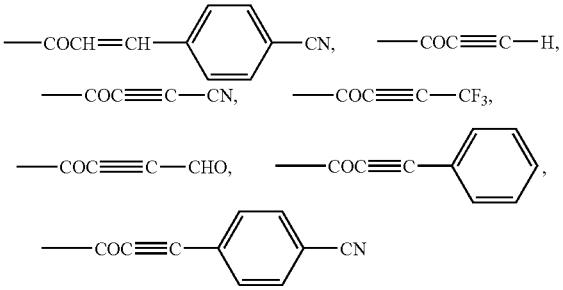

Further, preferred are those where at least one in X and W has oxalyl group, and X and W having oxalyl group include, for example, the following groups.

—$COCOCH_3$, —$COCOOC_2H_5$, —$COCONHCH_3$, —$COCOSC_2H_5$, —$COCOOC_2H_4SCH_3$, —$COCONHC_2H_4SCH_3$

Further, preferred are those where at least one in X and W has aryl group substituted with the electron withdrawing group or nitrogen-containing heterocyclic group, and such X and W include, for example, the following groups.

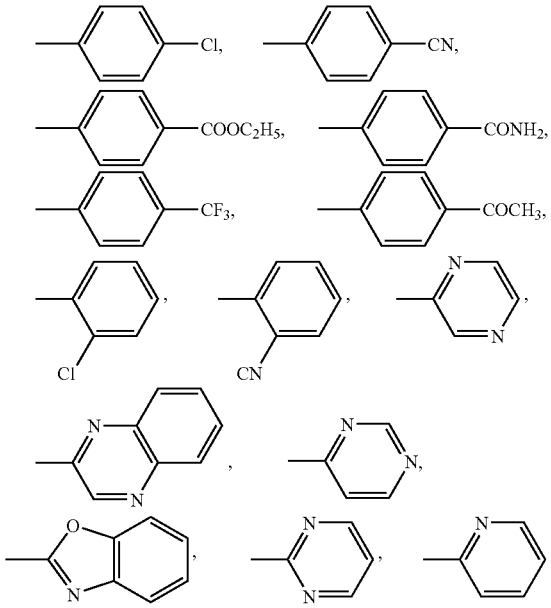

In the present invention, the alkene compounds represented by the Formula (1) comprise all isomers when they can take an isomer structure for double bonds which X, W, $R_{01}$ and $R_{02}$ substitute, and also comprise all isomers when they can take a tautomeric structure such as keto-enol.

Hereinafter, specific examples of the compounds represented by the Formula (1) are shown, but the invention is not limited thereto.

(1)-1

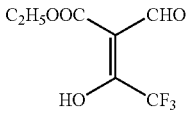

-continued (1)-2

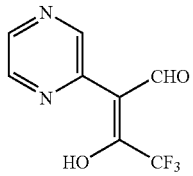

(1)-3

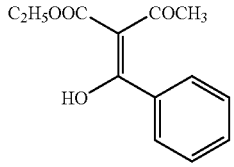

(1)-4

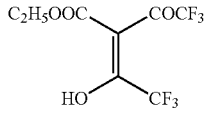

(1)-5

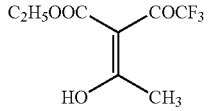

(1)-6

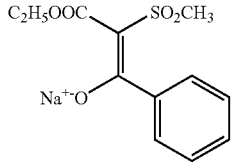

(1)-7

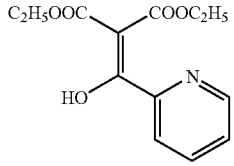

(1)-8

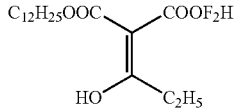

(1)-9

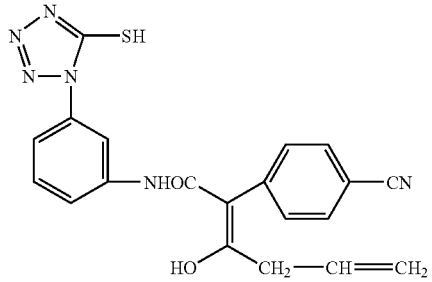

(1)-10

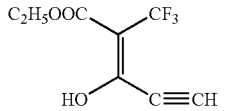

(1)-11

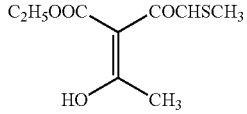

-continued
(1)-12
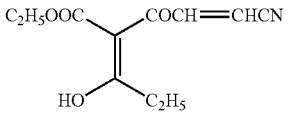
(1)-13
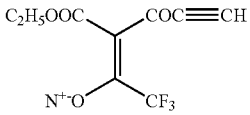
(1)-14
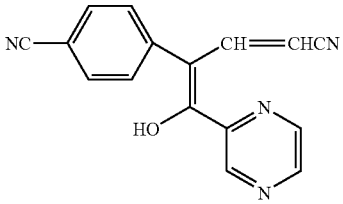
(1)-15
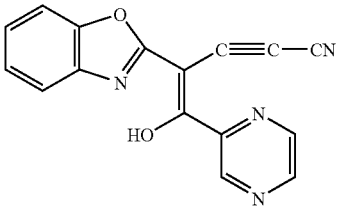
(1)-16
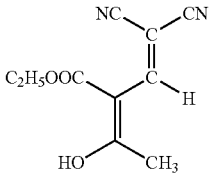
(1)-17
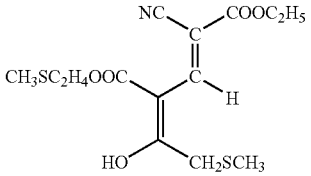
(1)-18
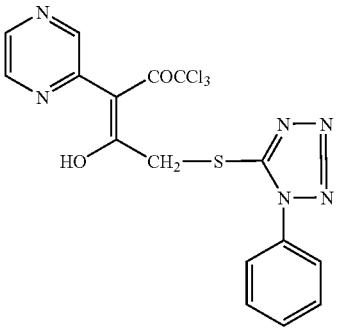
(1)-19
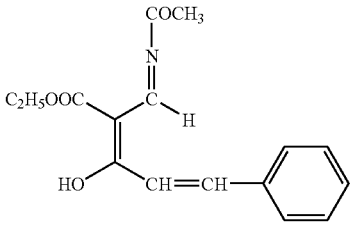
-continued
(1)-20
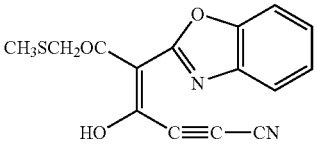
(1)-21
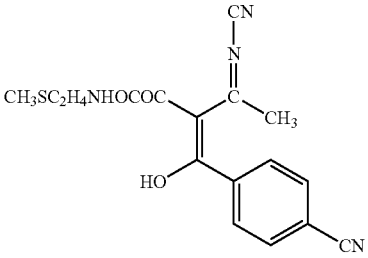
(1)-22
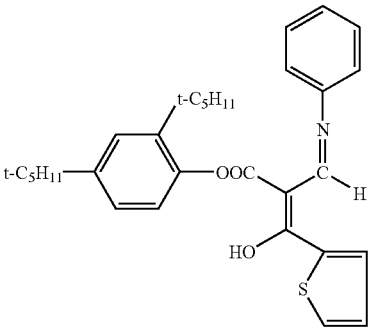
(1)-23
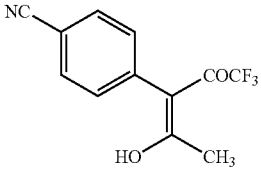
(1)-24
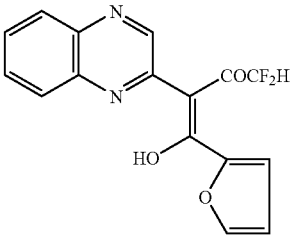
(1)-25
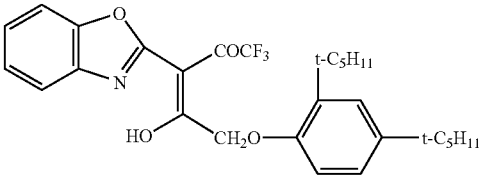
(1)-26
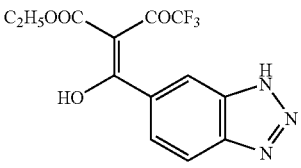

-continued
(1)-27
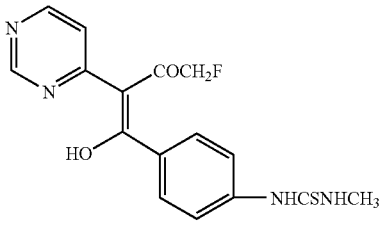
(1)-28
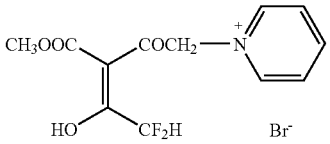
(1)-29
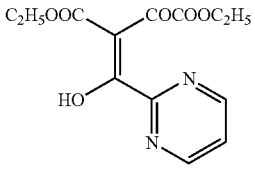
(1)-30
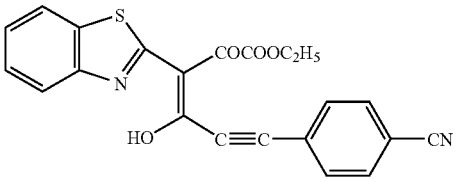
(1)-31
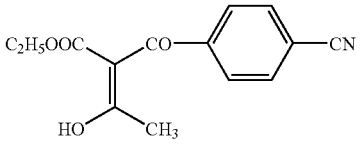
(1)-32
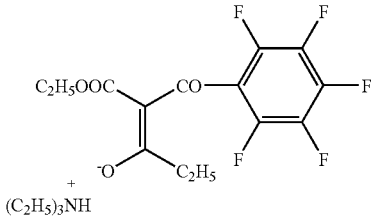
(1)-33
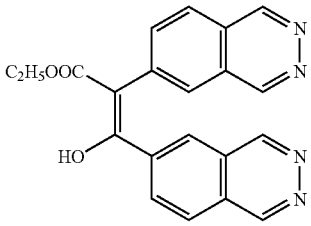
(1)-34
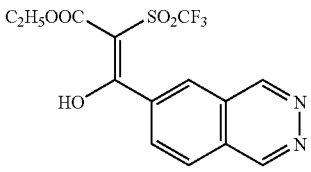
-continued
(1)-35
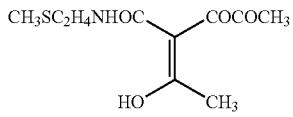
(1)-36
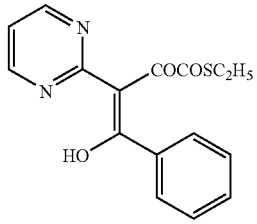
(1)-37
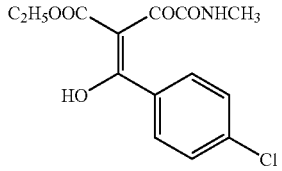
(1)-38
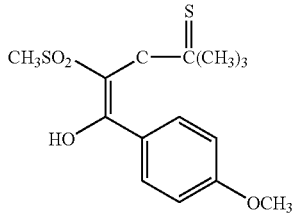
(1)-39
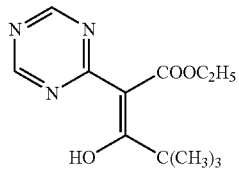
(1)-40
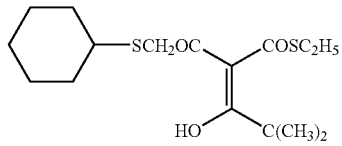
(1)-41
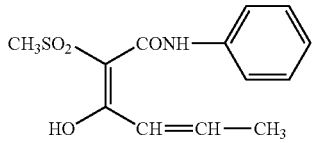
(1)-42
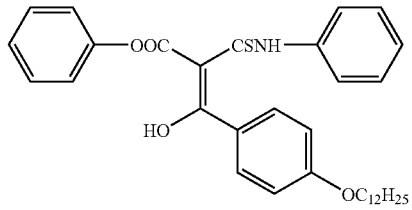

-continued
(1)-43
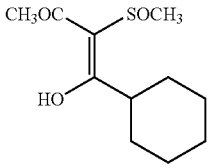
(1)-44
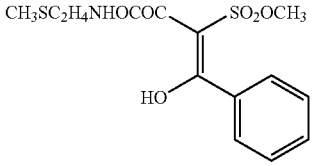
(1)-45
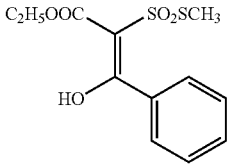
(1)-46
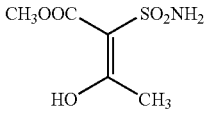
(1)-47
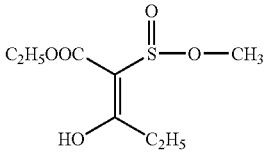
(1)-48
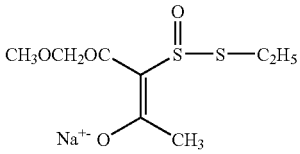
(1)-49
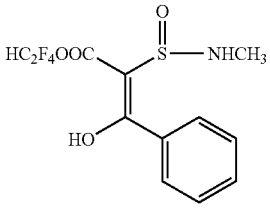
(1)-50
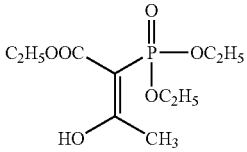
(1)-51
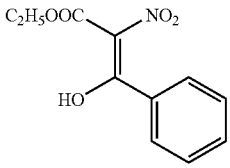
-continued
(1)-52
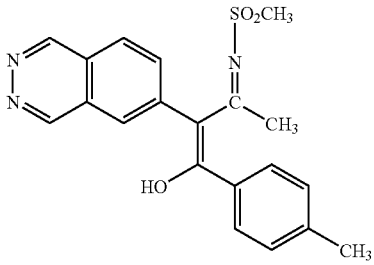
(1)-53
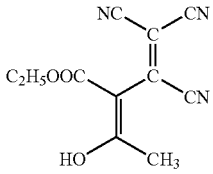
(1)-54
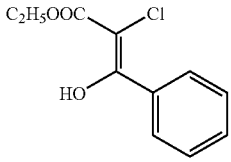
(1)-55
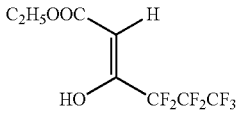
(1)-56
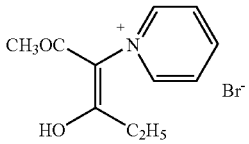
(1)-57
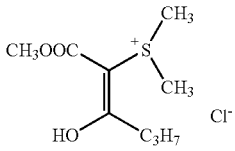
(1)-58
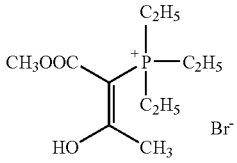
(1)-59
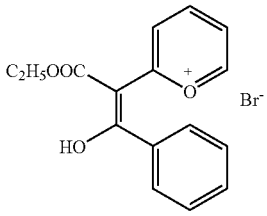

-continued
(1)-60
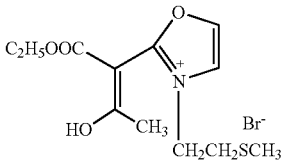
(1)-61
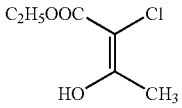
(1)-62
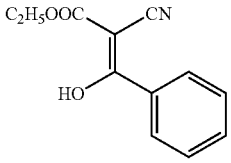
(1)-63
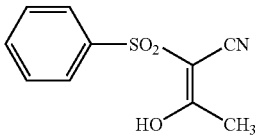
(1)-64
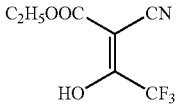
(1)-65
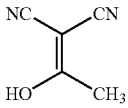
(1)-66
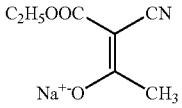
(1)-67
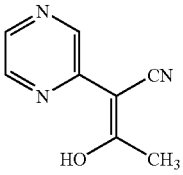
(1)-68
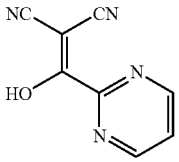
(1)-69
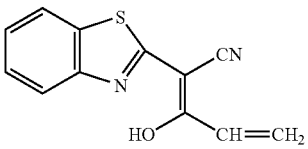
-continued
(1)-70
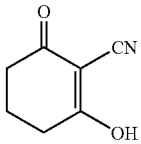
(1)-71
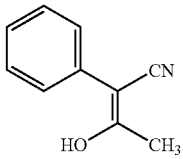
(1)-72
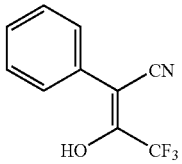
(1)-73
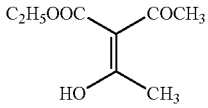
(1)-74
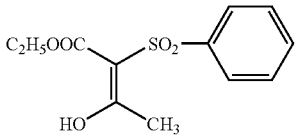
(1)-75
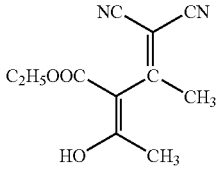
(1)-76
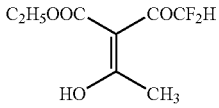
(1)-77
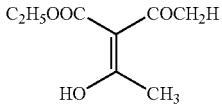
Next, shown are specific examples where X and W are bound together to form the cyclic structure in the Formula (1).
(1)-101
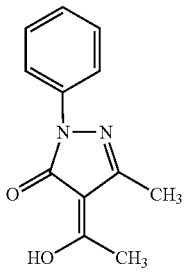

-continued
(1)-102
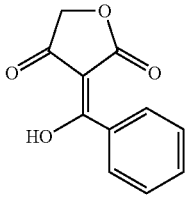
(1)-103
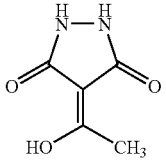
(1)-104
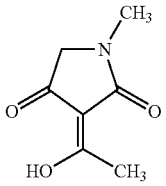
(1)-105
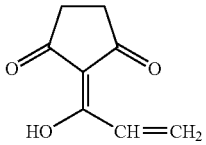
(1)-106
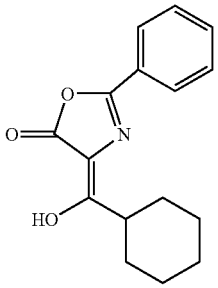
(1)-107
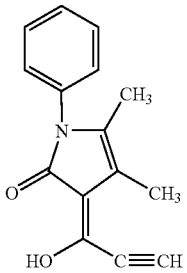
(1)-108
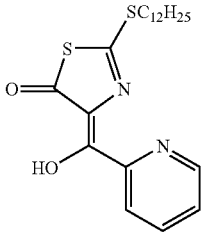
-continued
(1)-109
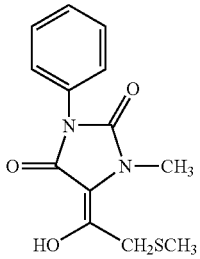
(1)-110
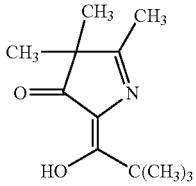
(1)-111
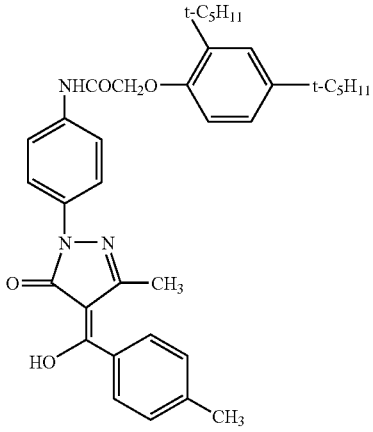
(1)-112
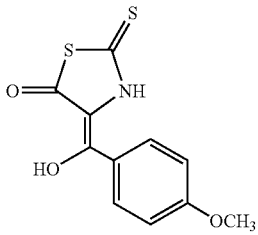
(1)-113
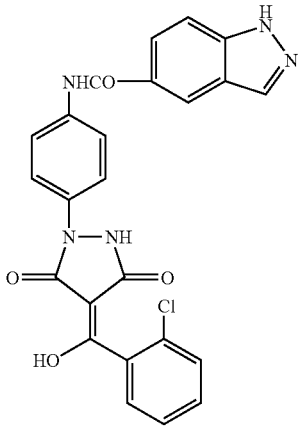

-continued
(1)-114
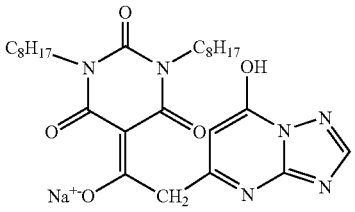
(1)-115
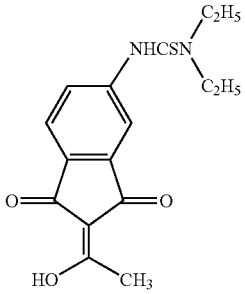
(1)-116
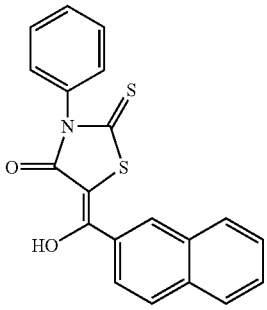
(1)-117
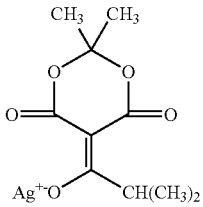
(1)-118
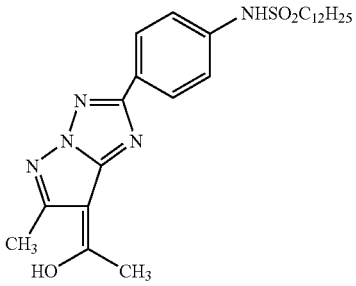
(1)-119
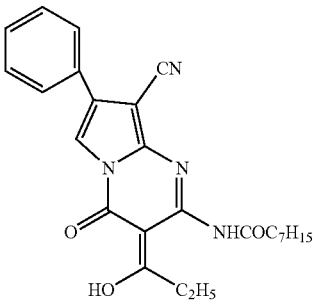
-continued
(1)-120
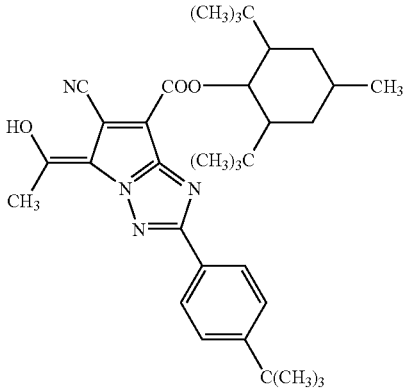
(1)-121
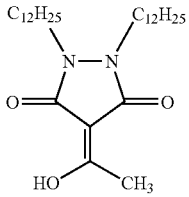
(1)-122
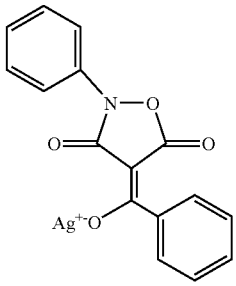
(1)-123
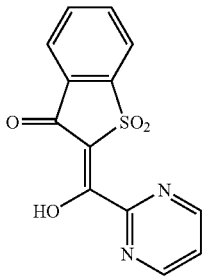
(1)-124
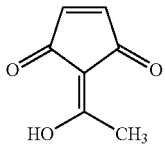
(1)-125
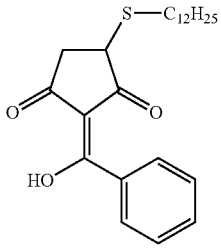

-continued (1)-126

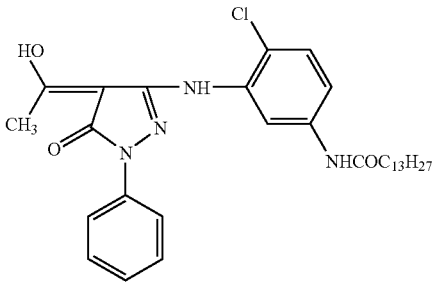

(1)-127

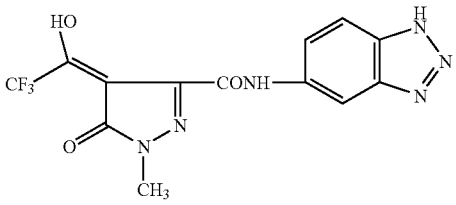

(1)-128

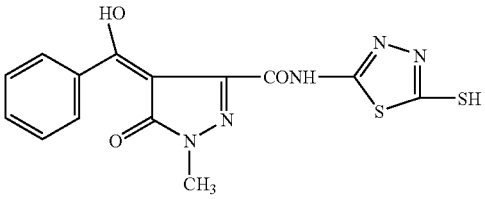

(1)-129

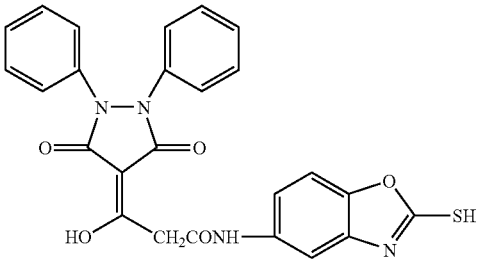

(1)-130

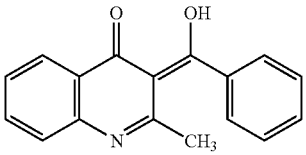

(1)-131

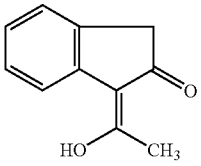

(1)-132

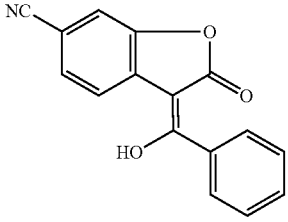

-continued (1)-133

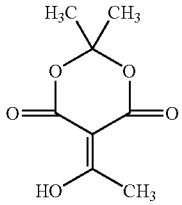

(1)-134

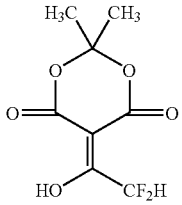

(1)-135

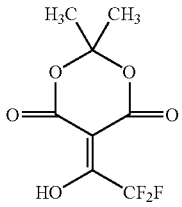

(1)-136

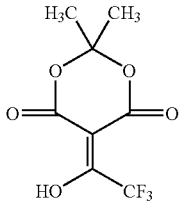

The compounds represented by the Formula (1) of the invention can be synthesized by various methods, and for example, can be synthesized in reference to the method for synthesis described in JP-T-2000-515995.

The example compound (1)-5 can be synthesized, for example, by the following route.

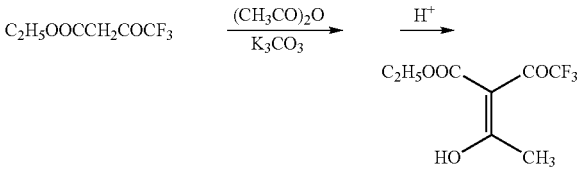

The other compounds represented by the Formula (1) can be synthesized similarly.

The compound represented by the Formula (1) could be contained in at least one layer of a photosensitive layer or non-photosensitive layers at the side of the photosensitive layer of the photothermographic imaging material, but preferably it is contained in at least the photosensitive layer. The addition amount of the compound represented by the Formula (1) is preferably from $1\times10^{-8}$ to 1 mol, more preferably from $1\times10^{-6}$ to $1\times10^{-1}$ mol, and most preferably from $1\times10^{-4}$ to $1\times10^{-2}$ mol based on 1 mol of silver.

The compound represented by the Formula (1) can be added to the photosensitive layer and the non-photosensitive layers by the methods known in the art. That is, it can be added to coating solutions for the photosensitive layer and the non-photosensitive layers by dissolving in polar solvents such as alcohols such as methanol and ethanol, ketones such as methylethylketone and acetone, and dimethylsulfoxide and dimethylformamide. Also, it can be added by making fine particles of 1 μm or less and dispersing in water or the organic solvent. Numerous technologies are disclosed for fine particle dispersion technology, and it can be dispersed according to these technologies.

The compounds of the Formula (2) are described in detail. In the Formula (2), $R_{61}$ represents a substituted or unsubstituted alkyl group. In the Formula (2), when $R_{62}$ is the substituent other than the hydrogen atom, $R_{61}$ represents the alkyl group. As the alkyl group, preferred is the alkyl group with 1 to 30 carbons, and the alkyl group may be unsubstituted or may have substituents. The alkyl groups are specifically preferably methyl, ethyl, butyl, octyl, isobutyl, tert-butyl, tert-octyl, tert-amyl, sec butyl, cyclohexyl, 1-methyl-cyclohexyl groups and the like. It is preferred that it is a sterically larger group than isopropyl group (e.g., isopropyl, isononyl, tert-butyl, tert-amyl, tert-octyl, cyclohexyl, 1-methyl-cyclohexyl, adamantine group, etc.), among others, secondary or tertiary alkyl groups are preferable, and the tertiary alkyl groups such as tert-butyl, tert-octyl and tert-amyl are especially preferable. The substituents when $R_{61}$ has the substituents include halogen atoms, aryl, alkoxy, amino, acyl, acylamino, alkylthio, arylthio, sulfonamide, acyloxy, oxycarbonyl, carbamoyl, sulfamoyl, sulfonyl, phosphoryl and the like.

$R_{62}$ represents a hydrogen atom, a substituted or unsubstituted alkyl group or substituted or unsubstituted acylamino group. The alkyl group represented by $R_{62}$ is preferably the alkyl group with 1 to 30 carbons, and the acylamino group represented by $R_{62}$ is preferably the acylamino group with 1 to 30 carbons. Description for the alkyl group is the same as the case of $R_{61}$. The acylamino group may be unsubstituted or may have substituents, which specifically include acetylamino, alkoxyacetylamino, aryloxyacetylamino groups and the like. $R_{62}$ is preferably a hydrogen atom or an unsubstituted alkyl group with 1 to 24 carbons, and specifically includes methyl, isopropyl and t-butyl. $R_{61}$ and $R_{62}$ are not 2-hydroxyphenylmethyl group.

$R_{63}$ represents a hydrogen atom or a substituted or unsubstituted alkyl group. The alkyl group represented by $R_{63}$ is preferably the alkyl group with 1 to 30 carbons. Description for the alkyl group is the same as the case of $R_{61}$. $R_{63}$ is preferably a hydrogen atom or an unsubstituted alkyl group with 1 to 24 carbons, and specifically includes methyl, isopropyl and t-butyl. Also, it is preferred that either one of $R_{62}$ and $R_{63}$ is a hydrogen atom.

$R_{64}$ represents a group capable of being substituted to benzene ring, and for example, the same group as that described for $R_2$ of the later-described Formula (A-1). As $R_{64}$, preferred are a substituted or unsubstituted alkyl group with 1 to 30 carbons and oxycarbonyl group with 2 to 30 carbons. Alkyl groups with 1 to 24 carbons are more preferable. The substituents of the alkyl group include aryl, amino, alkoxy, oxycarbonyl, acylamino, acyloxy, imide, ureido groups and the like, and aryl, amino oxycarbonyl and alkoxy group are more preferable. These substituents of the alkyl group may be further substituted with these substituents.

The Formula (2) is preferably a bisphenol compound represented by the following Formula (2a).

(2a)

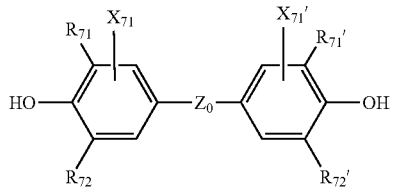

$Z_0$ represents —S— group or —C($R_{73}$)($R_{73}$')— group, $R_{73}$ and $R_{73}$' each represent hydrogen atoms or substituents. The substituents represented by $R_{73}$ and $R_{73}$' include the same groups as the substituents included in the description of $R_{43}$ to $R_{45}$ in the later-described Formula (A-4). $R_{73}$ and $R_{73}$' are preferably hydrogen atoms or alkyl groups.

$R_{71}$, $R_{72}$, $R_{71}$' and $R_{72}$' each represent substituents, and the substituents include the same groups as the substituents included in the description of $R_{43}$ to $R_{45}$ in the later-described Formula (A-4).

$R_{71}$, $R_{72}$, $R_{71}$' and $R_{72}$' are preferably alkyl, alkenyl, alkynyl, aryl, hetero ring groups and the like, and more preferably alkyl groups.

The substituents on alkyl group include the same groups as the substituents included in the description of $R_{43}$ to $R_{45}$ in the later-described Formula (A-4).

$R_{71}$, $R_{72}$, $R_{71}$' and $R_{72}$' are more preferably tertiary alkyl groups such as t-butyl, t-amyl, t-octyl and 1-methylcyclohexyl.

$X_{71}$ and $X_{71}$' each represent hydrogen atoms or substituents, and the substituents include the same groups as the substituents included in the description of $R_{43}$ to $R_{45}$ the later-described Formula (A-4).

The compounds represented by the Formula (2) and (2a) include the compounds (II-1) to (II-40) described in [0032] to [0038] of JP-A-2002-169249, and the compounds (ITS-1) to (ITS-12) described in [0026] of EP 1,211,093.

Hereinafter, specific examples of the bisphenol compounds represented by the Formula (2) and (2a) are shown, but the present invention is not limited thereto.

(2)-1

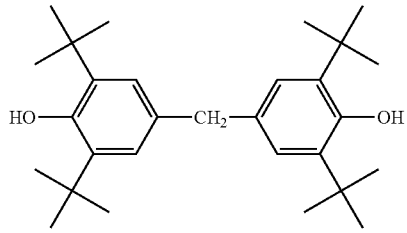

(2)-2

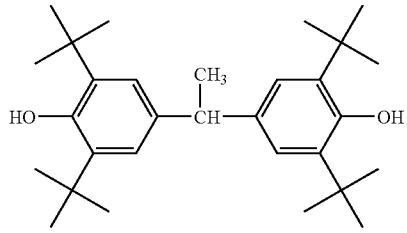

-continued
(2)-3
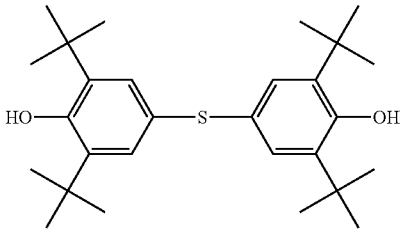
(2)-4
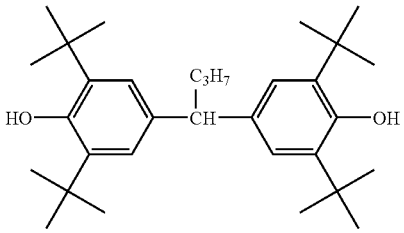
(2)-5
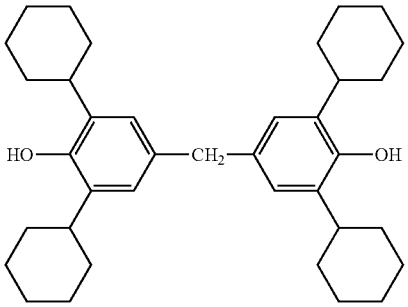
(2)-6
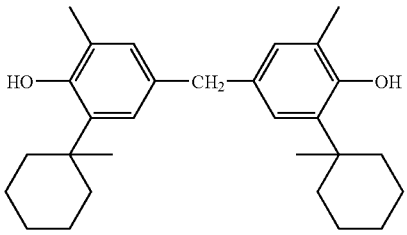
(2)-7
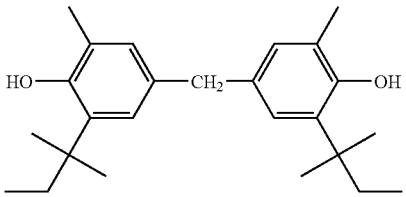
(2)-8
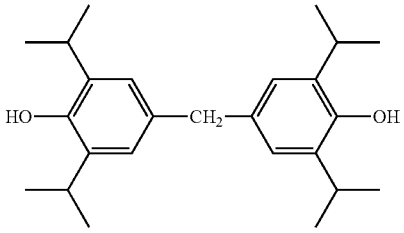
-continued
(2)-9
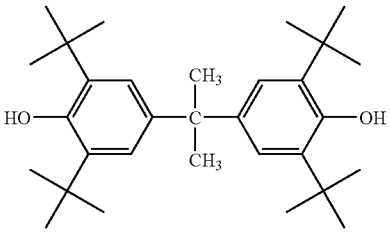
(2)-10
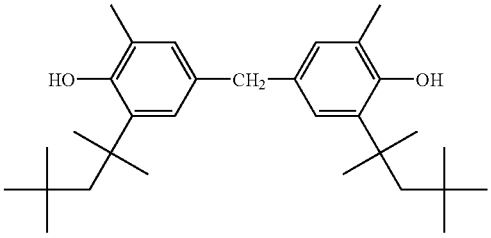
(2)-11
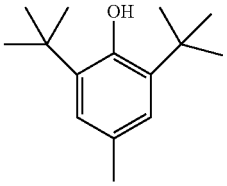
(2)-12
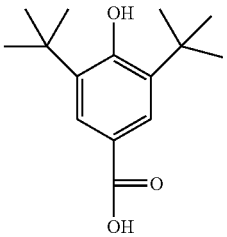
(2)-13
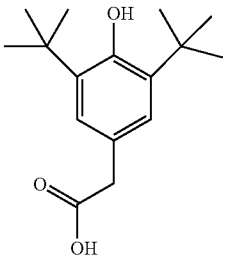
(2)-14
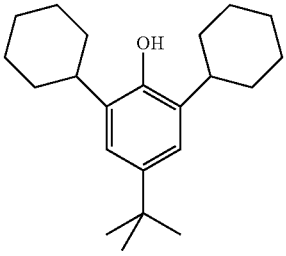

-continued (2)-15

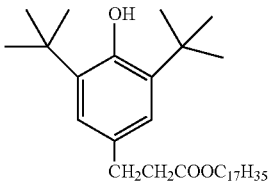

The compounds represented by the Formula (2) and (2a) can be added by the same method as the addition method of the reducing agents represented by the Formula (1) or the later-described Formulas (A-1) to (A-5), and may be contained in the imaging material by being contained in the coating solution by any methods such as a solution form, emulsified dispersion form and solid particulate dispersion form.

An addition amount ratio (molar ratio) of the compound (hindered phenol compound) of the Formula (2) (including the compound of the Formula (2a)) to a total amount of the compounds (polyphenol linked at position o)represented by the Formula (A-1) to (A-5) is in the range of {compounds of Formula (2) and (2a)}/{compounds of Formula (A-1) to (A-5)}=from 0.001 to 0.2, preferably in the range of 0.005 to 0.1, and more preferably in the range of 0.008 to 0.05.

It is preferred that the compounds of the later-described Formulas (A-1) to (A-5) and the Formulas (2) and (2a) are contained in the image formation layer (photosensitive layer) containing the organic silver salt, but one may be contained in the image formation layer and the other may be contained in non-image formation layer adjacent thereto, and both may be contained in the non-image formation layer. Also when the image formation layer is made up of multiple layers, they may be contained in different layers, respectively. In the photothermographic imaging material of the invention, the phenol derivatives represented by the formula (A) described in JP-A-2000-267222 are preferably used as a development accelerator.

Described are the compounds represented by the Formula (3), preferably used in the invention.

Electron withdrawing groups represented by Y include the same groups as the specific examples of the electron withdrawing groups represented by X in the Formula (1). $Z_{10}$ includes the same groups as the specific examples included in W in the Formula (1). Y and $Z_{10}$ may be bound one another to form the cyclic structure as with X and W in the Formula (1).

$R_{03}$ includes halogen atoms, oxy groups (hydroxy, aryloxy, heterocyclic oxy, acyloxy, alkoxy, alkenyloxy, alkynyloxy, alkoxycarbonyloxy, aminocarbonyloxy, etc.), thio groups (mercapto, arylthio, heterocyclic thio, alkylthio, alkenylthio, alkynylthio, acylthio, alkoxycarbonylthio, aminocarbonylthio, etc.), and organic or inorganic salts of hydroxy or mercapto groups, amino groups (amino, alkylamino, arylamino, acylamino, oxycarbonylamino, ureido, sulfonamide, etc.), heterocyclic groups (5- to 6-membered nitrogen-containing heterocycles) and the like.

Heterocyclic groups are 5- to 6-membered nitrogen-containing heterocycles, preferably 5- to 6-membered nitrogen-containing hetero aromatic rings, more preferably those being bound via nitrogen atoms in the ring, and those represented by pyrrole, diazole, triazole, tetrazole and the like. Specifically, imidazole, benzotriazole and the like are preferable.

Preferably $R_{03}$ includes hydroxy, mercapto groups, halogen atoms, organic or inorganic salts of hydroxy or mercapto, heterocyclic residues and the like. $R_{03}$ more preferably includes hydroxy group, organic or inorganic salts of hydroxy, and heterocyclic residues, and in particular hydroxy group, organic or inorganic salts of hydroxy are preferable.

Further, in the present invention, Y, $Z_{10}$ and $R_{03}$ may each contain anti-diffusion group or absorption facilitating group to the silver salt. Specific examples of these groups can include the anti-diffusion groups and the absorption facilitating groups to the silver salts included in X, W and $R_{02}$ in the Formula (1).

In the present invention, the alkene compounds represented by the Formula (3) comprise all isomers when they can take an isomer structure for double bonds which Y, $Z_{10}$, $R_{03}$ and H substitute, and also comprise all isomers when they can take a tautomeric structure such as keto-enol.

Hereinafter, specific examples of the compounds represented by the Formula (3) are shown, but the invention is not limited thereto.

(3)-1

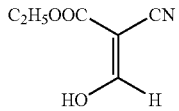

(3)-2

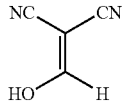

(3)-3

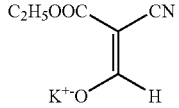

(3)-4

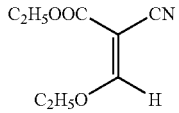

(3)-5

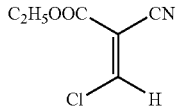

(3)-6

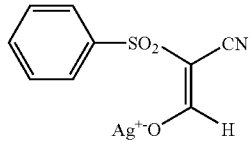

(3)-7

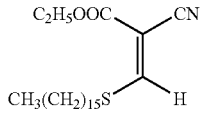

(3)-8

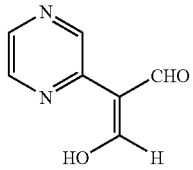

-continued
(3)-9
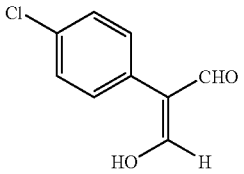
(3)-10
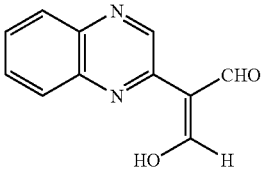
(3)-11
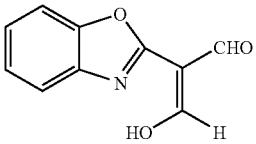
(3)-12
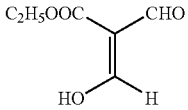
(3)-13
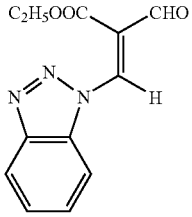
(3)-14
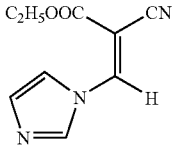
(3)-15
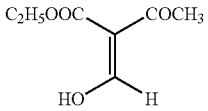
(3)-16
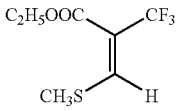
(3)-17
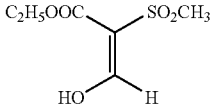
(3)-18
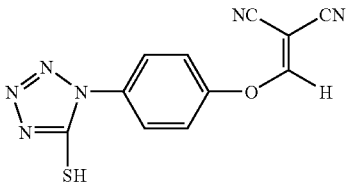
-continued
(3)-19
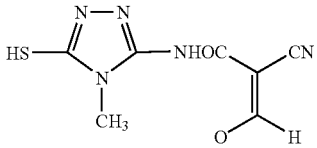
(3)-20
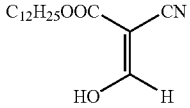
(3)-21
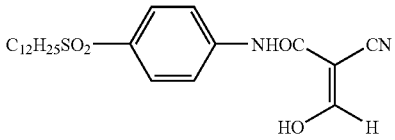
(3)-22
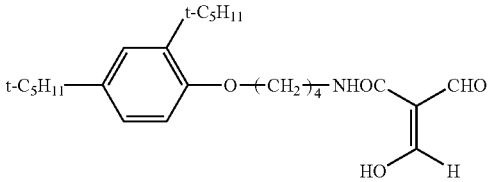
(3)-23
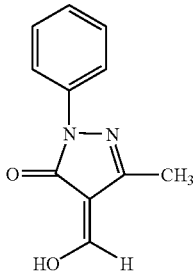
(3)-24
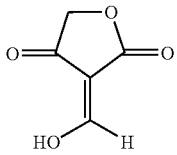
(3)-25
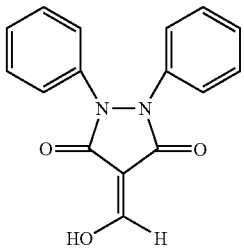
(3)-26
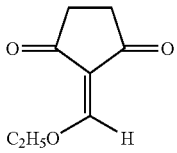

-continued
(3)-27
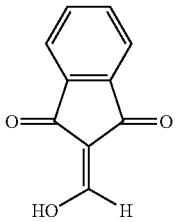
(3)-28
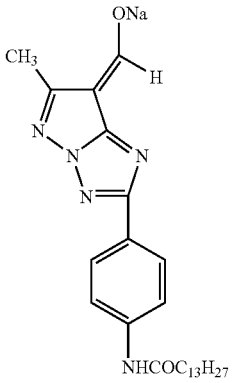
(3)-29
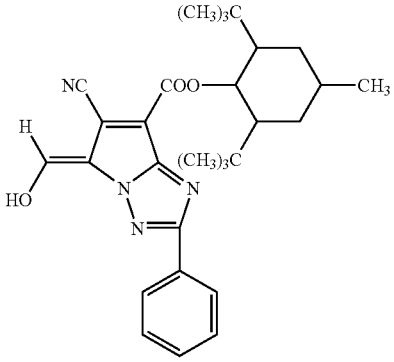
(3)-30
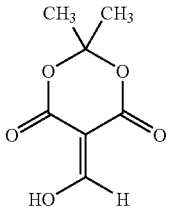
(3)-31
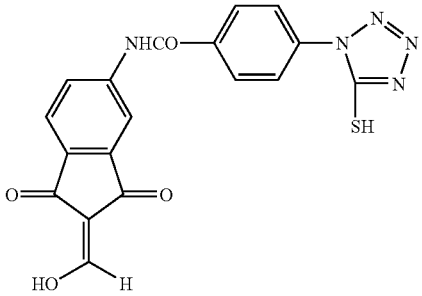
-continued
(3)-32
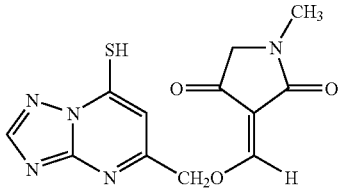
(3)-33
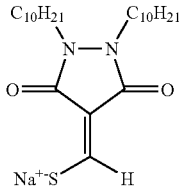
(3)-34
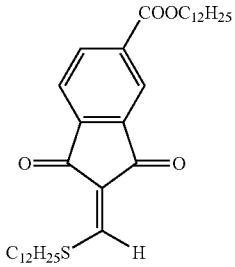
(3)-35
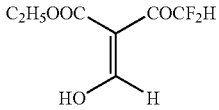
(3)-36
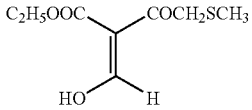
(3)-37
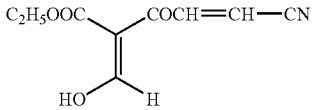
(3)-38
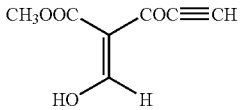
(3)-39
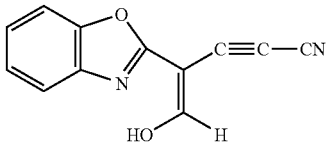
(3)-40
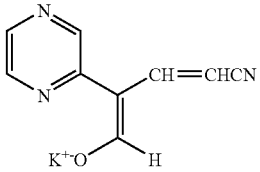

-continued
(3)-41
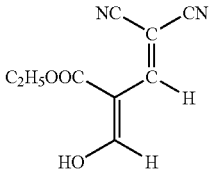
(3)-42
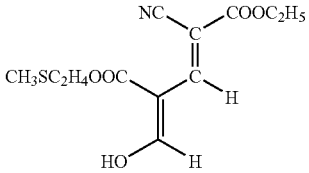
(3)-43
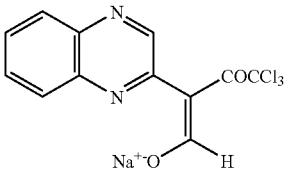
(3)-44
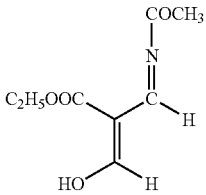
(3)-45
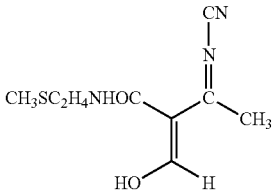
(3)-46
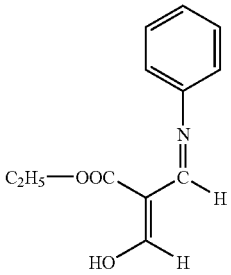
(3)-47
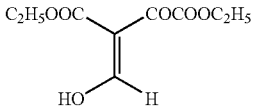
(3)-48
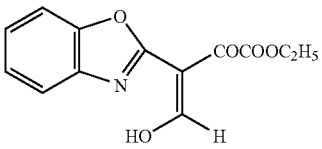
-continued
(3)-49
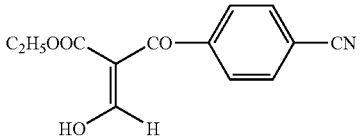
(3)-50
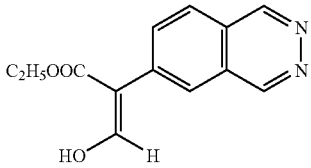
(3)-51
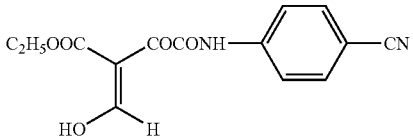
(3)-52
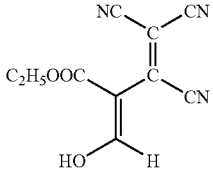
(3)-53
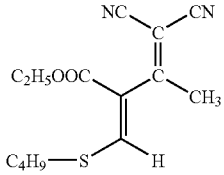
(3)-54
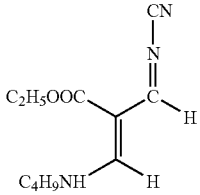
(3)-55
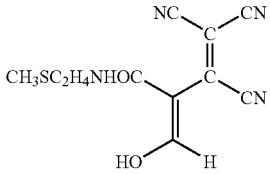
(3)-56
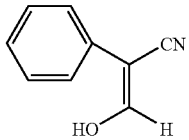
(3)-57
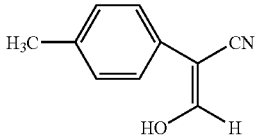

-continued (3)-58

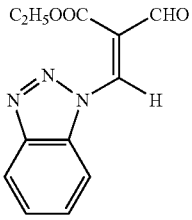

The compounds represented by the Formula (3) of the invention can be synthesized by various methods, and for example, can be synthesized in reference to the methods for synthesis described in U.S. Pat. Nos. 5,545,515, 5,635,339 and JP-A-11-119373.

The example compound (3)-12 can be synthesized, for example, by the following route.

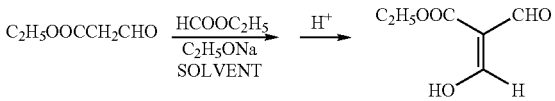

The other compounds represented by the Formula (3) of the invention can be synthesized similarly.

The compound represented by the Formula (3) could be contained in at least one layer of the photosensitive layer or the non-photosensitive layers at the side of the photosensitive layer of the photothermographic imaging material, but preferably it is contained in the same layer as that where the compound represented by the Formula (1) is contained. The addition amount of the compound represented by the Formula (3) is preferably from $1\times10^{-8}$ to 1 mol, more preferably from $1\times10^{-6}$ to $1\times10^{-1}$ mol, and most preferably from $1\times10^{-4}$ to $1\times10^{-2}$ mol based on 1 mol of the silver.

The compound represented by the Formula (3) can be added to the photosensitive layer and the non-photosensitive layers by the same method as that where the compound represented by the Formula (1) is added. That is, it can be added to coating solutions for the photosensitive layer and the non-photosensitive layers by dissolving in polar solvents such as alcohols such as methanol and ethanol, ketones such as methylethylketone and acetone, and dimethylsulfoxide and dimethylformamide. Further, it can be added by making fine particles of 1 μm or less and dispersing in water or the organic solvent. Numerous technologies are disclosed for fine particle dispersion technology, and it can be dispersed according to these technologies.

Described are hydrazine compounds preferably used in the invention.

The hydrazine compounds are the compounds having —NHNH— group, and the preferable representative hydrazine compounds include the compounds represented by the following Formula (4).

T-NHNH—CO—V (4)

In the Formula (4), T represents an alkyl, aryl or heterocyclic group, which may be substituted, respectively, and V represents a hydrogen atom or a blocking group.

As the alkyl groups represented by T, included are linear, branched or cyclic alkyl groups such as methyl, ethyl, propyl, isopropyl and cyclohexyl, and various substituents such as aryl, heterocyclic, acyl and cyano groups may be substituted, and specifically include trityl, benzyl groups and the like.

The aryl groups represented by T comprise benzene ring and naphthalene ring, which may be substituted with various substituents. The preferable substituents include linear or branched alkyl groups (preferably with 1 to 20 carbons, e.g., methyl, ethyl, propyl, isopropyl, dodecyl, trifluoromethyl, etc.), alkoxy groups (preferably with 1 to 20 carbons, e.g., methoxy, ethoxy, propoxy, isopropoxy, dodecyloxy, etc.), aliphatic acylamino groups (preferably having alkyl group with 1 to 21 carbons, e.g., acetylamino, heptylamino, etc.), aromatic acylamino, nitro, cyano, sulfonyl groups and the like. In addition to these groups, also comprised are those where the above substituted or unsubstituted aromatic rings are bound via linkage groups such as —CONH—, —O—, —$SO_2$NH—, —NHCONH— and —$CH_2$CH═N—. The heterocyclic groups represented by T include pyridyl, furyl, thienyl, pyrimidyl, pyrazinyl, quinoxalyl, quinazolyl and the like, and the substituents thereof include the substituents as included in the above aryl groups.

T is preferably phenyl, trityl and heterocyclic groups, and may have the substituents mentioned above. V represents a hydrogen atom or a blocking group, and the blocking groups include, for example, alkyl, aryl, heterocyclic, carbamoyl, oxycarbonyl, oxy, amino groups and the like, to which the substituents included as the substituents to T mentioned above may be substituted similarly.

Specific examples of the blocking groups other than hydrogen atom represented by V include, for example, methyl, methoxymethyl, methylthiomethyl, trifluoromethyl, phenyl, naphthyl, pyridyl, thienyl, furyl, ethoxy, t-butoxy, N-methylcarbamoyl, ethoxycarbonyl, anilino, butylamino, octylamino groups and the like.

The hydrazine compounds can be synthesized in reference to the description of U.S. Pat. Nos. 4,269,929, 5,545,515, JP-T-10-512061, JP-A-9-152702, JP-A-8-286340, JP-A-9-152700, JP-A-9-152701, JP-A-9-152703 and JP-A-9-152704.

To contain the hydrazine compound in the photosensitive layer or the non-photosensitive layers, it can be contained by dissolving the hydrazine compound in the polar solvent such as alcohols such as methanol and ethanol, ethyleneglycols, ethers, ketones such as methylethylketone and acetone, dimethylsulfoxide and dimethylformamide and adding to the coating solution for the above layer. Also, the hydrazine compound can be added by making fine particles of 1 μm or less and dispersing in water or the organic solvent. Numerous technologies are disclosed for fine particle dispersion technology, and it can be dispersed according to these technologies. The addition amount is preferably from $1\times10^{-8}$ to 1 mol, more preferably from $1\times10^{-6}$ to $1\times10^{-1}$ mol, and more preferably from $1\times10^{-4}$ to $1\times10^{-2}$ mol based on 1 mol of the silver.

The hydrazine compounds preferably used for the invention can include the hydrazine compounds described in U.S. Pat. No. 5,545,515, JP-T-10-512061 and JP-A-2002-268176.

Specific examples of the hydrazine compounds are shown below.

4-1
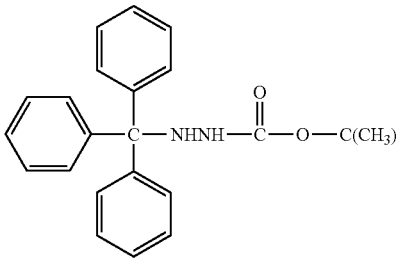
4-2
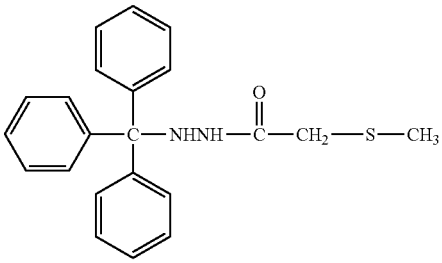
4-3
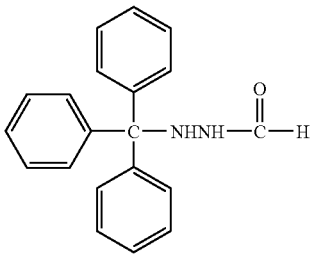
4-4
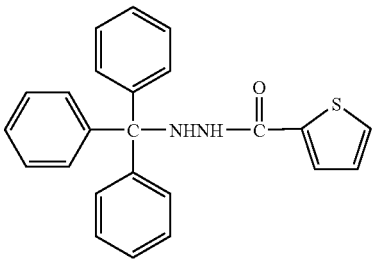
4-5
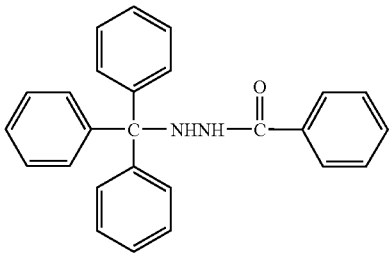
4-6
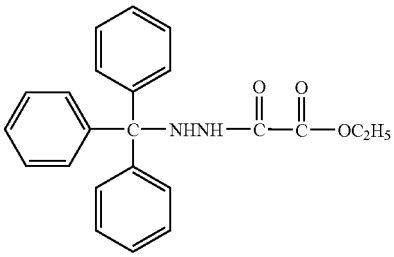
4-7
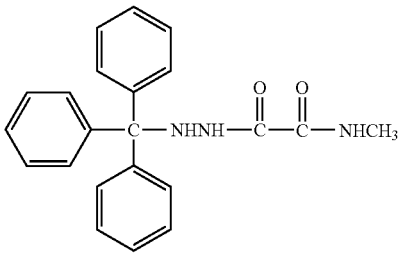
4-8
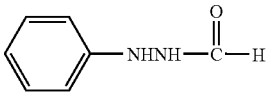
4-9
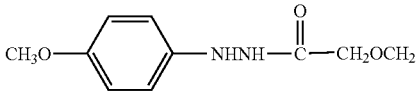
4-10
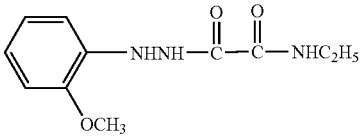
4-11
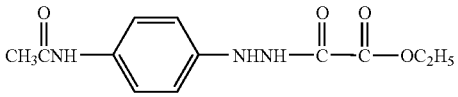
4-12
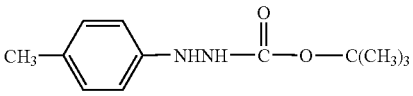
4-13
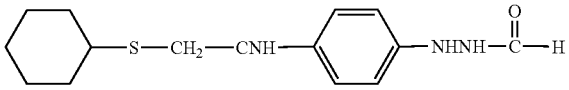
4-14
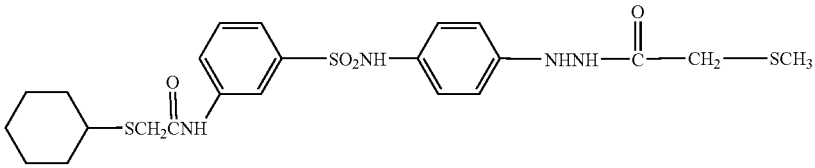

-continued 4-15

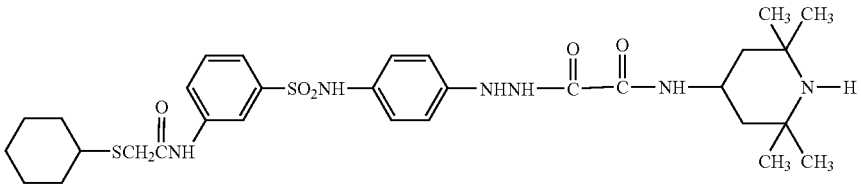

4-16

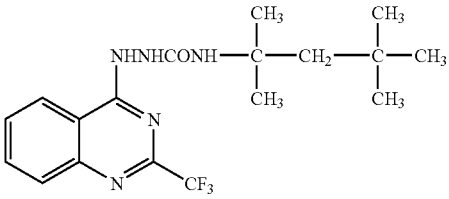

4-17

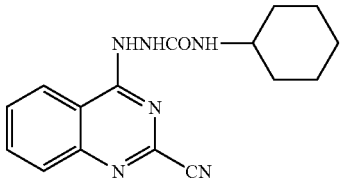

4-18

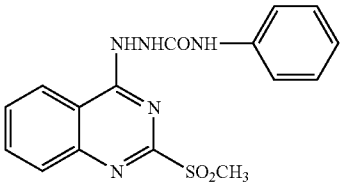

4-19

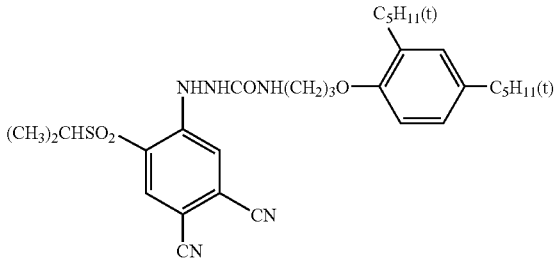

4-20

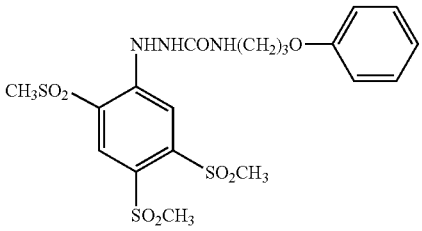

4-21

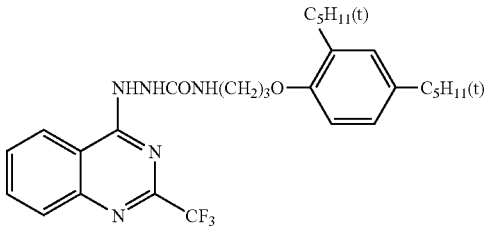

4-22

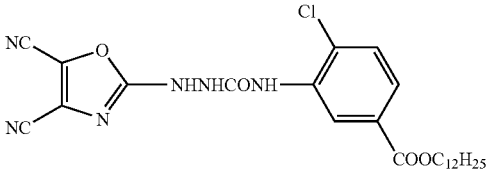

Specific examples of polyhalomethane compounds preferably used for the invention include the compounds of the following Formula (5).

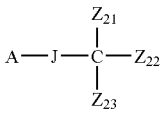

(5)

In the formula, A represents an alkyl, alkenyl, alkynyl, aryl, or heterocyclic group. $Z_{21}$, $Z_{22}$ and $Z_{23}$ each represent hydrogen atoms, halogen atoms, acyl, alkoxycarbonyl, aryloxycarbonyl, sulfonyl or aryl groups, but at least one is a hydrogen atom. J is a group comprising —C(=O)—, —SO— or —$SO_2$—, and —C(=O)—, —SO— or —$SO_2$— is directly bound to C of —C($Z_{21}$)($Z_{22}$)($Z_{23}$).

The alkyl, alkenyl and alkynyl groups represented by A include the same groups as described for W in the Formula (1).

The aryl groups represented by A may be monocyclic or condensed rings, are preferably monocyclic or bicyclic aryl groups with 6 to 30 carbons, more preferably phenyl or naphthyl groups, and still preferably phenyl groups.

The heterocyclic groups represented by A are 3- to 10-membered saturated or unsaturated heterocyclic groups containing at least one of N, O or S atom, and these may be monocyclic or may further form a condensed ring with the other ring. The heterocyclic groups are preferably 5- to 6-membered unsaturated heterocyclic groups which may have the condensed ring, and more preferably 5- to 6-membered aromatic heterocyclic groups which may have the condensed ring. Still preferably, they are nitrogen atom-containing 5- and 6-membered aromatic heterocyclic groups which may have the condensed ring, and especially preferably 1 to 4 nitrogen atom-containing 5- to 6-membered aromatic heterocyclic groups which may have the condensed ring.

The heterocycles in such heterocyclic groups are preferably imidazole, pyrazole, pyridine, pyrimidine, pyrazine, pyridazine, triazole, triazine, indole, indazole, purine, thiadiazole, oxadiazole, quinoline, phthalazine, naphthylidine, quinoxaline, quinazoline, cinnoline, pteridine, acridine, fenantrone, fenadine, tetrazole, thiazole, oxazole, benzimidazole, benzoxazole, benzothiazole, indrenine, tetrazaindene and the like, more preferably imidazole, pyridine, pyrimidine, pyrazine, pyridazine, triazole, triazine, thiadiazole, oxadiazole, quinoline, phthalazine, naphthylidine, quinoxaline, quinazoline, cinnoline, tetrazole, thiazole, oxazole, benzimidazole, benzoxazole, benzothiazole, and tetrazaindene, still preferably imidazole, pyridine, pyrimidine, pyrazine, pyridazine, triazole, triazine, thiadiazole, quinoline, phthalazine, naphthylidine, quinoxaline, quinazoline, cinnoline, tetrazole, thiazole, benzimidazole, and benzothiazole, and especially preferably pyridine, thiadiazole, quinoline and benzothiazole.

The alkyl, alkenyl, alkynyl, aryl and heterocyclic groups represented by A may have substituents in addition to -J-C($Z_{21}$)($Z_{22}$)($Z_{23}$), and the substituents are preferably alkyl, alkenyl, alkynyl, aryl, alkoxy, aryloxy, acyloxy, acyl, alkoxycarbonyl, aryloxycarbonyl, acyloxy, acylamino, alkoxycarbonylamino, aryloxycarbonylamino, sulfonylamino, sulfamoyl, carbamoyl, sulfonyl, ureido, phosphateamide groups, halogen atoms, cyano, sulfo, carboxyl, nitro and heterocyclic groups, more preferably alkyl, aryl, alkoxy, aryloxy, acyl, acylamino, alkoxycarbonylamino, aryloxycarbonylamino, sulfonylamino, sulfamoyl, carbamoyl, ureido, phosphateamide groups, halogen atoms, cyano, nitro and heterocyclic groups, still preferably alkyl, aryl, alkoxy, aryloxy, acyl, acylamino, sulfonylamino, sulfamoyl, carbamoyl groups, halogen atoms, cyano, nitro and heterocyclic groups, and especially preferably alkyl, aryl groups and halogen atoms.

$Z_{21}$, $Z_{22}$ and $Z_{23}$ are preferably halogen atoms, haloalkyl, acyl, alkoxycarbonyl, aryloxycarbonyl, carbamoyl, sulfamoyl, sulfonyl and heterocyclic groups, more preferably halogen atoms, haloalkyl, acyl, alkoxycarbonyl, aryloxycarbonyl and sulfonyl groups, and still preferably halogen atoms. The halogen atoms are preferably chlorine, bromine and iodine atoms, more preferably chlorine and bromine atoms, and especially preferably bromine atoms.

J represents a group comprising —C(═O)—, —SO— or —$SO_2$—, and preferably a group comprising —$SO_2$— or —C(═O)—.

Specific examples of these compounds are shown below.

5-1

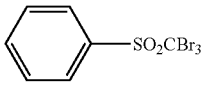

5-2

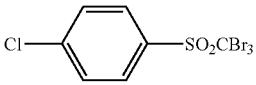

5-3

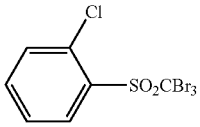

5-4

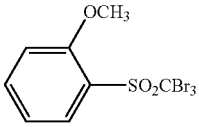

5-5

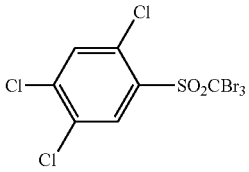

5-6

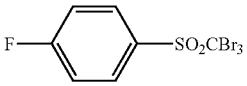

5-7

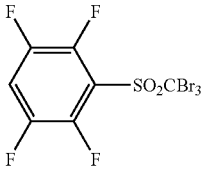

5-8

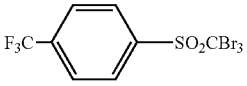

5-9

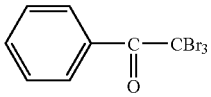

5-10

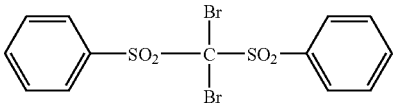

5-11

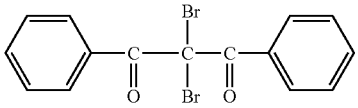

5-12

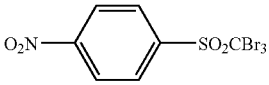

5-13

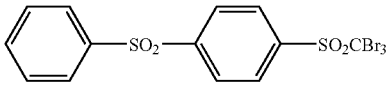

5-14

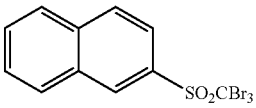

-continued
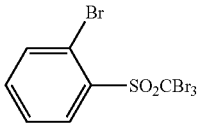
5-15
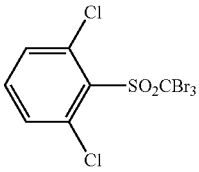
5-16
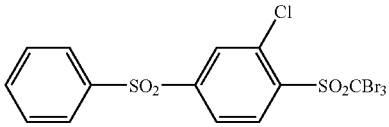
5-17
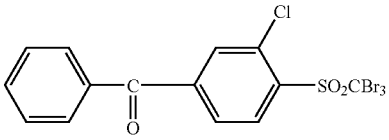
5-18
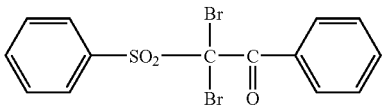
5-19
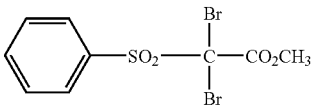
5-20
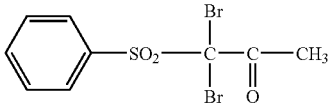
5-21
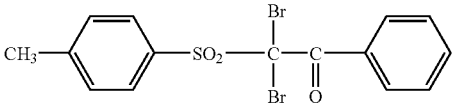
5-22
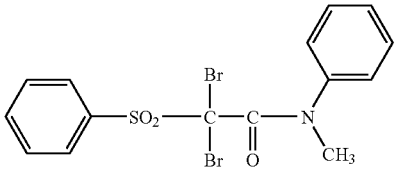
5-23
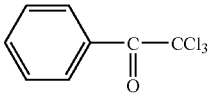
5-24
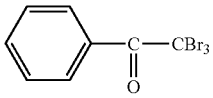
5-25
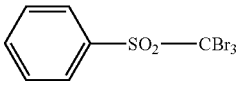
5-26
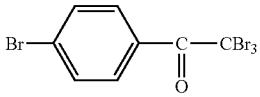
5-27
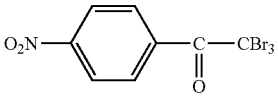
5-28
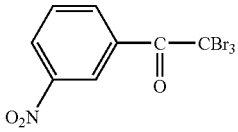
5-29
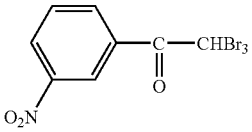
5-30
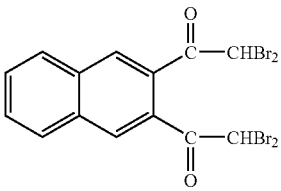
5-31
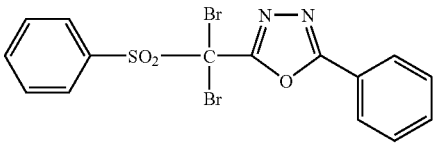
5-32
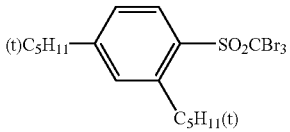
5-33
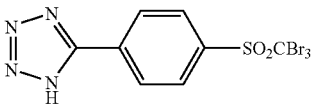
5-34
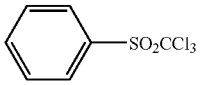
5-35
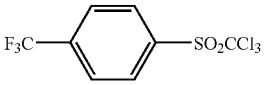
5-36

-continued
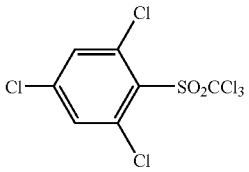
5-37
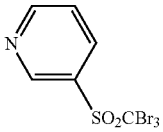
5-38
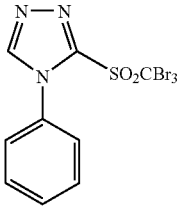
5-39
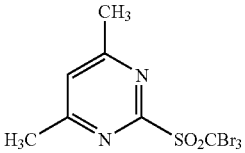
5-40
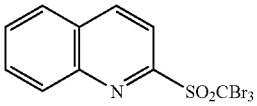
5-41
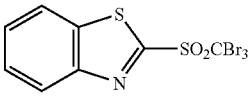
5-42
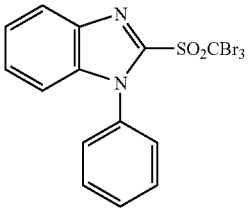
5-43
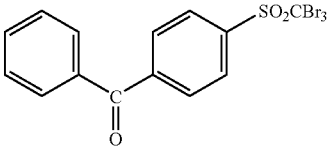
5-44
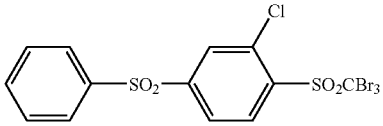
5-45
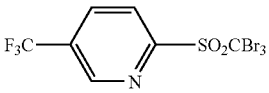
5-46
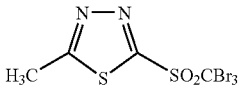
5-47
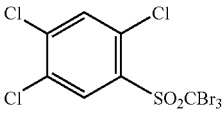
5-48
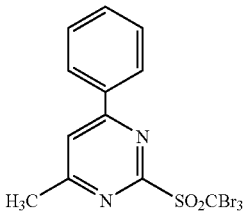
5-49
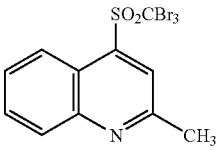
5-50
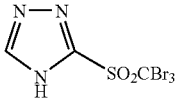
5-51
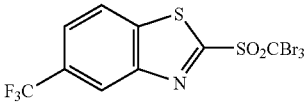
5-52
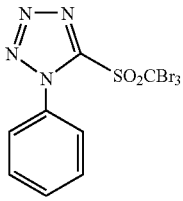
5-53
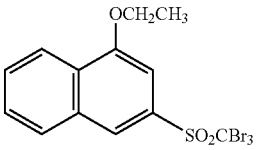
5-54

-continued
5-55
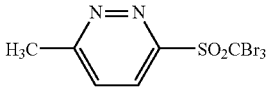
5-56
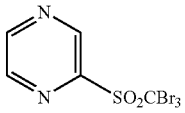
5-57
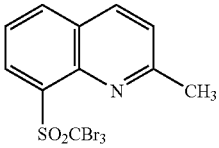
5-58
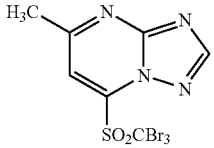
5-59
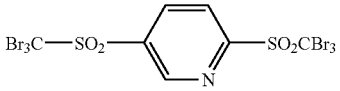
5-60
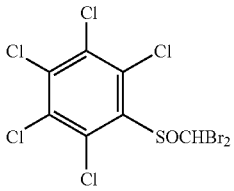
5-61
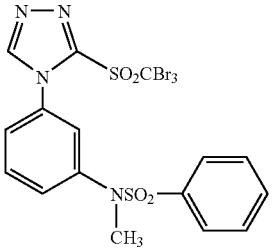
5-62
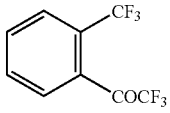
5-63
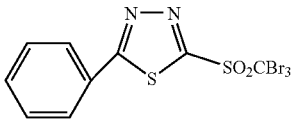
5-64
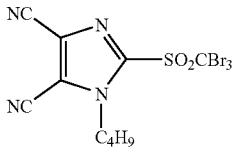
5-65
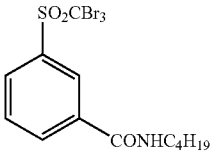
5-66
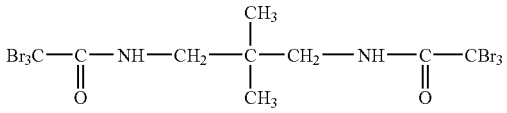
5-67
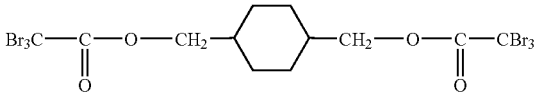
5-68
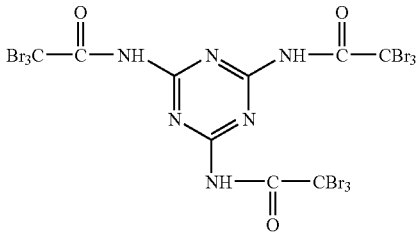
5-69
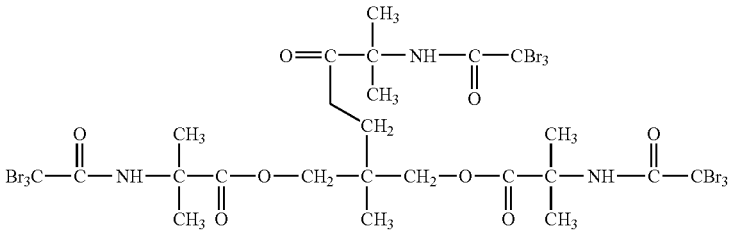

-continued 5-70

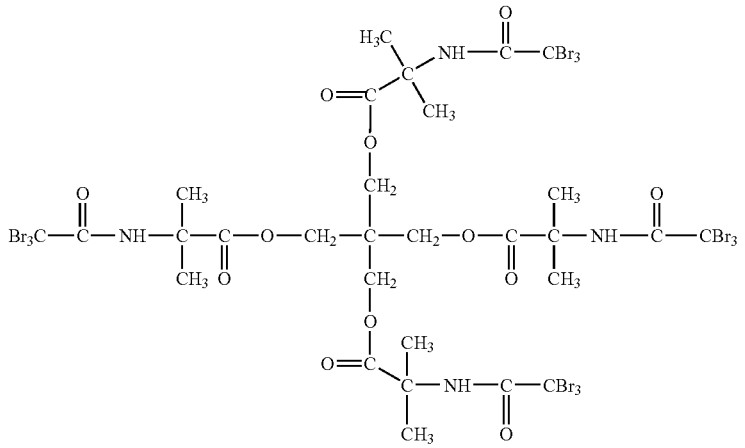

The polyhalomethane compound may be contained in at least one layer of the photosensitive layer and the layers adjacent thereto, and it is preferred that it is contained in at least the photosensitive layer.

The polyhalomethane compound may be added by dissolving in organic solvents such as alcohols such as methanol and ethanol, ketones such as methylethylketone and acetone, aromatic types such as toluene and xylene, and non-aromatic types such as hexane and decane, may be dispersed in water, and may be directly added by making powder and tablets.

The use amount can be from $1\times10^{-8}$ to 1 mol, is preferably from $1\times10^{-6}$ to $1\times10^{-1}$ mol and more preferably $1\times10^{-4}$ to $1\times10^{-1}$ per mol of the silver. When the amount is less than this range, it is difficult to obtain aimed improvement effects of image storage stability. On the other hand, when it is more than this range, it is not preferable because images become weak tone and coating films become weak.

In the present invention, it is preferable to combine a phthalazine compound. The phthalazine compounds are the compounds obtained by introducing various substituents into a phthalazine ring. The phthalazine compounds preferable in the invention are the compounds where the following substituents are introduced into the phthalazine ring.

Substituents: halogen atoms, cyano, hydroxyl groups; and alkyl, alkenyl, alkynyl, alkoxy, aromatic groups and heterocyclic groups, which may have substituents, respectively. Carbons in these alkyl, alkenyl, alkynyl and alkoxy groups are preferably from 1 to 60, and especially preferably from 1 to 40. When the carbons are more than 60, good effects are not obtained on photographic fog inhibition, color tone, and storage stability. As substitution positions of the above substituents, the substituents can be introduced at positions 1 to 8 except positions 2 and 3 of the phthalazine ring.

Specific examples of the phthalazine compounds used for the invention are shown below, but the invention is not limited thereto.

f1: Phthalazine
f2: 6-Aminophthalazine
f3: 5-Methylphthalazine
f4: 6-Chlorophthalazine
f5: 6-i-Propylphthalazine
f6: 6-(4,6-di-t-amylphenyl)phthalazine
f7: 6-Phenylphthalazine
f8: 6-Methoxyphthalazine
f9: 1,4-Dimethylphthalazine
f10: 5,6-Dimethoxyphthalazine
f11: 6-i-Butylphthalazine The phthalazine compound may be added by dissolving in organic solvents such as alcohols such as methanol and ethanol, ketones such as methylethylketone and acetone, aromatic types such as toluene and xylene, and non-aromatic types such as hexane and decane, may be dispersed in water, and may be directly added by making powder and tablets. The use amount can be from $1\times10^{-8}$ to 1 mol, is preferably from $1\times10^{-6}$ to $1\times10^{-1}$ mol and more preferably $1\times10^{-4}$ to $1\times10^{-1}$ per mol of the silver. When the amount is less than this range, it is difficult to obtain aimed improvement effects of image storage stability. When it is more than this range, it is not preferable because images become weak tone and coating films become weak.

Next, sequentially described are photosensitive silver halide particles, spectral sensitizing dyes, organic silver salts, reducing agents, binders, crosslinkers and the other materials used for the photothermographic imaging material of the invention.

The silver halide particles contained in the photosensitive layer of the photothermographic imaging material can precedently prepared by any method known in the art in the field of photographic technology such as a single jet method or a double jet method, for example, any method of an ammonium method emulsion, a neutralization method, an acid method and the like, and then mixed with the other ingredients of the invention to introduce into the composition used for the invention. In this case, in order to sufficiently perform the contact of the photosensitive silver halide particles and the organic silver salt, it is possible to apply the means of using polymers other than gelatin such as polyvinyl acetals described in U.S. Pat. Nos. 3,706,564, 3,706,565, 3,713,833, 3,748,143, and British Patent No. 1,362,970 as protection polymers when the photosensitive silver halide particles are prepared; the means of enzymatically decomposing gelatin of the photosensitive silver halide emulsion described in British Patent No. 1,354,186; or the means of omitting the use of protection polymer by preparing the photosensitive silver halide particles in the presence of surfactants as described in U.S. Pat. No. 4,076,539.

AS the photosensitive silver halide particles, those with small particle sizes are preferable to keep white turbidity low after the image formation and obtain good image quality. The average particle diameter is 0.1 μm or less, preferably from 0.01 to 0.1 μm, and in particular preferably from 0.02 to 0.8 μm. The shape of the silver halide particles is not especially limited, and it is possible to use so-called normal crystalline, cubic, octahedral, and non-normal crystalline spherical, rod-like and tabular particles. Also the silver halide composition is not especially limited, and may be any of silver chloride, silver chloride bromide, silver chloride iodide bromide, silver bromide, silver iodide bromide and silver iodide.

The amount of photosensitive silver halide particles is suitably 50% or less, preferably from 25 to 0.1%, and more preferably in the range of 15 to 0.1% by mass based on a total mass of the silver halide and the organic silver salt. As the photosensitive silver halide particles, a part of the organic silver salt may be converted into the silver halide using forming ingredients of the silver halide. Various conditions such as reaction temperature, reaction time period and reaction pressure can be appropriately set to minimize consumption energy at the production, but typically it is preferred that the reaction temperature is from −23 to 74° C., the reaction time period is from 0.1 sec to 72 hours and the reaction pressure is set at an atmospheric pressure.

The photosensitive silver halide particles prepared by the above various methods can be chemically sensitized by, for example, sulfur-containing compounds, gold compounds, platinum compounds, palladium compounds, silver compounds, tin compounds, chromium compounds and the combinations thereof. The methods and procedures for this chemical sensitization are described in, for example, U.S. Pat. No. 4,036,650, GB Patent No. 1,518,850, JP-A-51-22430, JP-A-51-78319 and JP-A-51-81124.

Further, when the part of the organic silver salt is converted into the silver halide by the silver halide forming ingredients, an amide compound with low molecular weight may coexist to accomplish the sensitization as described in U.S. Pat. No. 3,980,482.

Further, for luminance disobedience and gradation adjustment, ions of metals belonging to VI to X Groups of the periodic table of the elements, such as Ph, Ru, Ir, Os and Fe, complexes or complex ions thereof can be contained in these photosensitive silver halide particles. In particular, it is preferable to contain the ions of the metals belonging to VI to X Groups of the periodic table of the elements or complex ions thereof. As the above metals, preferred are W, Fe, Co, Ni, Cu, Ru, Rh, Pd, Re, Os, Ir, Pt, and Au. Additionally, in the case of the photothermographic imaging material of the invention, it is preferable to select from Rh, Re, Ru, Ir and Os.

These metals can be introduced into the silver halide by a complex form. In the present invention, it is preferred that transition metal complexes are the 6-coordinated complexes represented by the following Formula (6).

$$[ML_6]^m \quad (6)$$

In the Formula (6), M represents a transition metal selected from the elements in Groups VI to X of the periodic table of the elements, L represents a cross-linking ligand, and m represents 0, 1-, 2- or 3-. Specific examples of the ligands represented by L include ligands of halides (fluoride, chloride, bromide and iodide), cyanide, cyanate, thiocyanate, selenocyanate, tellurocyanate, azide and aquo, nitrosyl, thionitrosyl and the like, and preferably aquo, nitrosyl, thionitrosyl and the like. When the aquo ligand is present, it is preferable to occupy 1 or 2 ligands. L may be the same or different. Especially preferable special examples as M are iridium (Ir), rhodium (Rh), ruthenium (Ru), rhenium (Re) and osmium (Os).

Hereinafter, shown are specific examples of sodium salts of transition metal coordination complexes. For convenience, no sodium is marked, but the trivalent and bivalent salts are made up of three and two sodium atoms, respectively.

1: $[RhCl_6]^{3-}$
2: $[RuCl_6]^{3-}$
3: $[ReCl_6]^{3-}$
4: $[RuBr_6]^{3-}$
5: $[OSCl_6]^{3-}$
6: $[CrCl_6]^{3-}$
7: $[Ru(NO)Cl_5]^{2-}$
8: $[RuBr_4(H_2O)]^{2-}$
9: $[Ru(NO)(H_2O)Cl_4]^{2-}$
10: $[RhCl_5(H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)_2Cl_4]^{-}$
15: $[Rh(NO)(H_2O)Cl_4]^{-}$
16: $[Ru(NO)CN_5]^{2-}$
17: $[Fe(CN)_6]^{2-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[IrCl_6]^{3-}$
28: $[IrCl_6]^{2-}$

These metallic ions or complex ions may be used alone or in combination of two or more same or different types. The salts may be potassium or lithium salts in addition to sodium salts, and it is possible to voluntarily select the salts such as cesium salts. In general the content of these metallic ions or complex ions is suitably from $1\times10^{-9}$ to $1\times10^{-2}$ mol, and preferably from $1\times10^{-8}$ to $1\times10^{-4}$ mol per mol of the silver halide.

It is preferred that the compound which provides these metallic ions or complex ions is added at the silver halide particle formation and incorporated in the silver halide particles, and it may be added at any stage of the preparation of silver halide particles, i.e., before and after the core formation, growth, physical maturation, and chemical sensitization, but it is preferable to add at the stage of core formation, growth or physical maturation, it is more preferable to add at the stage of core formation or growth, and in particular preferably it is added at the stage of core formation. When added, the compound may be added by dividing in several times; can be evenly contained in the silver halide particles; and can be contained by possessing a distribution in the particle as described in JP-A-63-29603, JP-A-2-306236, JP-A-3-167545, JP-A-4-76534, JP-A-6-110146 and JP-A-5-273683.

These metallic compounds can be added by dissolving in water or an appropriate solvent (e.g., alcohols, ethers, glycols, ketones, esters, amides). For example, there are the method where an aqueous solution of powder of the metallic compound or an aqueous solution in which the metallic compound and NaCl, KCl are dissolved together has been added in a water soluble silver salt solution during the particle formation or a water soluble halide solution, or the method where the metallic compound is added as the third aqueous solution when the silver salt aqueous solution and the halide aqueous solution are simultaneously mixed to prepare the silver halide particle by a three solution simultaneous mixing method, the method where an aqueous solution of a required amount of the metallic compound is put in a reactor during the particle formation, or the method where the other silver halide particles in which the metallic ions or complex ions have been precedently doped are added to dissolve at the preparation of the silver halide. Especially, the method where the aqueous solution of powder of the metallic compound or the aqueous solution in which the metallic compound and NaCl, KCl are dissolved together is added to the halide aqueous solution is preferable. When added on the particle surface, the aqueous solution of the required amount of metallic compound can be put in the reactor immediately after the particle formation, during or at the end of the physical maturation, or at the chemical maturation.

The photosensitive silver halide particles can be sensitized with spectral sensitizing dye if necessary, and as the spectral sensitizing dye, it is possible to use the sensitizing dyes described in, for example, JP-A-63-159841, JP-60-140335, JP-A63-231437, JP-A-63-259651, JP-A-63-304242, JP-A-63-15245, U.S. Pat. Nos. 4,639,414, 4,740,455, 4,741,966, 4,751,175, and 4,835,069.

The spectral sensitizing dyes useful for the invention are described in, for example, RD 17643, page 23, IV-A section (December, 1978) and RD 1831, page 437, X section (August, 1978) or the references cited therein. Especially, it is possible to advantageously select the sensitizing dyes having spectral sensitivity suitable for spectral property of various scanner light sources. For example, preferably used are the compounds described in JP-A-9-34078, JP-A-9-54409 and JP-A-9-80679.

The organic silver salt contained in the photothermographic imaging material is a reducible silver source, and used are silver salts of organic acids, hetero organic acids and acid polymers having the reducible silver ion source. Further, useful are organic or inorganic silver salt complexes, ligands of which have a total stability constant to a silver ion of 4.0 to 10.0. Examples of the organic silver salts are described in RD 17029 and 29963, and also include the salts of organic acids (salts of gallic, oxalic, behenic, arachidic, stearic, palmitic, lauric acids and the like).

The organic silver salts preferably used for the invention are silver salts of aliphatic carboxyl acids, and specifically the silver salts of behenic, arachidic, stearic palmitic acids and the like.

An organic silver salt compound can be obtained by mixing a water soluble silver compound and a compound which forms complex with the silver, and preferably used are a normal mixing method, a reverse mixing method, a simultaneous mixing method, a controlled double jet method as described in JP-A-9-127643, and the like. For example, an alkali metallic salt (e.g., sodium hydroxide, potassium hydroxide, etc.) is added to an organic acid to make an organic acid alkali metallic salt soap (e.g., sodium behenate, sodium arachidate, etc.), and subsequently crystal of an organic silver salt is made by mixing silver nitrate with the soap. At that time, silver halide particles may be mixed.

In the present invention, it has been found that in preparation of the organic silver salt, effects excellent to the objects of the present invention can be obtained by manufacturing the organic acid silver salt after preparing an organic potassium salt by using potassium hydroxide.

The reducing agents contained in the photothermographic imaging material are those which reduce the organic silver salt to form silver images. Examples of the reducing agents are described in, for example, U.S. Pat. Nos. 3,770,448, 3,773,512, 3,593,863, Research Disclosure (hereinafter, abbreviated as RD) 17029 and 29963, JP-A-11-119372 and JP-A-2002-62616, but the reducing agents preferably used for the invention include those represented by the following Formula (7).

(7)

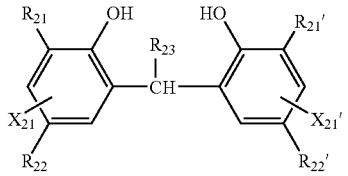

In the formula, $R_{21}$, $R_{21}'$, $R_{22}$ and $R_{22}'$ each represent substituents. $R_{23}$ represents a hydrogen atom or a substituent. $X_{21}$ and $X_{21}'$ represent hydrogen atoms or substituents.

Particularly describing, the substituents represented by $R_{21}$, $R_{21}'$, $R_{22}$ and $R_{22}'$ include the same groups as the substituents included in the description of $R_{73}$ and $R_{73}'$ in the Formula (2a). $R_{21}$, $R_{21}'$, $R_{22}$ and $R_{22}'$ are preferably alkyl, alkenyl, alkynyl groups and the like. $R_{23}$ represents a hydrogen atom or a substituent, and the substituents include the same groups as the substituents included in the description of $R_{73}$ and $R_{73}'$ in the Formula (2a). $R_{23}$ is preferably a hydrogen atom, an alkyl alkenyl, alkynyl groups and the like.

$X_{21}$ and $X_{21}'$ represent hydrogen atoms or substituents, and the substituents include the same groups as the substituents included in the description of $R_{73}$ and $R_{73}'$ in the Formula (2a).

Specific examples of these compounds are shown below.

7-1

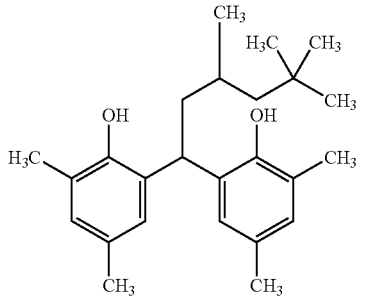

7-2

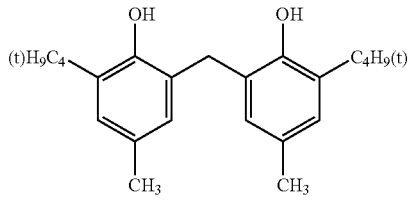

7-3

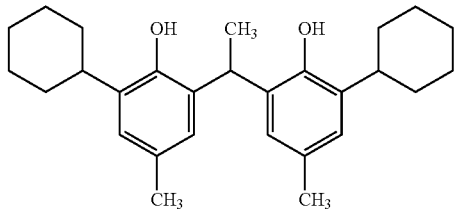

-continued
7-4
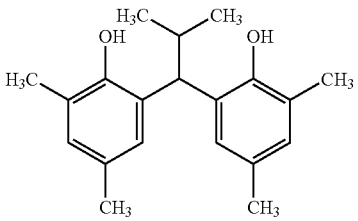
7-5
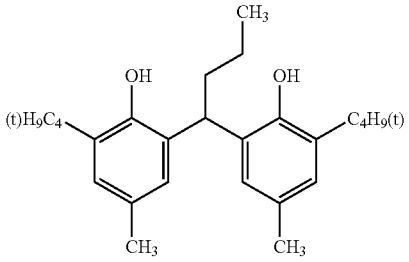
7-6
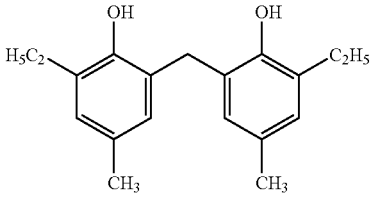
7-7
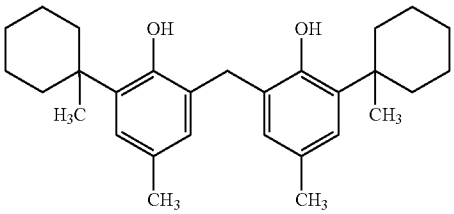
7-8
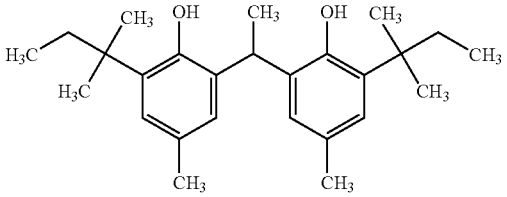
7-9
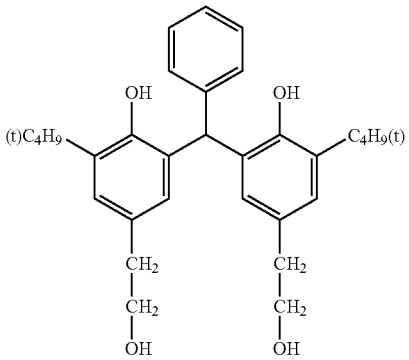
-continued
7-10
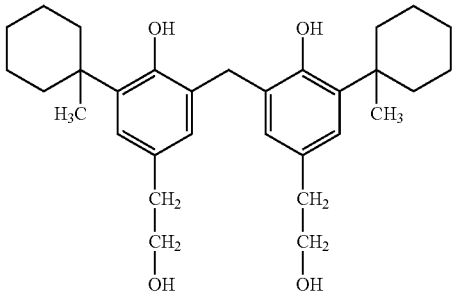
7-11
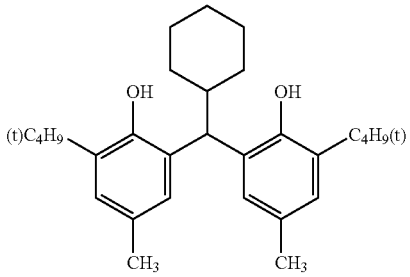
7-12
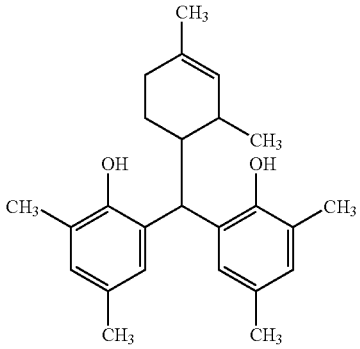
7-13
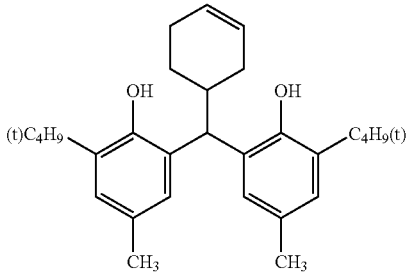
7-14
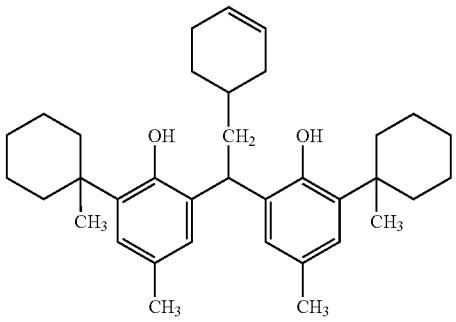

-continued 7-15

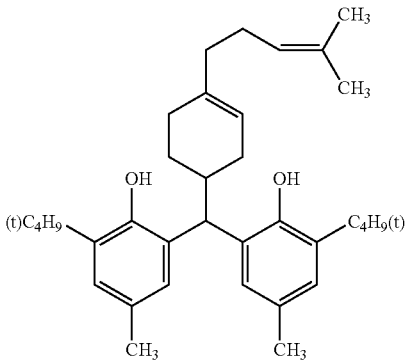

7-16

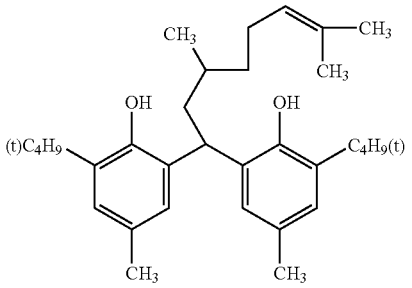

7-17

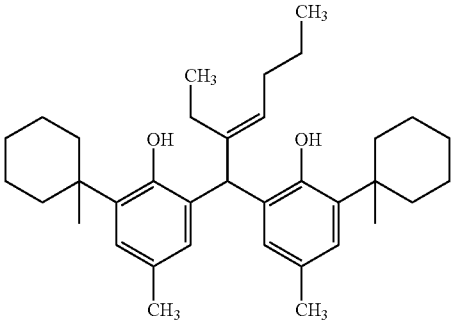

7-18

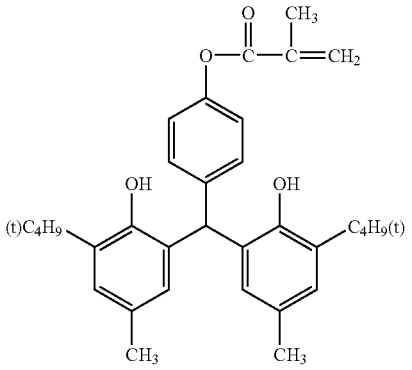

-continued 7-19

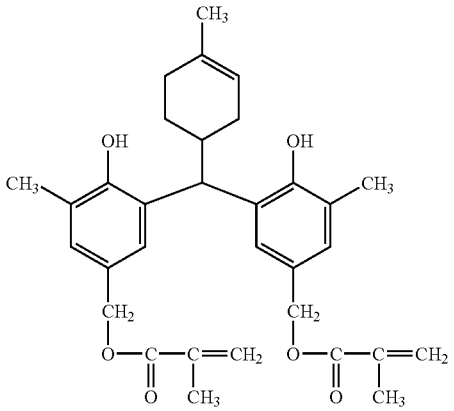

7-20

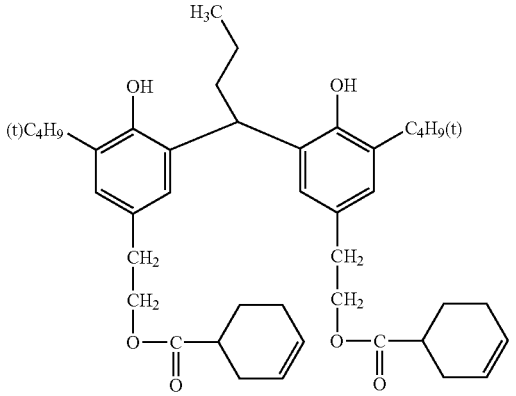

The reducing agent can be contained in a coating solution for the photosensitive layer and coating solutions for the adjacent layers thereof by dispersing in water or dissolving in an organic solvent to be contained in these layers. The organic solvent can be voluntarily selected from alcohols such as methanol and ethanol, ketones such as acetone and methylethylketone, and aromatic types such as toluene and xylene.

The use amount of the reducing agent is suitably in the range of $1\times10^{-2}$ to 10 mol, and preferably from $1\times10^{-2}$ to 1.5 mol per mol of the silver.

As high molecular binders of the photosensitive layer and the adjacent layers thereof, and the other non-photosensitive layers of the photothermographic imaging material, typically used are the colorless, transparent or translucent high molecular binders. The high molecular binders include polyvinyl butyral, polyacrylamide, polystyrene, polyvinyl acetate derivatives, polyurethane, polyacrylic acid derivatives, polymethacrylic acid derivatives, styrene-butadiene copolymer, acrylonitrile-butadiene copolymer, vinyl chloride-vinyl acetate copolymer, styrene-butadiene-acryl copolymer and the like.

The binders used for the invention are preferably those where equilibrium water content of coating film after drying is low, and for example, can include organic solvent type cellulose acetate, cellulose acetate butylate and polyacetal. Among others, polyacetal means the polymers obtained by saponifying polyvinyl acetate to produce polyvinyl alcohol and reacting this polyvinyl alcohol with an aldehyde compound, and preferred are polybutyral acetalized with butylaldehyde and polyacetal acetalized with acetaldehyde (polyacetal in a narrow sense). In acetal preferable for the invention, it is preferred that a saponification degree of polyvinyl acetate is from 60 to 99.9% and acetalization is practically from 20 to 95% although acetalization from 1 to 100% is theoretically possible. When an acetalization degree is low, then hydroxyl groups are increased and property easily affected by moisture is exhibited in photographic performance. When the acetalization degree is high, then reaction temperature and time period become harsh and cost and productivity are decreased.

It is preferable to use polyvinyl acetate derivative, polyacrylic acid derivative, polymethacrylic acid derivative or copolymer of styrene and butadiene as the binder according to the invention.

The polyvinyl acetate derivative means polymer (including copolymer) having monomer units of vinyl acetate or the derivative thereof, the polyacrylic acid derivative means polymer (including copolymer) having monomer units of acrylic acid or acrylate ester, and the polymethacrylic acid derivative means polymer (including copolymer) having monomer units of methacrylic acid or methacrylate ester.

In the present invention, it is preferred that at least 70% by mass of total binders which each of the photosensitive layer and the adjacent layer comprise is the polyvinyl acetate derivative, polyacrylic acid derivative, polymethacrylic acid derivative or copolymer of styrene and butadiene.

Copolymer ingredient of the polyvinyl acetate derivative or (meth)acrylic acid derivative is preferably linear, branched or cyclic alkyl ester with 1 to 12 carbons which may have substituents of acrylic acid and methacrylic acid, a copolymerization ratio is preferably from 0 to 50 mol % in the case of the polyvinyl acetate derivative and from 80 to 99.9 mol % in the case of (meth)acrylic acid derivative, and the average polymerization degree is preferably from 100 to 3000 and especially preferably from 200 to 2000 by the number average polymerization ratio.

The binders for an aqueous coating solution can include styrene-butadiene copolymer, copolymer of styrene and alkyl acrylate ester or alkyl methacrylate esters, and alkyl acrylate esters-alkyl methacrylate ester copolymer. As this aqueous dispersion type polymer, preferred are those making fine particles with an average particle diameter in the range of 1 nm to some μm, which are dispersed in an aqueous dispersion medium. In those used as the binder of the aqueous coating solution, the aqueous dispersion type polymer is especially preferably hydrophobic in terms of being capable of improving water resistance. The polymerization degree of the polymer can be freely selected from about 10 to 10,000, but is preferably from 100 to 6,000 in terms of coating property and productivity at the synthesis.

The photothermographic imaging material of the invention is characterized in that the high molecular binder in at least one layer of the photosensitive layer and the adjacent layers is coated by adding at least one type of the compounds having isocyanate, alkoxysilane, vinylsulfone or carbodiimide group.

The binder even alone retains adhesion to a lower layer and an upper layer to give film strength which is scratch-resistant by making a film of each layer of the photothermographic imaging material, but the use of a crosslinker having the above functional group can further enhance film adhesion and film strength.

The preferable crosslinkers are preferably the crosslinkers having alkoxysilane, isocyanate, epoxy (glycidyl), vinylsulfonyl or carbodiimide group. The especially preferable crosslinkers can include the crosslinkers having at least two isocyanate groups, the carbodiimide crosslinkers having at least two carbodiimide groups, the alkoxysilane crosslinkers having at least two alkoxysilane, and the vinylsulfonyl crosslinkers having at least two vinylsulfonyl groups. Examples of the preferable crosslinkers are shown below.

H1: Hexamethylene diisocyanate
H2: Trimer of hexamethylene diisocyanate
H3: Tolylene diisocyanate
H4: Phenylene diisocyanate
H5: Xylylene diisocyanate
H6: 1,3-bis(isocyanatomethyl)cyclohexane
H7: Tetramethylenexylylene diisocyanate
H8: m-i-Propenyl-a,a-dimethylbenzyl isocyanate
H9: Phenylaminopropyl trimethoxysilane
H10: p-Methylphenylpropyl trimethoxysilane
H11: Dimethylaminopropyl trimethoxysilane
H12: Diethoxyaminopropyl triethoxysilane
H13: 1,2-bis(Vinylsulfonylacetamide)ethane
H14: 1,2-bis(Vinylsulfonamide)ethane
H15: 1,3-bis(Vinylsulfonamide)-2-hydroxypropane
H16: 1,3-bis(Vinylsulfonyl)-2-propanol (H17)

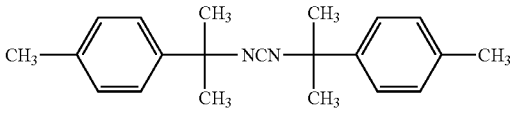

(H18)

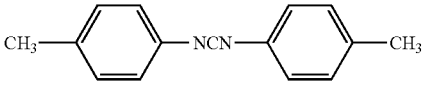

(H19)

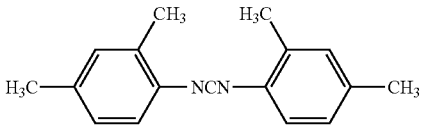

(H20)

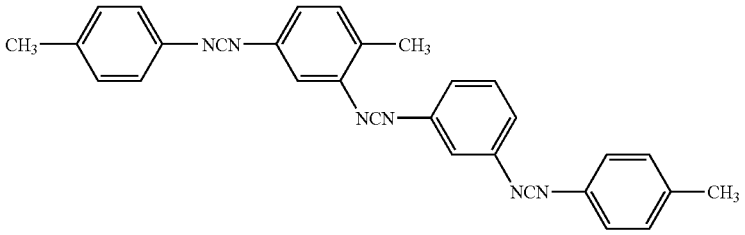

-continued (H21)

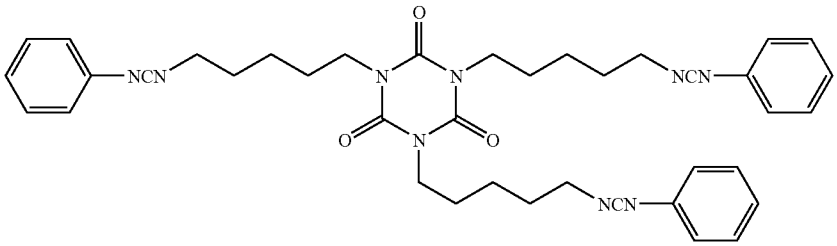

It is preferred that the carbodiimide compounds used for the invention are further the multifunctional carbodiimide compounds shown by the following Formula (CI).

$$R_{31}\text{-}J_1N{=}C{=}N\text{-}J_2\text{-}(L_1)_n\text{-}(J_3\text{-}N{=}C{=}N\text{-}J_4\text{-}R_{32})_v \quad \text{(CI)}$$

$R_{31}$ and $R_{32}$ each represent aryl or alkyl groups, $J_1$ and $J_4$ each represent bivalent linkage groups, $J_2$ and $J_3$ each represent arylene or alkylene groups, $L_1$ represents (v+1) valence alkyl, alkenyl, aryl or heterocyclic group, or a group where these groups are bound via binding groups, v represents an integer of 1 or more, and n represents 0 or 1.

The details of the above substituents are described in paragraph numbers [0188] to [0190] of JP-2002-1345. Specific examples of the carbodiimide compounds preferably used for the invention are shown, but the invention is not limited thereto.

C1-1

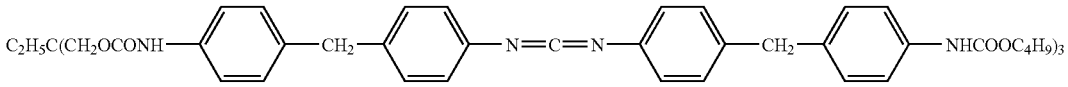

C1-2

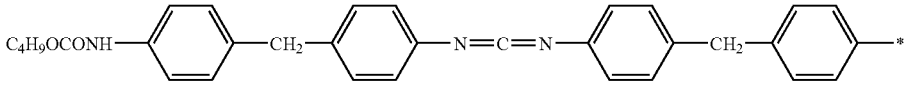

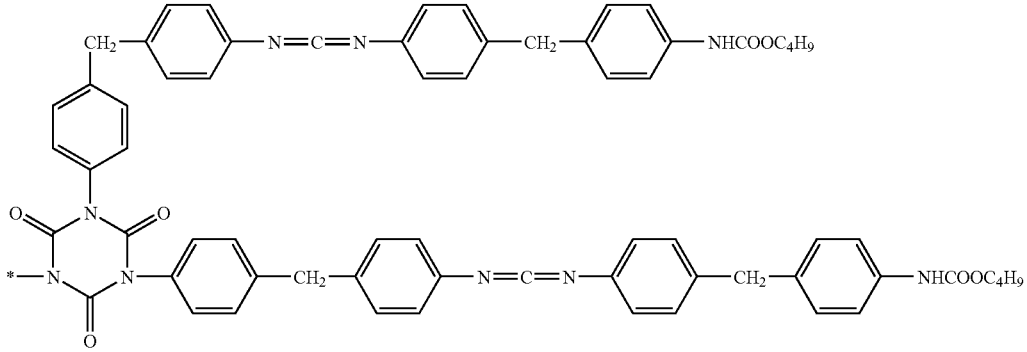

C1-3

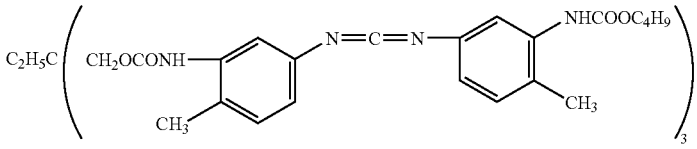

C1-4

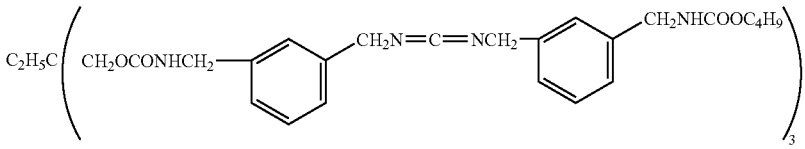

-continued
C1-5
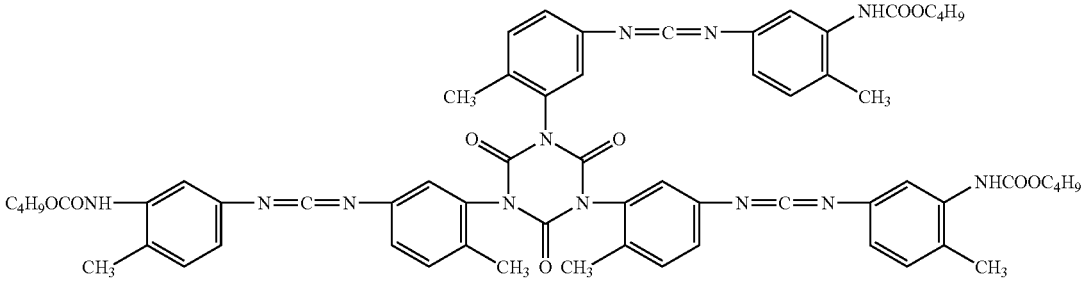
C1-6
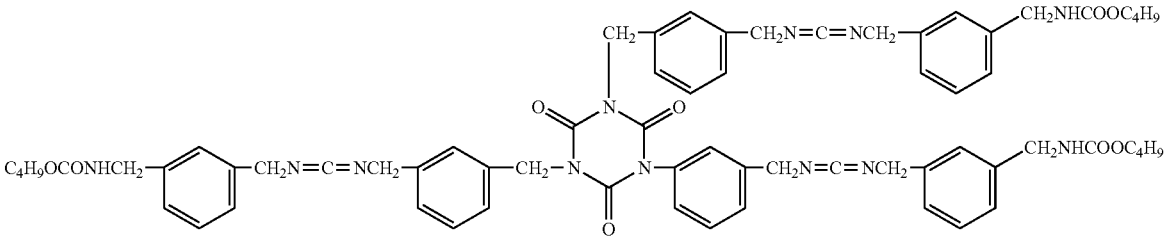
C1-7
$C_2H_5C(CH_2OCONH(CH_2)_6N{=}C{=}N(CH_2)_6NHCOOC_4H_9)_3$
C1-8
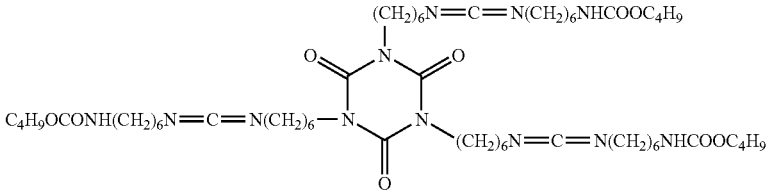
C1-9
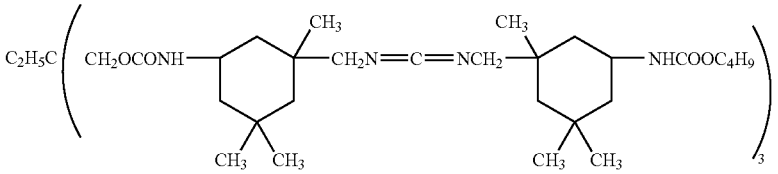
C1-10
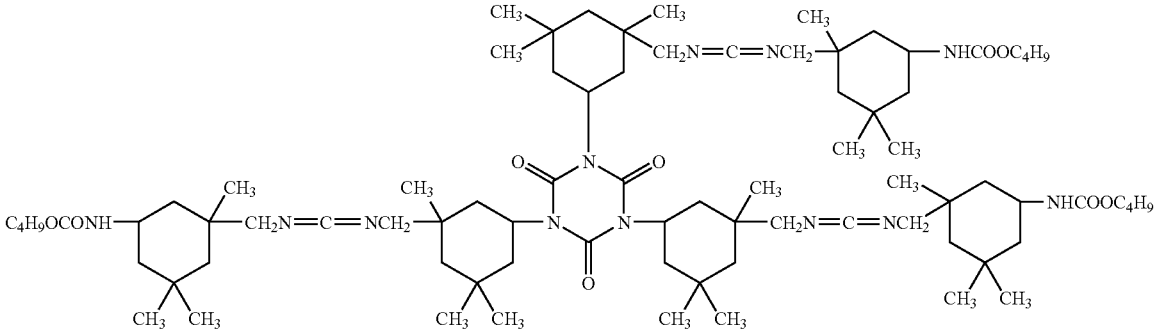
C1-11
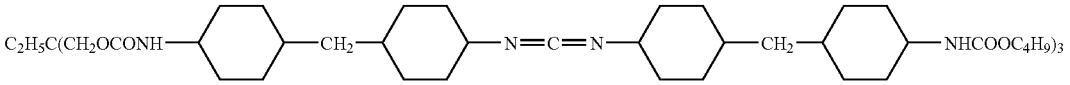
C1-12
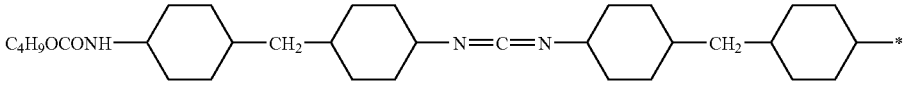

-continued
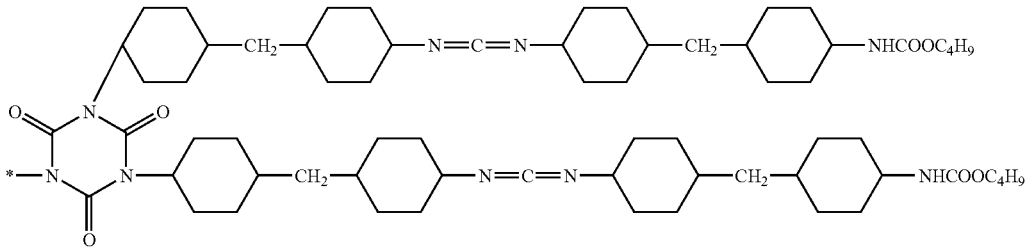
C1-13
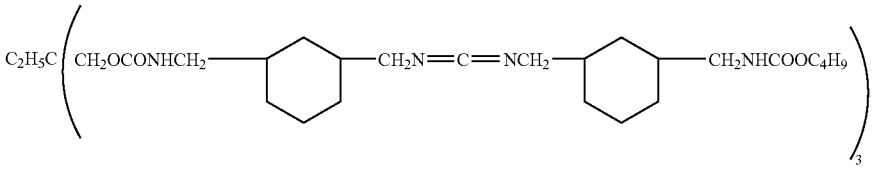
C1-14
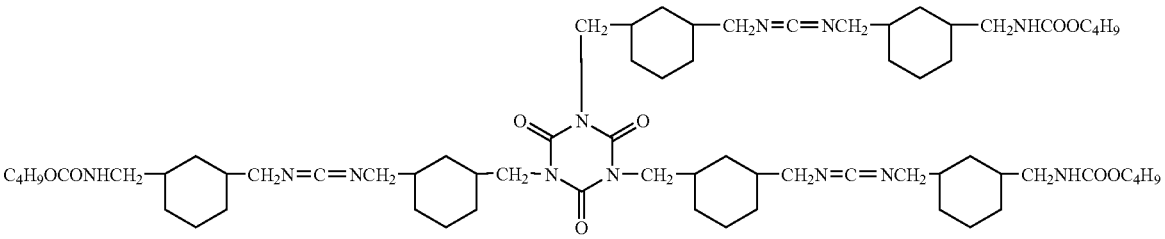
C1-15
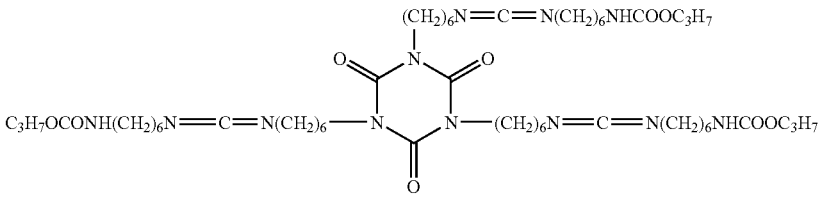
C1-16
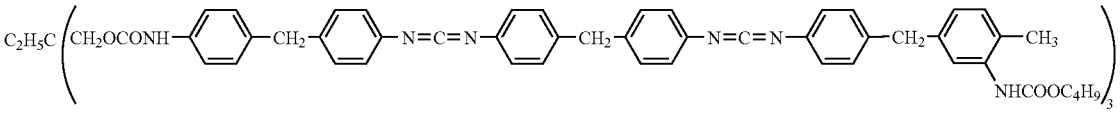
C1-17
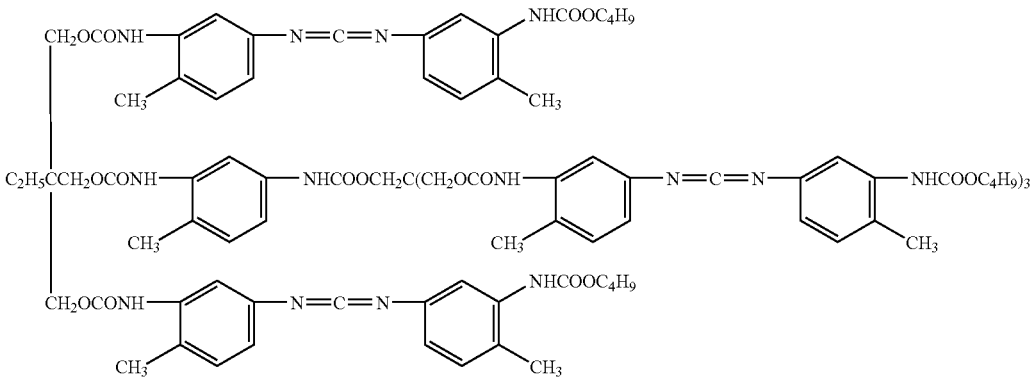

-continued

C1-18

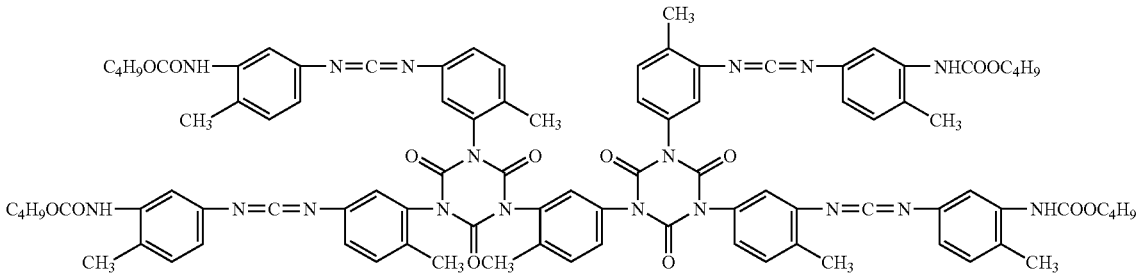

The above crosslinkers may be added by dissolving in water, alcohols, ketones, and non-polar organic solvents, or may be added in the coating solution as solid. The addition amount is preferably equivalence with the amount of the groups to be crosslinked, but may be increased by up to 10 times or decreased by one tenth or less. When the amount is too small, crosslinking reaction does not progress, and when it is too large, it is not preferable because unreacted crosslinkers deteriorate photographic property.

The photothermographic imaging material may be either in the form where the photosensitive layer is present on only one side of a support or in the form where it is on both sides. When the photosensitive layer is present on one side of the support, comprised is the form having a BC (back face layer) provided at an opposite side of the photosensitive layer, and in some cases, having a protection layer thereof. The adjacent layers of the photosensitive layer are, for example, an anti-halation layer (AH layer) at a lower side of and a protection layer at an upper side of the photosensitive layer.

In the photothermographic imaging material, if necessary AH layer for anti-halation of the photothermographic imaging material and/or BC layer for anti-halation are provided, dyes used for the AH and BC layers could be the dyes which absorbs image exposure light, and preferably used are thermal achromatizing dyes described in U.S. Pat. No. 5,384,237. When the dye is not thermally achromatized, the use amount is limited to the range where no image disturbance is given to the photothermographic imaging material, but when it is the thermal achromatizing dye, it is possible to add the necessary and sufficient amount of the dye.

The photothermographic imaging material can be provided with the protection layer. It is preferable to contain a matting agent in the protection layer. The matting agents may be any of organic or inorganic matters, and as the inorganic matting agent, it is possible to use the matting agents made up of silica described in Swiss Patent No. 330,158, polystyrene or polymethacrylate described in Swiss Patent No. 330,158, polyacrylonitrile described in U.S. Pat. No. 3,079,257, polycarbonate described in U.S. Pat. No. 3,022,169, and the like.

The shape of matting agent may be either a finite form or an infinite form, but is preferably the finite form and sphere is preferably used. The size of matting agent is represented as a diameter when a volume of the matting agent is converted into a sphere. When particle diameters of the matting agent are represented by the diameters of converted spheres, in the matting agents used for the invention, the average particle diameter is preferably from 0.5 to 10 μm, and more preferably from 1.0 to 8.0 μm. A variation coefficient of particle diameter distribution for the matting agent is preferably 50% or less, more preferably 40% or less, and especially preferably 20% or less. An addition method of the matting agent may be the method of coating by precedently dispersing in the coating solution or the method of spraying the matting agent before completion of drying after coating the coating solution.

As the support of the photothermographic imaging material, it is possible to use the support of paper, synthetic paper, nonwoven, flitter, plastic film and the like, and also it is possible to voluntarily use composite sheet by combining these materials.

An exposure method of the photothermographic imaging material is optional. As the exposure method, for example, it is possible to expose using laser by the methods described in JP-A-9-304869, JP-A-9-311403 and JP-A-2000-10230.

As an apparatus for developing the photothermographic imaging material, it is possible to use those known in the art. For example, it is possible to use the apparatuses described in JP-A-11-65067, JP-A-11-72897 and JP-A-11-84619.

Further, in the present invention, as organic silver salts as silver ion supplying source for silver image formation, preferred are silver salts of organic acids and hetero organic acids, especially in these salts, silver salts of long chain (from 10 to 30, preferably from 15 to 25 carbons) aliphatic carboxylic acids, and silver salts of nitrogen-containing heterocyclic compounds. Also preferred are organic or inorganic complexes described in Research Disclosure (hereinafter, also referred to as RD) 17029 and 29963 such as those where ligands have values of 4.0 to 10.0 as a total stability constant for silver ions. Examples of these suitable silver salts include the followings.

It is possible to include silver salts of organic acids, e.g., silver salts of gallic acid, oxalic acid, behenic acid, stearic acid, arachidic acid, palmitic acid, lauric acid, etc.; carboxyalkylthio urea salts of silver, e.g., silver salts of 1-(3-carboxypropyl)thiourea, 1-(3-carboxypropyl)-3,3-dimethyl thiourea; silver salts or silver complexes of polymer reaction product of aldehyde with hydroxy-substituted aromatic carboxylic acid, e.g., silver salts or silver complexes of the reaction product of aldehydes (formaldehyde, acetaldehyde, butylaldehyde, etc.) with hydroxy-substituted acids (e.g., salicylic acid, benzoic acid, 3,5-hydroxybenzoic acid); silver salts or silver complexes of thiones, e.g., silver salts or silver complexes of 3(2-carboxyethyl)-4-hydroxymethyl-4-thiazoline-2-thione, and 3-carboxymethyl-4-thiazoline-2-thione, etc.; complexes or salts of silver with nitrogen acid selected from imidazole, pyrazole, urazole, 1,2,4-thiazole and 1H-tetrazole, 3-amino-5-benzylthio-1,2,4-triazole and benzotriazole; silver salts of saccharine, 5-chlorosalicylaldoxime, and the like; and silver mercaptides. Among them, especially preferable silver salts include the silver salts of long chain (from 10 to 30, preferably from 15 to 25 carbons) aliphatic carboxylic acids such as silver behenate, silver arachidate and silver stearate.

Further, it is preferred that two or more organic silver salts are mixed in terms of increasing development performance and forming silver images with high density and high contrast, and for example, it is preferable to prepare by mixing a silver ion solution to a mixture of two or more organic acids.

An organic silver salt compound can be obtained by mixing a water soluble silver compound and a compound which forms complex with the silver, and preferably used are a normal mixing method, a reverse mixing method, a simultaneous mixing method, a controlled double jet method as described in JP-A-9-127643, and the like. For example, an alkali metallic salt (e.g., sodium hydroxide, potassium hydroxide, etc.) is added to an organic acid to make an organic acid alkali metallic salt soap (e.g., sodium behenate, sodium arachidate, etc.), and subsequently crystal of an organic silver salt is made by mixing silver nitrate with the soap. At that time, silver halide particles may be mixed.

It is possible to use various shapes of the above organic silver salt according to the present invention, but tabular particles are preferable. Especially, preferred are the particles which are tabular organic silver salt particles with an aspect ratio of 3 or more and where the average value of an acicular ratio of the tabular organic silver salt particles measured from a major plane direction is from 1.1 or more and less than 10.0 in order to increase a filling rate in a photosensitive layer by reducing shape anisotropy of nearly parallel opposed two faces (major planes) having maximum area. Besides, more preferable acicular ratio is from 1.1 or more and less than 5.0.

Further, tabular organic silver salt particles with the aspect ratio of 3 or more represents that the tabular organic silver salt particles occupy 50% or more of the number of whole organic silver salt particles. Further, in the organic silver salt according to the present invention, the tabular organic silver salt particles with the aspect ratio of 3 or more occupy preferably 60% or more, more preferably 70% or more (number), and especially preferably 80% or more (number) of the number of whole organic silver salt particles.

Tabular particles with the aspect ratio of 3 or more are the particles where a ratio of a particle diameter to a thickness, so-called the aspect ratio (abbreviated as AR) represented by the following formula is 3 or more.

$$AR = \text{Particle diameter } (\mu m)/\text{Thickness } (\mu m)$$

The aspect ratio of the tabular organic silver salt particles is preferably from 3 to 20, and more preferably from 3 to 10. The reasons are that the organic silver salt particles are easily close-packed when the aspect ratio is too low whereas when the aspect ratio is too high, then the organic silver salt particles are easily overlapped and light scattering and the like easily occur because the particles are easily dispersed in a clung state, resulting in reduction of clear feeling of photosensitive materials. Thus, the range described above is preferable.

To measure the particle diameter of the organic silver salt particles described above, the organic silver salt after dispersion is diluted, dispersed on grids with carbon support film, photographed by transmission electron microscope (e.g., 2000 FX type, direct magnification 5000 folds supplied from Japan Electron Optics Laboratory Co. Ltd.), and the particle diameter is measured. Besides, when the average particle diameter is obtained, a negative image is imported as a digital image by a scanner, 300 or more particle diameters (diameter of corresponding circle) are measured using an appropriate image processing software, and the average particle diameter is calculated.

To obtain the thickness of the organic silver salt particles described above, it is calculated by a method using TEM (transmission electron microscope) as shown below.

First, an image formation layer coated on a support is attached on an appropriate holder by an adhesive, and an ultra thin slice with thickness of 0.1 to 0.2 μm is made using a diamond knife in a direction perpendicular to the support face. The ultra thin slice made is supported by copper mesh, transferred on a carbon film hydriphilized by glow discharge, a bright-field image is observed at a magnification of 5,000 to 40,000 folds using transmission electron microscope (hereinafter abbreviated as TEM) with cooling at −130° C. or below by liquid nitrogen, and the image is quickly recorded on a film, imaging plate, CCD camera and the like. At that time, it is preferred that parts where there is no break and sagging in the slice are appropriately chosen as the filed to be observed.

It is preferred that those supported with an organic film such as extremely thin collodion and formvar are used as the carbon film, and more preferably it is the film of carbon alone obtained by forming on a rock salt substrate and solving/removing the substrate or obtained by removing the above organic film by an organic solvent or ion etching. An accelerating voltage of TEM is preferably from 80 to 400 kV, and especially preferably from 80 to 200 kV.

It is preferred that TEM image recorded in an appropriate medium is resolved into at least 1024 pixels×1024 pixels, preferably 2048 pixels×2048 pixels per image and image processing by a computer is carried out. To carry out the image processing, it is preferred that an analog image recorded on the film is converted into the digital image by the scanner and given are shading compensation and contrast/edge emphasis and the like if necessary. Subsequently, a histogram is made, and sites corresponding to the organic silver salt particles are extracted by binarization processing.

To obtain the average thickness, the thickness of 300 or more organic silver salt particles extracted above is manually measured by an appropriate software, and the average value is obtained.

Further, the average value of the acicular ratio of the tabular organic silver salt particles is obtained by the following method.

First, the photosensitive layer comprising the tabular organic silver salt particles are made swell in an organic solvent capable of dissolving a light photosensitive layer binder to exfoliate from the support, and ultrasonic washing using the above solvent, centrifugation and elimination of supernatant are repeated five times. Besides, the above steps are performed under a safe light. Subsequently, the sample is diluted with MEK (methylethylketone) such that an organic silver solid concentration is 0.01%, dispersed by sonication, and then dripped on a polyethylene terephthalate film hydrophilized by glow discharge to dry. It is preferred that the film loaded with the particles is used for the observation after performing oblique deposition of Pt—C with a thickness of 3 nm from an angle of 30° against a film face by electron beam using a vacuum evaporation apparatus.

Concerning the other electron microscopy observation methods and sample making techniques in detail, it is possible to refer to "Medical/Biological Electron Microscope Observation Methods edited by Japanese Society of Electron Microscopy, Kanto Branch" (Maruzen) and "Electron Microscope Sample Making Methods edited by Japanese Society of Electron Microscopy, Kanto Branch" (Maruzen), respectively.

For the sample made, a secondary electron image is observed using a field emission type scanning electron microscope (hereinafter abbreviated as FE-SEM) at an accelerating voltage of 2 kV to 4 kV and at a magnification of 5000 to 20000 folds, and image saving into an appropriate record medium is carried out.

For the above processing, it is convenient to use an apparatus capable of AD converting image signals from the electron microscope body and directly recording on memory as digital information, but analog images recorded on Polaroid films and the like can be used by converting into digital images by the scanner and if necessary giving shading compensation and contrast/edge emphasis and the like.

It is preferred that the image recorded in an appropriate medium is resolved into at least 1024 pixels×1024 pixels, preferably 2048 pixels×2048 pixels per image and image processing by a computer is carried out.

As a procedure of the image processing described above, first, the sites corresponding to the organic silver salt particles with the aspect ratio of 3 or more are extracted by making the histogram and by the binarization processing. The necessarily agglomerated particles are cut by an appropriate algorithm or manual manipulation, and contour extraction is carried out. Subsequently, a maximum length (MX LNG) and a minimum width (WIDTH) of each particle are measured for at least 1000 particles, and the acicular ratio is obtained for each particle by the following formula. Here, the maximum length of particle is referred to the maximum value when two points in the particle is tied with a straight line. The minimum width of particle is referred to the value when a distance of parallel lines becomes the minimum value when two parallel lines circumscribed to the particle are drawn.

$$\text{Acicular ratio}=(\text{MX LNG})/(\text{WIDTH})$$

Subsequently, the average value of the acicular ratio is calculated for entire particles measured. It is preferred that length compensation (scale compensation) per pixel and two dimensional strain compensation of the instrumental system are thoroughly carried out precedently using the standard samples when measured by the above procedure. As the standard sample, suitable are uniform latex particles (DULP) commercially available from Dow Chemical in US, preferred are polystyrene particles having a coefficient of variation of less than 10% for the particle diameters of 0.1 to 0.3 μm, and specifically available is a lot with a particle diameter of 0.212 μm and standard deviation of 0.0029 μm.

The image processing technology in detail can refer to "Image Processing Application Technology (Kogyo Chosakai) edited by Hiroshi Tanaka", and the image processing program or apparatus is not especially limited as long as it is one where the above manipulation is possible, but one example includes Luzex-III supplied from Nireco Corporation.

The method where the organic silver salt particles having the above shape are obtained is not especially limited, but effective are that a mixing state at the formation of the organic acid alkali metallic salt soap and/or a mixing state at the addition of silver nitrate to the soap are kept well and that a rate of silver nitrate which reacts with the soap is made optical.

It is preferred that the tabular organic silver salt particles according to the present invention are predispersed with a binder and surfactants if necessary and subsequently dispersed/pulverized by a media dispersing machine or a high pressure homogenizer. For the above predispersion, it is possible to use common mixers such as anchor type and propeller type, a high-speed rotation centrifuging radiation type mixer (dissolver) and a high-speed rotation shearing type mixer (homo mixer).

Further, as the above media dispersing machine, it is possible to use rolling mills such as a ball mill, planetary ball mill and vibrating ball mill, media mixing mills such as a bead mill and attritor, and the others such as a basket mill, and as high pressure homogenizers, it is possible to use various types such as a type of conflicting to walls and plugs, a type where a liquid is divided into two and then the liquids are crashed at a high-speed and a type of passing through thin orifices.

As ceramics used for ceramic beads used at media dispersion, preferred are, for example, $Al_2O_3$, $BaTiO_3$, MgO, ZrO, BeO, $Cr_2O_3$, $SiO_2$, $SiO_2$—$Al_2O_3$, $Cr_2O_3$—MgO, MgO—CaO, MgO—C, MgO—$Al_2O_3$ (spinel), SiC, $TiO_2$, $K_2O$, $Na_2O$, BaO, PbO, $B_2O_3$, $SrTiO_3$ (strontium titanate), $BeAl_2O_4$, $Y_3Al_5O_{12}$, $ZrO_2$—$Y_2O_3$ (cubic zirconia), 3BeO—$Al_2O_3$—$6SiO_2$ (synthetic emerald), C (synthetic diamond), $Si_2O$-$nH_2O$, silicon nitride, yttrium stabilized zirconia, zirconia strengthened alumina and the like. Yttrium stabilized zirconia and zirconia strengthened alumina (hereinafter, abbreviated the zirconia-containing ceramics as zirconia) are specially preferably used from the reason why production of impurities due to friction with beads and the dispersing machine at the dispersion is low.

In the apparatuses used upon dispersing the tabular organic silver salt particles, as materials of members to which the organic silver salt particles contact, it is preferable to use ceramics such as zirconia, alumina, silicon nitride and boron nitride, or diamond, and among others it is preferable to use zirconia.

When the above dispersion is carried out, it is preferred that the binder is added at a concentration of 0.1 to 10% of the organic silver salt by mass, and it is preferred that liquid temperature is less than 45° C. throughout from predispersion to main dispersion. A preferable operating condition of the main dispersion includes the condition of 29.42 MPa to 98.06 MPa and two times or more of operations when the high pressure homogenizer is used as the dispersion means as the preferable operating condition. Also when the media dispersing machine is used as the dispersing means, the condition where a peripheral velocity is from 6 m/second to 13 m/second is included as the preferable condition.

Further, the preferable aspect in the photothermographic imaging materials according to the present invention is made by coating the organic silver salt having the characteristics that the rate of the organic silver salt particles which exhibit a projected area of less than 0.025 $\mu m^2$ when a sectional face perpendicular to the support face of the material is observed by the electron microscope is 70% or more of whole projected areas and the rate of the particles which exhibit the projected area of 0.2 $\mu m^2$ or more is 10% or less of whole projected areas of the organic silver salt particles, and further a photosensitive emulsion containing the photosensitive silver halide. In such a case, it is possible to obtain the state where agglomeration of the organic silver salt particles is low and the particles are distributed evenly in the photosensitive emulsion.

The conditions to make the photosensitive emulsion having such characteristics are not especially limited, but include that the mixing state at the formation of organic acid alkali metallic salt soap and/or the mixing state at the addition of silver nitrate to the soap are kept well, that the rate of silver nitrate which reacts to the soap is made optical, dispersing by the media dispersing machine or the high pressure homogenizer for dispersion/pulverization, that the use amount of binder (concentration) is made from 0.1 to 10% of the organic silver salt by mass at that time, agitating at the peripheral velocity of 2.0 m/second or more using the dissolver at the preparation of solution, in addition to that the temperature is less than 45° C. throughout from dry to the termination of main dispersion as the preferable conditions.

For the projected area of the organic silver salt particles having the certain projected area value and the rate based on the whole projected areas described above, the sites corresponding to the organic silver salt particles are extracted by the method using TEM (transmission electron microscope) as is described in the sites to obtain the average thickness of the tabular particles described above.

At that time, agglomerated particles are processed by regarding as one particle, and the area of each particle (AREA) is obtained. Likewise, the areas are obtained for at least 1,000 particles and preferably 2,000 particles, and sorted into three groups of A: less than 0.025 $\mu m^2$, B: 0.025 $\mu m^2$ or more and less than 0.2 $\mu m^2$, and C: 0.2 $\mu m^2$ or more. It is preferred that the imaging materials of the present invention are those which fulfill the condition where the sum of areas of the particles belonging to A group is 70% or more of the area of entire particles and the sum of areas of the particles belonging to C group is 10% or less of the area of measured entire particles.

It is preferred that length compensation (scale compensation) per pixel and two dimensional strain compensation of the instrumental system are thoroughly carried out beforehand using the standard samples and using the method which has been performed upon calculating the average value of the acicular ratio, when measured by the above procedure.

As with the above, the image processing technology in detail can refer to "edited by Hiroshi Tanaka, Image Processing Application Technology (Kogyo Chosakai)", and the image processing program or apparatus is not especially limited as long as it is one where the above manipulation is possible, but one example includes Luzex-III supplied from Nireco Corporation.

It is preferred that the organic silver salt particles according to the present invention are monodisperse particles, preferable monodisperse degree is from 1 to 30%, and the image with high density is obtained by making the monodisperse particles in this range. The monodisperse degree herein is defined by the following formula.

Monodisperse degree={(Standard deviation of particle diameters)/(Mean value of particle diameters)}×100

The average particle diameter (circle corresponding diameter) of the organic silver salt described above is preferably from 0.01 to 0.3 μm, and more preferably from 0.02 to 0.2 μm. Besides, the average particle diameter (diameter of corresponding circle) represents the diameter of a circle which has the same area as each particle image observed by the electron microscope.

To prevent devitrification of the photosensitive materials in the present invention, it is preferred that the total amount of silver halide and organic silver salt is from 0.3 g or more and 1.5 g or less per $m^2$ in terms of the silver amount. The preferable images are obtained when used as medical images by making this range. When it is less than 3 g per $m^2$, the image density is reduced in some cases. Also when it is more than 1.5 g per $m^2$, sensitivity reduction occurs at printing to PS plates in some cases.

Described is silver halide according to the present invention (hereinafter also referred to photosensitive halogenated solver particles or silver halide particles). Besides, the silver halide according to the present invention is referred to the silver halide crystalline particles treated and manufactured to be capable of originally absorbing light as an inherent nature of the silver halide crystal or capable of absorbing visual light or infrared light by artificial physicochemical methods, and such that physicochemical changes occur in the silver halide crystal or on the surface of the crystal when light is absorbed in any area of the light wavelength range from the ultraviolet light area to the infrared light area.

The silver halide particles per se used for the present invention can be prepared as the silver halide particle emulsion (also referred to silver halide emulsion) using the methods described in P. Glafkides, Chemie et Physique Photographique (published by Montel, 1967), G. F. Duffin, Photographic emulsion Chemistry (published by The Focal Press, 1966), V. L. Zelikman et al., Making and Coating Photographic Emulsion (published by The Focal Press, 1964), and the like. That is, any of an acid method, neutral method, ammonia method and the like may be used, and also as the method to react a soluble silver salt with a soluble halogen salt, any of an one side mixing method, a simultaneous mixing method and the combination thereof may be used, but among the above methods, so-called controlled double jet method is preferable where the silver halide particles are prepared with controlling the formation condition. A halogen composition is not especially limited, and may be any of silver chloride, silver chloride bromide, silver chloride iodide bromide, silver bromide, silver iodide bromide and silver iodide.

Particle formation is typically divided into two stages of silver halide seed particle (nucleus) generation and particle growth, the method where these are carried out continuously at a time may be used, and the method where nucleus (seed particle) formation and the particle growth are separately carried out may be used. The controlled double jet method where the particle formation is carried out by controlling pAg, pH which are the particle formation condition is preferable because the particle shape and size can be controlled. For example, when the method where the nucleus generation and the particle growth are separately carried out is performed, first a silver salt aqueous solution and a halide aqueous solution are mixed evenly and rapidly in a gelatin aqueous solution to generate the nucleus (seed particle), and subsequently the silver halide particles are prepared by a particle growth step where the particles are grown with supplying the silver salt aqueous solution and the halide aqueous solution under controlled pAg and pH. The desired silver halide photographic emulsion can be obtained by eliminating unnecessary salts by a desalting step such as the desalting method known in the art such as a noodle method, flocculation method, ultrafiltration method and electric dialysis method after the particle formation.

In the present invention, it is preferred that particle sizes of the silver halide particles are monodisperse. The monodisperse herein is referred to those where a coefficient of variation of the particle sizes obtained by the following formula is 30% or less. Preferably it is 20% or less and more preferably 15% or less.

Coefficient of variation of particle sizes %=(Standard deviation of particle diameters/Mean value of particle diameters)×100

Shapes of the silver halide particles can include a regular hexahedron, octahedron, 14-hedron particles, tabular particles, spherical particles, stick particles, potato-shaped particles and the like, but in these, preferred are regular hexahedron, octahedron, 14-hedron, and tabular silver halide particles.

When the tabular silver halide particles are used, the average aspect ratio is preferably 1.5 or more and 100 or less, and more preferably 2 or more and 50 or less. These are described in U.S. Pat. Nos. 5,264,337, 5,314,798 and 5,320,958, and the target tabular particles can be readily obtained. Additionally, particles where corners of the silver halide particles uproll can be preferably used.

Crystal habits of external surfaces of the halogenated solver particles are not especially limited, but it is preferred to use the silver halide particles having the crystal habit compatible for the selectivity at a high rate when a sensitizing dye having the crystal habit (face) selectivity is used in absorption reaction of the sensitizing dye onto the surface of the silver halide particles. For example, when the sensitizing dye which is selectively absorbed to crystal face with mirror index [100] is used, it is preferred that a occupying rate of the [100] face is high on the external surface of the silver halide particles, and this rate is preferably 50% or more, more preferably 70% or more, and especially preferably 80% or more. Besides, the rate of mirror index [100] face can be obtained by T. Tani, J. Imaging Sci., 29, 165 (1985) where absorption dependency of [111] face and [100] face is utilized in the absorption of sensitizing dye.

It is preferred that the silver halide particles of the present invention are prepared using low molecular weight gelatin with the average molecular weight of 50,000 or less at the formation of the particles, and in particular it is preferable to use at the nucleus formation of the silver halide particles.

In the present invention, the low molecular weight gelatin is preferably one with the average molecular weight of 50,000 or less, preferably from 2,000 to 40,000, and especially preferably from 5,000 to 25,000. The average molecular weight of gelatin can be measured by gel filtration chromatography. The low molecular weight gelatin can be obtained by enzymatically decomposing by adding gelatinase to an aqueous solution of gelatin with the average molecular weight of about 100,000 usually used, by hydrolyzing by adding an acid or an alkali to the solution, by thermally decomposing by heating in air or under pressure, by decomposing by sonication or by combining these methods.

A concentration of dispersion medium at the nucleus formation is preferably 5% by mass, and it is preferable to perform at the low concentration of 0.05 to 3.0% by mass.

It is preferred that the compound represented by the following Formula is used for the silver halide particles used for the present invention at the particle formation.

$$YO(CH_2CH_2O)_m(CH(CH_3)CH_2O)_p(CH_2CH_2O)n\ Y_4$$

$Y_4$ represents a hydrogen atom, —$SO_3M$ or —CO—B—COOM, M represents a hydrogen atom, an alkali metal atom, an ammonium group or an ammonium group substituted with an alkyl group of 5 or more carbon atoms, B represents a chain or a cyclic group which forms an organic dibasic acid, m and n represent from 0 to 50, respectively, and p represents from 1 to 100.

The polyethyleneoxide compound represented by the above Formula is preferably used as a defoaming agent for remarkable effervescence when photographic emulsion raw materials are stirred and moved such as a step where a gelatin aqueous solution is produced, a step where a water soluble halide and a water soluble silver salt are added to the gelatin solution and a step where the photographic emulsion is coated on the support, upon producing silver halide photographic photosensitive materials, and the technology using as the defoaming agent is described, for example, in JP-A-44-9497. The polyethyleneoxide compound represented by the above Formula also works as the defoaming agent at the nucleus formation.

The compound represented by the above Formula is preferably used at 1% or less by mass based on the silver, and more preferably is used at from 0.01 to 0.1% by mass.

The polyethyleneoxide compound represented by the above Formula could be present at the nucleus formation, and it is preferable to precedently add to the dispersion medium before the nucleus formation, but it may be added during the nucleus formation, or it may be used by adding to a silver salt aqueous solution or a halide aqueous solution used at the nucleus formation. Preferably it is used by adding to the halide aqueous solution or both aqueous solutions at from 0.01 to 2.0% by mass. Also, it is preferred to make the compound represented by the above Formula present over at least 50% of time period of the nucleus formation step, and more preferably present over 70% or more of the time period. The compound represented by the above Formula may be added as powder or by dissolving in a solvent such as methanol.

Besides, the temperature at the nucleus formation is typically from 5 to 60° C., preferably from 15 to 50° C., and it is preferable to control in the temperature range even when the temperature is constant, a temperature rising pattern (e.g., when the temperature at the start of nucleus formation is 25° C., the temperature is gradually elevated during the nucleus formation, and the temperature at the end of nucleus formation is 40° C.) or a reverse pattern thereof.

The concentration of the silver salt aqueous solution and the halide aqueous solution is preferably 3.5 mol/L or less, and further it is preferable to use at the low concentration of 0.01 to 2.5 mol/L. An addition velocity of silver ions at the nucleus formation is preferably from $1.5\times10^{-3}$ mol/min to $3.0\times10^{-1}$ mole/min per L of reaction solution, and more preferably from $3.0\times10^{-3}$ mol/min to $8.0\times10^{-2}$ mol/min.

At the nucleus formation, pH can be typically set in the range of 1.7 to 10, but since particle diameter distribution of the formed nuclei is broadened at pH of the alkali side, pH is preferably from pH 2 to 6, and more preferably from 1.5 to 2.0.

The silver halide particles used for the present invention may be added to an image formation layer by any methods, and at that time, it is preferred that the silver halide particles are positioned to come close to reducible silver source (organic silver salt).

It is preferred that the silver halide particles used for the present invention are precedently prepared and added to a solution for the preparation of organic silver salt particles in terms of production control because the preparation step of silver halide and the preparation step of organic silver salt particles can be separately treated. But, as described in British Patent No. 1,447,454, the silver halide particles can be produced nearly simultaneously with the production of organic silver salt particles by coexisting a halogen ingredient such as halide ions with the organic silver salt formation ingredients and inpouring the silver ions thereto when the organic silver salt particles are prepared.

Further, it is possible to prepare the silver halide particles by making a halogen-containing compound act to the organic silver salt and by conversion of the organic silver salt. That is, it is possible to make the silver halide forming ingredients act to a solution or dispersion of precedently prepared organic silver salt or a sheet material comprising the organic silver salt and to convert a part of the organic silver salt into photosensitive silver halide.

As the silver halide forming ingredients, there are inorganic halogen compounds, onium halides, halogenated hydrocarbons, N-halogen compounds, and the other halogen-containing compounds. For specific examples thereof, there are metallic halogenated matter, inorganic halogen compounds such as halogenated ammonium, e.g., onium halides such as trimethylphenyl ammonium bromide, cetylethyldimethyl ammonium bromide and trimethylbenzyl ammonium bromide, e.g., halogenated hydrocarbons such as iodoform, bromoform, carbon tetrachloride and 2-bromo-2-methylpropane, N-halogen compounds such as N-bromosuccinateimide, N-bromophthalimide and N-bromoacetamide, and the other, e.g., triphenylmethyl chloride, triphenylmethyl bromide, 2-bromoacetate, 2-bromoethanol, dichlorobenzophenone and the like described in detail in U.S. Pat. Nos. 4,009,039, 3,457,075, 4,003,749, British Patents No. 1,498,956, JP-A-53-27027 and JP-A53-25420. This way, the silver halide can be also prepared by converting a part of or all silver in the organic silver salt into the silver halide by the reaction of the organic silver salt and the halogen ions. Also, these silver halide particles produced by converting a part of the organic silver salt may be combined with the silver halide separately prepared.

For these silver halide particles, both the silver halide particles separately prepared and the silver halide particles by the conversion of organic silver salt are preferably used at from 0.001 to 0.7 mol for 1 mol of the organic silver salt, and more preferably used at from 0.03 to 0.5 mol.

It is preferred that the silver halide used for the present invention contains ions of transit metals belonging to Groups VI to X in periodic table of elements. As the above metals, preferred are W, Fe, Co, Ni, Cu, Ru, Rh, Pd, Re, Os, Ir, Pt and Au. These may be used alone, or two or more of the same type or different type metallic complexes may be combined. These metallic ions may be obtained by introducing the metallic salt in the silver halide, and can be introduced into the silver halide in a metallic complex or complex ion form. A content is preferably in the range of $1\times10^{-9}$ mol to $1\times10^{-2}$ mol, and more preferably from $1\times10^{-8}$ to $1\times10^{-4}$. In the present invention, the transit metallic complex or complex ion is preferably one represented by the following Formula.

$$[ML_6]^m$$

M represents a transit metal selected from the elements of Groups VI to X in the periodic table of elements, L represents a ligand, and m represents 0, 1-, 2-, or 3-. Specific examples of the ligand represented by L include halogen ion (fluorine ion, chlorine ion, bromine ion and iodine ion), cyanide, cyanate, thiocyanate, selenocyanate, tellurocyanate, ligands of azide and aquo, nitrosyl, thionitrosyl and the like, and preferably are aquo, nitrosyl and thionitrosyl. When the aquo ligand is present, it is preferable to occupy one or two of the ligands. L may be the same or different.

It is preferred that the compound which provides these metallic ions or complex ions is added at the silver halide particle formation and incorporated in the silver halide particles, and it may be added at any stage of the preparation of silver halide particles, i.e., before and after the nucleus formation, growth, physical maturation, and chemical sensitization, but it is preferable to add at the stage of nucleus formation, growth or physical maturation, it is more preferable to add at the stage of nucleus formation or growth, and in particular preferably it is added at the stage of nucleus formation. When added, the compound may be added by dividing in several times; can be evenly contained in the silver halide particles; and can be contained by possessing a distribution in the particle as described in JP-A-63-29603, JP-A-2-306236, JP-A-3-167545, JP-A-4-76534, JP-A-6-110146 and JP-A-5-273683.

These metallic compounds can be added by dissolving in water or an appropriate solvent (e.g., alcohols, ethers, glycols, ketones, esters, amides). For example, there are the method where an aqueous solution of powder of the metallic compound or an aqueous solution in which the metallic compound and NaCl, KCl are dissolved together has been added in a water soluble silver salt solution during the particle formation or a water soluble halide solution, or the method where the metallic compound is added as the third aqueous solution when the silver salt aqueous solution and the halide aqueous solution are simultaneously mixed to prepare the silver halide particle by a three solution simultaneous mixing method, the method where an aqueous solution of a required amount of the metallic compound is put in a reactor during the particle formation, or the method where the other silver halide particles in which the metallic ions or complex ions have been precedently doped are added to dissolve at the preparation of the silver halide. Especially, the method where the aqueous solution of powder of the metallic compound or the aqueous solution in which the metallic compound and NaCl, KCl are dissolved together is added to the halide aqueous solution is preferable. When added on the particle surface, the aqueous solution of the required amount of metallic compound can be put in the reactor immediately after the particle formation, during or at the end of the physical maturation, or at the chemical maturation.

Separately prepared photosensitive silver halide particles can be desalted by the desalting methods known in the art such as the noodle method, flocculation method, ultrafiltration method and electric dialysis method, but can be also used without desalting in the photothermographic imaging materials.

Chemical sensitization can be given to the silver halide particles used for the present invention. For example, by the methods disclosed in JP-A-2001-249428 and JP-A-2001-249426, a chemical sensitization center (chemical sensitization nucleus) can be formed and imparted using the compound having chalcogen atoms such as sulfur or the noble metal compound which releases noble metal ions such as gold ions. In the present invention, it is especially preferred that the chemical sensitization by the above compound having the chalcogen atom and the chemical sensitization using the noble metal compound are combined.

In the present invention, it is preferred to be chemically sensitized by the compound having the chalcogen atom shown below.

It is preferred that these compounds having the chalcogen atom useful as an organic sensitizer are the compounds having a group capable of being absorbed to the silver halide and an unstable chalcogen atomic site.

As these organic sensitizer, it is possible to use the organic sensitizers having various structures disclosed in JP-A-60-150046, JP-A-4-109240 and JP-A-11-218874, and among them, it is preferred that the sensitizer is at least one type of the compounds having the structure where the chalcogen atom is bound to a carbon atom or phosphorus atom by a double bond. Especially preferred are the compounds of the Formula (1-1) and the Formula (1-2) disclosed in JP-A-2002-250984.

An use amount of the chalcogen atom-containing compound as the organic sensitizer varies depending on the chalcogen compound used, the silver halide particles used and a reaction environment upon giving the chemical sensitization, is preferably from $10^{-8}$ to $10^{-2}$ mol, and more preferably from $10^{-7}$ to $10^{-3}$ mol. The chemical sensitization environment of the present invention is not especially limited, but it is preferred that chalcogen sensitization is given using the organic sensitizer having the chalcogen atom in the presence of the compound capable of vanishing or reducing in size chalcogenated silver or silver nucleus on the photosensitive silver halide particles, or in coexistence of an oxidizing agent capable of oxidizing the silver nucleus. As the sensitization condition, pAg is preferably from 6 to 11 and more preferably from 7 to 10, pH is preferably from 4 to 10 and more preferably from 5 to 8, and it is preferred that the sensitization is given at the temperature of 30° C. or below.

Therefore, in the photothermographic imaging materials of the present invention, it is preferred that the chemical sensitization is given to the photosensitive silver halide at the temperature of 30° C. or below using the chalcogen atom-containing organic sensitizer in the coexistence of the oxidizing agent capable of oxidizing silver nuclei on the particles, ant that used is a photosensitive silver halide emulsion which is mixed with the organic silver salt, dispersed, dehydrated and dried.

Further, it is preferred that the chemical sensitization using these organic sensitizers is carried out in the presence of a spectral sensitizing dye or a heteroatom-containing compound having absorbability to the silver halide particles. Dispersion of chemical sensitization center nuclei can be prevented, and high sensitivity and low photographic fog can be achieved by performing the chemical sensitization in the presence of the compound having the absorbability to the silver halide. The spectral sensitizing dye used in the present invention is described below, but the heteroatom-containing compounds having the absorbability to the silver halide include nitrogen-containing heterocyclic compounds described in JP-A-3-24537. In the nitrogen-containing heterocyclic compounds used for the present invention, heterocyclic rings can include pyrazole ring, pyrimidine ring, 1,2,4-triazole ring, 1,2,3-triazole ring, 1,3,4-thiaziazole ring, 1,2,3-thiaziazole ring, 1,2,4-thiaziazole ring, 1,2,5-thiaziazole ring, 1,2,3,4-tetrazole ring, pyridazine ring, 1,2,3-triazine ring, rings where two to three of these rings are bound, e.g., triazolotriazole ring, diazaindene ring, triazaindene ring, pentaazaindene ring and the like. It is possible to apply the heterocyclic rings where a monocyclic heterocyclic ring and an aromatic ring is condensed, such as phthalazine ring, benzimidazole ring, indazole ring, and benzothiazole ring.

Among them, preferred are azaindene rings, and more preferable are azaindene compounds having a hydroxyl group as a substituent, e.g., hydroxytriazaindene, hydroxytetraazaindene, hydroxypentaazaindene compounds and the like.

The heterocyclic ring may have substituents other than the hydroxyl group. It may have, for example, alkyl, alkylthio, amino, hydroxyamino, alkylamino, dialkylamino, arylamino, carboxyl, alkoxycarbonyl groups, halogen atoms, cyano group and the like as the substituents.

The addition amount of the heterocyclic compound containing them varies in the wide range depending on the sizes and composition of silver halide particles and the other conditions, and the approximate amount is in the range of $10^{-6}$ mol to 1 mol as the amount per mol of the silver halide, and preferably in the range of $10^{-4}$ mol to $10^{-1}$ mol.

The noble metal sensitization can be given to the silver halide particles according to the present invention by utilizing the compound which releases noble metal ions such as gold ions as described above. For example, as the gold sensitizer, it is possible to use aurichloride salts and organic gold compounds.

Further, reducing sensitization methods can be used in addition to the above sensitization methods. As specific compounds for the reducing sensitization, it is possible to use ascorbic acid, thiourea dioxide, stannous chloride, hydrazine derivatives, boron compounds, silane compounds, polyamine compounds and the like. Further, the reducing sensitization can be carried out by maturing with retaining pH or pAg of the photographic emulsion 7 or more or 8.2 or less, respectively.

The silver halide given the chemical sensitization according to the present invention may be those formed in the presence of the organic silver salt, those formed in the absence of the organic silver salt, or those where both are mixed.

It is preferred that the spectral sensitization is given to the photosensitive silver halide particles used for the present invention by making spectral sensitizing dye absorb. As the spectral sensitizing dye, it is possible to use cyanine dye, merocyanine dye, complex cyanine dye, complex merocyanine dye, holopolar cyanine dye, styryl dye, hemicyanine dye, oxonol dye, hemioxonol dye and the like. For example, it is possible to use the sensitizing dyes described in JP-A-63-159841, JP-A-60-140335, JP-A-63-231437, JP-A-63-259651, JP-A-63-304242, JP-A-63-15245, U.S. Pat. Nos. 4,639,414, 4,740,455, 4,741,966, 4,751,175 and 4,835,096. The useful sensitizing dyes used for the present invention are for example described in the references described or cited in RD17643IV-A section (December in 1978, page 23) and RD18431 X section (August in 1978, page 437). Especially it is preferable to use the sensitizing dye having spectral sensitivity suitable for spectral property of various laser imager and scanner light sources. For example, preferably used are the compounds described in JP-A-9-34078, JP-A-9-54409 and JP-A-9-80679.

Useful cyanine dyes are, for example, the cyanine dyes having basic nuclei such as thiazoline nucleus, oxazoline nucleus, pyrroline nucleus, pyridine nucleus, oxazole nucleus, thiazole nucleus, selenazole nucleus and imidazole nucleus. Useful merocyanine dyes and preferable ones include acidic nuclei such as thiohydantoin nucleus, rhodanine nucleus, oxazolidine dione nucleus, thiazolinedione nucleus, barbituric acid nucleus, thiazolinone nucleus, malononitrile nucleus and pyrazolone nucleus in addition to the above basic nuclei.

In the present invention, it is preferable to use the sensitizing dye especially having spectral responsivity in an infrared area. In the present invention, infrared spectral sensitizing dyes preferably used include the infrared spectral sensitizing dyes disclosed, for example, in U.S. Pat. Nos. 4,536,473, 4,515,888 and 4,959,294.

Concerning the infrared spectral sensitizing dyes used in the present invention, especially preferred are long chain polymethine dyes characterized in that a sulfinyl group is substituted on a benzene ring of a benzazole ring.

The above infrared spectral sensitizing dyes can be readily synthesized by the method, for example, described in F. M. Harmer, The Chemistry of Heterocyclic Compounds, Vol. 18, The Cyanine Dyes and Related Compounds (edited by A. Weissberger, published by Interscience, New York, 1964).

An addition time of these infrared spectral sensitizing dyes may be anytime after the preparation of the silver halide, and for example, they can be added by adding in a solvent or in so-called solid dispersion state by dispersing in a particulate form, to the photosensitive photographic emulsion containing the silver halide particles or the silver halide particles/organic silver salt particles. Further, as is the case with the heteroatom-containing compound having the absorbability to the silver halide particles, prior to the chemical sensitization, after adding to the silver halide particles and making absorb thereto, the chemical sensitization can be also given. This can prevent the dispersion of chemical sensitization center nuclei and can achieve high sensitivity and low photographic fog.

In the present invention, the above infrared spectral sensitizing dyes may be used alone or in combination thereof, and the combination of sensitizing dyes is often used especially for the purpose of strong color sensitization.

In the photographic emulsion containing the silver halide particles or the organic silver salt particles used for the photothermographic imaging materials of the present invention, along with the sensitizing dye, a dye which per se has no spectral sensitizing action or a substance which does not substantially absorb visible light and which expresses a strong color sensitizing effect is included in the photographic emulsion, and this may perform strong color sensitization of the silver halide particles.

Useful sensitizing dyes, the combination of dyes which exhibit the strong color sensitization and the substance exhibiting the strong color sensitization are described in RD 17643 (issued in December, 1978) page 23 IV J section, or JP-B-9-2550, JP-B-43-4933, JP-A-59-19032, JP-A-59-192242 and JP-A-5-341432. In the present invention, as the strong color sensitizers, preferred are heterocyclic aromatic mercapto compounds represented by the following Formula or mercapto derivative compounds.

Ar—SM

M is a hydrogen atom or an alkali metal atom, Ar is a heterocyclic aromatic ring or condensed aromatic ring having one or more nitrogen, oxygen, selenium, or tellurium atoms. Preferable heterocyclic aromatic rings or condensed aromatic rings include benzimidazole, naphthimidazole, benzothiazole, naphthothiazole, benzoxazole, naphthoxazole, benzoselenazole, benzotellurazole, imidazole, oxazole, pyrazole, triazole, triazine, pyrimidine, pyridazine, pyrazine, pyridine, purine, quinoline, or quinazoline or the like. However, the other heterocyclic aromatic rings are included.

Besides, the present invention also includes mercapto derivative compounds which substantially produce the above mercapto compounds when contained in the dispersion of the organic acid silver salt or silver halide particle emulsion. Especially, preferable examples include the mercapto derivative compounds represented by the following Formula.

Ar—S—S—Ar

Ar is the same as defined in the case of the mercapto compounds represented by the above Formula.

The above heterocyclic aromatic ring or condensed aromatic ring, for example, can have a substituent selected from the group consisting of halogen atoms (e.g., Cl, Br, I), hydroxyl, amino, carboxyl, alkyl groups (e.g., those having one or more carbon atoms, preferably from 1 to 4 carbon atoms), and alkoxy groups (e.g., those having one or more carbon atoms, preferably from 1 to 4 carbon atoms).

In the present invention, as the strong color sensitizer, it is possible to use macrocyclic compounds comprising the compound represented by the Formula (1) disclosed in JP-A-2001-330918 and heteroatoms, in addition to the above strong color sensitizers.

It is preferable to use the string color sensitizer at the range of 0.001 to 1.0 mol per mol of the silver in a photographic emulsion layer comprising the organic silver salt and silver halide particles. It is especially preferable to use at the range of 0.01 to 0.5 mol per mol of the silver.

In the present invention, as a reducing agent (silver ion reducing agent), especially a compound where at least one type of reducing agents is a bisphenol derivative is used alone, or used in conjunction with a reducing agent having the other different chemical structure. In the photothermographic imaging materials according to the present invention, it is possible to unexpectedly inhibit performance deterioration due to the occurrence of photographic fog during CP storage of the photothermographic imaging materials and color tone deterioration in storage of silver images after the photothermographic process.

As the reducing agents used for the present invention, used are the reducing agent of the Formula (A-1), more preferably the Formula (A-2), the compound of a Formula (A-4) or a Formula (A-5).

In the Formula (A-1), Z represents an atomic group required to configure a 3- to 10-membered ring with carbon atoms, and Z is preferably a 3- to 10-membered non-aromatic ring or a 5- to 6-membered aromatic ring and more preferably a 3- to 10-membered non-aromatic ring. As the rings, specifically, the 3-membered rings include cyclopropyl, aziridil, oxyranyl, the 4-membered rings include cyclobutyl, cyclobutenyl, oxetanyl, and azetidinyl, the 5-membered rings include cyclopentyl, cyclopentenyl, cyclopentadienyl, tetrahydrofuranyl, pyrolidinyl, and tetrahydrothienyl, the 6-membered rings include cyclohexane, cyclohexenyl, cyclohexadienyl, tetrahydropyranyl, pyranyl, piperidinyl, dioxanyl, tetrahydrothiopyranyl, norcaranyl, norpinanyl and norbornyl, the 7-membered rings include cycloheptyl, cycloheptinyl and cycloheptadienyl, the 8-membered rings include cycloctanyl, cyclooctenyl, cyclooctadienyl and cyclooctatrienyl, the 9-membered rings include cyclononanyl, cyclononenyl, cyclononadienyl and cyclononatrienyl, and the 10-membered rings include cyclodecanyl, cyclodecenyl, cyclodecadienyl, cyclodecatrienyl, and the like.

The 3- to 6-membered rings are preferable, the 5- to 6-membered rings are more preferable, the 6-membered rings are most preferable, and among them, hydrocarbon rings containing no heteroatom are preferable. The ring may form a spiro bond with the other ring via spiro atoms, or may be condensed with the other ring including the aromatic rings in any way. Also, the ring can have any substituents on the ring. It is especially preferred that the hydrocarbon ring is the hydrocarbon ring comprising alkenyl or alkynyl structure including —C═C— and —C≡C—.

The substituents specifically include halogen atoms (e.g., fluorine, chlorine, bromine atoms), alkyl groups (e.g., methyl, ethyl, propyl, butyl, pentyl, iso-pentyl, 2-ethylhexyl, octyl, decyl groups, etc.), cycloalkyl groups (e.g., cyclohexyl, cycloheptyl groups, etc.), alkenyl groups (e.g., etenyl-2-propenyl, 3-butenyl, 1-methyl-3-propenyl, 1-methyl-3-butenyl groups, etc.), cycloalkenyl groups (e.g., 1-cycloalkenyl, 2-cycloalkenyl groups, etc.), alkynyl groups (e.g., ethynyl, 1-propinyl groups, etc.), alkoxy groups (e.g., methoxy, ethoxy, propoxy groups, etc.), alkylcarbonyloxy groups (e.g., acetyloxy group, etc.), alkylthio groups (e.g., methylthio, trifluoromethylthio groups, etc.), carboxyl groups, alkylcarbonylamino groups (e.g., acetylamino group, etc.), ureide groups (e.g., methylaminocarbonylamino group, etc.), alkylsulfonylamino groups (e.g., methanesulfonylamino group, etc.), alkylsulfonyl groups (e.g., methanesulfonyl, trifluoromethanesulfonyl groups, etc.), carbamoyl groups (e.g., carbamoyl, N,N-dimethylcarbamoyl, N-morpholinocarbonyl groups, etc.), sulfamoyl groups (e.g., sulfamoyl, N,N-dimethylsulfamoyl, morpholinosulfamoyl groups, etc.), trifluoromethyl, hydroxyl, nitro, cyano groups, alkylsulfoneamide groups (e.g., methanesulfoneamide, butanesulfoneamide groups, etc.), alkylamino groups (e.g., amino, N,N-dimethylamino, N,N-diethylamino groups, etc.), sulfo, phosphono, sulfite, sulfino groups, alkylsulfonylaminocarbonyl groups (e.g., methanesulfonylaminocarbonyl, ethanesulfonylaminocarbonyl groups, etc.), alkylcarbonylaminosulfonyl groups (e.g., acetoamidesulfonyl, methoxyacetoamidesulfonyl groups, etc.), alkynylaminocarbonyl groups (e.g., acetoamidecarbonyl, methoxyacetoamidecarbonyl groups, etc.), alkylsulfinylaminocarbonyl groups (e.g., methanesulfinylaminocarbonyl, ethanesulfinylaminocarbonyl groups, etc.), and the like. When there are two or more substituents, they may be the same or different. Especially preferable substituents are alkyl groups.

$R_1$ and $R_2$ represent groups capable of being substituted on the benzene ring, and include, for example, hydrogen atoms, alkyl, aryl or heterocyclic ring groups. As the alkyl groups, it is specifically preferable to be the alkyl groups with 1 to 10 carbons. Specific examples include methyl, ethyl, propyl, isopropyl, butyl, t-butyl, pentyl, iso-pentyl, 2-ethyl-hexyl, octyl, decyl, cyclohexyl, cycloheptyl, 1-methylcyclohexyl, etenyl-2-propenyl, 3-butenyl, 1-methyl-3-propenyl, 3-pentenyl, 1-methyl-3butenyl, 1-cycloalkenyl, 2-cycloalkenyl, ethynyl, 1-propinyl groups and the like. More preferably, included are methyl, ethyl, isopropyl, t-butyl, cyclohexyl, 1-methylcyclohexyl groups and the like. They are preferably methyl, t-butyl and 1-methycyclohexyl groups, and most preferably methyl group. As the aryl groups, specifically included are phenyl, naphthyl, anthranil groups and the like. The heterocyclic ring groups specifically include aromatic hetero ring groups such as pyridine, quinoline, isoquinoline, imidazole, pyrazole, triazole, oxazole, thiazole, oxadiazole, thiadiazole and tetrazole groups, and non-aromatic hetero ring groups such as pyperidino, morpholino, tetrahydrofuryl, tetrahydrothienyl and tetrahydropyranyl groups. These groups may further have substituents, and the substituents can include substituents on the rings described above. Multiple $R_1$ and $R_2$ may be the same or different, but the most preferable is the case where all are methyl groups.

$R_x$ represents a hydrogen atom or an alkyl group, and as the alkyl group, it is specifically preferable to be the alkyl group with 1 to 10 carbons. Specific examples include methyl, ethyl, propyl, isopropyl, butyl, t-butyl, pentyl, iso-pentyl, 2-ethyl-hexyl, octyl, decyl, cyclohexyl, cycloheptyl, 1-methylcyclohexyl, etenyl-2-propenyl, 3-butenyl, 1-methyl-3-propenyl, 3-pentenyl, 1-methyl-3-butenyl, 1-cycloalkenyl, 2-cycloalkenyl, ethynyl, 1-propinyl groups and the like. More preferably included are methyl, ethyl isopropyl groups and the like. Preferably $R_x$ is a hydrogen atom.

$Q_0$ represents a group capable of being substituted on the benzene ring, and can specifically include alkyl groups with 1 to 25 carbons (e.g., methyl, ethyl, propyl, isopropyl, tert-butyl, pentyl, hexyl, cyclohexyl groups, etc.), halogenated alkyl groups (e.g., trifluoromethyl, perfluorooctyl groups, etc.), cycloalkyl groups (e.g., cyclohexyl, cyclopentyl groups, etc.), alkynyl groups (propargyl group, etc.), glycidyl, acrylate, methacrylate groups, aryl groups (e.g., phenyl group, etc.), heterocyclic ring groups (e.g., pyridyl, thiazolyl, oxazolyl, imidazolyl, furyl, pyrrolyl, pyrazinyl, pyrimidinyl, pyridazinyl, selenazolyl, suliforanyl, piperidinyl, pyrazolyl, tetrazolyl groups, etc.), halogen atoms (chlorine, bromine, iodine, fluorine atoms), alkoxy groups (methoxy, ethoxy, propyloxy, pentyloxy, cyclopentyloxy, hexyloxy, cyclohexyloxy groups, etc.), aryloxy groups (phenoxy group, etc.), alkoxycarbonyl groups (methyloxycarbonyl, ethyloxycarbonyl, butyloxycarbonyl groups, etc.), aryloxycarbonyl groups (phenyloxycarbonyl groups, etc.), sulfonamide groups (methanesulfonamide, ethanesulfonamide, butanesulfonamide, hexanesulfonamide, cyclohexanesulfonamide, benzenesulfonamide groups, etc.), sulfamoyl groups (aminosulfonyl, methylaminosulfonyl, dimethylaminosulfonyl, butylaminosulfonyl, hexylaminosulfonyl, cyclohexylaminosulfonyl, phenylaminosulfonyl, 2-pyridylaminosulfonyl groups, etc.), urethane groups (methylureide, ethylureide, pentylureide, cyclohexylureide, phenylureide, 2-pyridylureide groups, etc.), acyl groups (acetyl, propionyl, butanoyl, hexanoyl, cyclohexanoyl, benzoyl, pyridinoyl groups, etc.), carbamoyl groups (aminocarbonyl, methyaminocarbonyl, dimethylaminocarbonyl, propylaminocarbonyl, pentylaminocarbonyl, cyclohexylaminocarbonyl, phenylaminocarbonyl, 2-pyridylaminocarbonyl groups, etc.), amide groups (acetamide, propionamide, butanamide, hexanamide, benzamide groups, etc.), sulfonyl groups (methylsulfonyl, ethylsulfonyl, butylsulfonyl, cyclohexylsulfonyl, phenylsulfonyl, 2-pyridylsulfonyl groups, etc.), amino groups (amino, ethylamino, dimethylamino, butylamino, cyclopentylamino, anilino, 2-pyridylamino groups, etc.), cyano, nitro, sulfo, carboxyl, hydroxyl, oxamoyl groups and the like. These groups may be further substituted with these groups. And, n and m represent an integer of 0 to 2, and most preferably both n and m are 0.

L represents a bivalent linkage group, preferably is an alkylene group such as methylene, ethylene, and propylene, and the number of carbons is preferably from 1 to 20, and more preferably from 1 to 5, and k represents an integer of 0 to 1, and most preferably is the case of k=0.

In the Formula (A-2), $Q_1$ represents a halogen atom, an alkyl, aryl or hetero ring group, $Q_2$ represents a hydrogen atom, a halogen atom, an alkyl, aryl or hetero ring group, and the halogen atoms specifically include chlorine, bromine, fluorine and iodine. Preferably it is fluorine, chlorine or bromine. As the alkyl group, specifically it is preferable to be the alkyl group with 1 to 10 carbons. Specific examples include methyl, ethyl, propyl, isopropyl, butyl, t-butyl, pentyl, iso-pentyl, 2-ethyl-hexyl, octyl, decyl, cyclohexyl, cycloheptyl, 1methylcyclohexyl, etenyl-2-propenyl, 3-butenyl, 1-methyl-3-propenyl, 3-pentenyl, 1-methyl-3-butenyl, 1-cycloalkenyl, 2-cycloalkenyl, ethynyl, 1-propinyl groups and the like. More preferably, they are methyl and ethyl groups. The aryl groups specifically include phenyl and naphthyl groups. The hetero ring groups preferably include 5- to 6-memberd hetero aromatic groups such as pyridyl, furyl, thienyl and oxazolyl groups.

$Q_1$ is most preferably a methyl group, $Q_2$ is preferably a hydrogen atom or a methyl group and most preferably a hydrogen atom.

G represents a nitrogen or carbon atom, and is preferably a carbon atom, and ng represents 0 or 1 and is preferably 1.

$Z_2$ represents a carbon atom and an atomic group required for configuring a 3- to 10-membered non-aromatic ring together with G, and the 3- to 10-membered non-aromatic ring is the same as defined in the Formula (A-1) described above.

$R_1$, $R_2$, $R_x$, $Q_0$, L, k, n and m are the same as defined in the Formula (A-1).

Next, the reducing agents represented by the Formula (A-4) or (A-5) are described.

In the Formula (A-4), $R_{40}$ represents the Formula (A), and $R_{43}$ to $R_{45}$ each represent a hydrogen atom or a substituent. The substituents represented by $R_{43}$ to $R_{45}$ include, for example, alkyl groups (methyl, ethyl, propyl, isopropyl, cyclopropyl, butyl, isobutyl, sec-butyl, t-butyl, cyclohexyl, 1-methyl-cyclohexyl groups, etc.), alkenyl groups (vinyl, propenyl, butenyl, pentenyl, isohexenyl, cyclohexenyl, butenylidene, isopentylidene groups, etc.), alkynyl groups (ethynyl, propinylidene groups, etc.), aryl groups (phenyl, naphthyl groups, etc.), hetero ring groups (furyl, thienyl, pyridyl, tetrahydrofuranyl groups, etc.), halogen, hydroxyl, alkoxy, aryloxy, acyloxy, sulfonyloxy, nitro, amino, acylamino, sulfonylamino, sulfonyl, carboxy, alkoxycarbonyl, aryloxycarbonyl, carbamoyl, sulfamoyl, cyano, sulfo groups and the like.

When $R_{43}$ to $R_{45}$ in the Formula (A) do not form the ring one another, $R_{40}$ comprises at least one ethylene group which may be substituted (2,6-dimethyl-5-heptenyl, 1,5dimethyl-4-hexenyl, etc.) or acetylene group which may be substituted (1-propinyl, etc.).

When $R_{43}$ to $R_{45}$ in the Formula (A) form the ring (phenyl, naphthyl, furyl, thienyl, pyridyl, cyclohexyl, cyclohexenyl, etc.) one another, $R_{40}$ comprises at least one ethylene group (vinyl, propenyl, acryloxy, methacryloxy, etc.) which may be substituted or acetylene group (ethynyl, acetylenecarbonyloxy, etc.) out of this ring.

$R_{41}$, $R_{41}'$, $R_{42}$, $R_{42}'$, $X_{41}$, and $X_{41}'$ each represent a hydrogen atom or a substituent, and the substituents include the same groups as the substituents included in the description of $R_{43}$ to $R_{45}$.

$R_{41}$, $R_{41}'$, $R_{42}$, and $R_{42}'$ are preferably alkyl groups, and specifically include the same groups as the alkyl groups included in the description of $R_{43}$ to $R_{45}$ In the Formula (A-5), $R_{50}$ represents a hydrogen atom or a substituent, and the substituent includes the same groups as the substituents included in the description of $R_{43}$ to $R_{45}$. $R_{50}$ is preferably a hydrogen atom, alkyl, alkenyl, or alkynyl, and more preferably a hydrogen atom or alkyl group.

$R_{51}$, $R_{51}'$, $R_{52}$, $R_{52}'$, $X_{51}$, and $X_{51}'$ each represent a hydrogen atom or a substituent, and the substituents include the same groups as the substituents included in the description of $R_{43}$ to $R_{45}$ in the Formula (A-4)

$R_{51}$, $R_{51}'$, $R_{52}$, and $R_{52}'$ are preferably alkyl, alkenyl and alkynyl groups, and specifically include the same groups as the examples of alkyl, alkenyl and alkynyl groups included in the description of $R_{43}$ to $R_{45}$.

However, at least one of $R_{51}$, $R_{51}'$, $R_{52}$, $R_{52}'$, $X_{51}$, and $X_{51}'$ comprises an ethylene group which may be substituted (vinyl, ally, methacryloxymethyl, etc.) or an acetylene group which may be substituted (ethynyl, propargyl, propargyloxycarbonyloxymethyl, etc.).

In the present invention, it is preferable to combine the compound represented by the Formula (A-1) and the compound represented by the following Formula (A-3). A combination ratio is preferably [mass of the Formula (A-1)]:[mass of the Formula (A-3)]=95:5 to 55:45, and more preferably from 90:10 to 60:40.

(A-3)

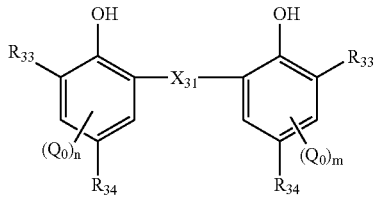

In the Formula (A-3), $X_{31}$ represents a chalcogen atom or $CHR_3$. The chalcogen atom is sulfur, selenium or tellurium, and preferably a sulfur atom. $R_3$ in $CHR_3$ represents a hydrogen atom, a halogen atom or an alkyl group, the halogen atoms are, for example, fluorine, chlorine or bromine atoms, and the alkyl group is preferably a substituted or unsubstituted alkyl group with 1 to 20 carbons. Specific examples of the alkyl groups are, for example, methyl, ethyl, propyl, butyl, hexyl, heptyl, vinyl, ally, butenyl, hexadienyl, ethenyl-2-propenyl, 3-butenyl, 1-methyl-3-propenyl, 3-pentenyl, 1-methyl-3-butenyl, and the like.

These groups may further have substituents, and as the substituent, it is possible to use the substituents described in the Formula (A-1). Also, when there are two or more substituents, they may be the same or different.

$R_{33}$ represents alkyl groups, may be the same or different, and at least one is a secondary or tertiary alkyl group. The alkyl groups are preferably substituted or unsubstituted ones with 1 to 20 carbons, and specifically include methyl, ethyl, propyl, isopropyl, butyl, isobutyl, t-butyl, t-amyl, t-octyl, cyclohexyl, cyclopentyl, 1-methylcyclohexyl, 1-methylcyclopropyl groups and the like.

The substituents of the alkyl group are not especially limited, and for example, include aryl, hydroxy, alkoxy, aryloxy, alkylthio, arylthio, acylamino, sulfonamide, sulfonyl, phosphoryl, acyl, carbamoyl, ester groups, halogen atoms and the like. Also it may form a saturated ring together with $(Q_0)_n$ and $(Q_0)_m$. All of $R_{33}$ are preferably secondary or tertiary alkyl groups, and carbons of 2 or more and 20 or less are preferable. They are more preferably tertiary alkyl groups. More preferably, they are t-butyl, t-amyl, and 1-methylcyclohexyl groups, and most preferably 1-methylcyclohexyl groups.

$R_{34}$ represents a hydrogen atom or a group capable of being substituted to benzene ring. The groups capable of being substituted to benzene group include, for example, halogen atoms such as fluorine, chlorine and bromine atoms, aryl, cycloalkyl, alkenyl, cycloalkenyl, alkynyl, amino, acyl, acyloxy, acylamino, sulfonylamino, sulfamoyl, carbamoyl, alkylthio, sulfonyl, alkylsulfonyl, sulfinyl, cyano, hetero ring groups and the like. Multiple $R_{33}$ and $R_{34}$ may be the same or different.

$R_{34}$ has preferably from 1 to 5 carbons and more preferably from 1 to 2 carbons. These groups may further have substituents, and as the substituents, it is possible to use the substituents described in the Formula (A-1). All of $R_{34}$ are preferably alkyl groups with 1 to 20 carbons, and most preferably methyl groups.

$Q_0$, n and m are the same as defined in the Formula (A-1). Also, $Q_0$ may form a saturated ring together with $R_{33}$ and $R_{34}$. $Q_0$ is preferably a hydrogen atom, a halogen atom or an alkyl group, and more preferably a hydrogen atom.

Hereinafter, specific examples of the compounds represented by the Formulae (A-1) to (A-5) of the present invention are listed, but the invention is not limited thereto.

(1-1)
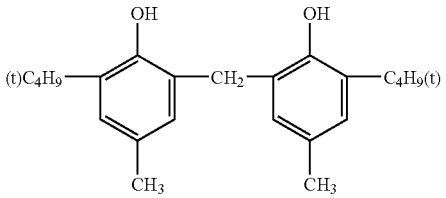
(1-2)
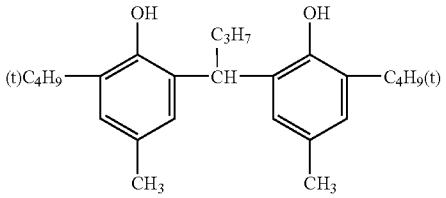
(1-3)
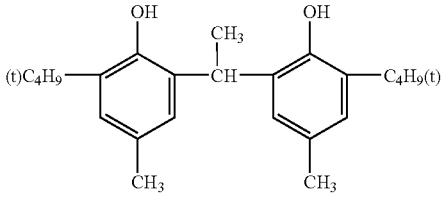
(1-4)
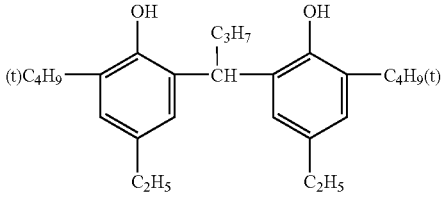
(1-5)
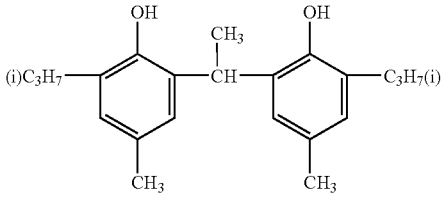
(1-6)
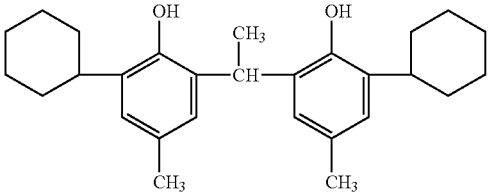
(1-7)
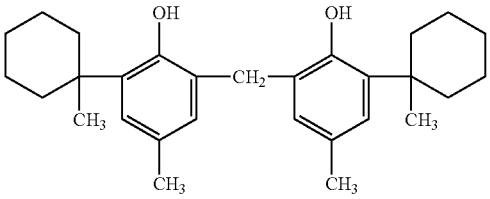
-continued
(1-8)
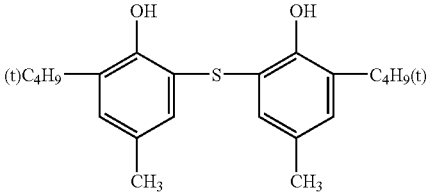
(1-9)
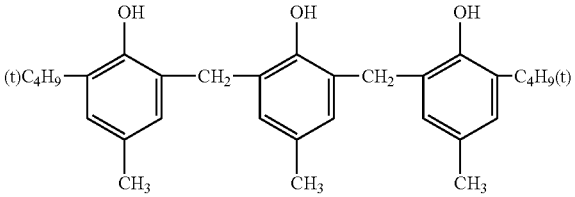
(1-10)
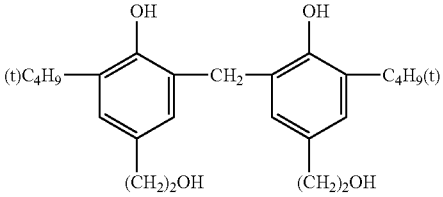
(1-11)
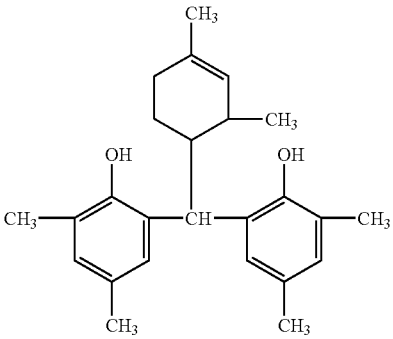
(1-12)
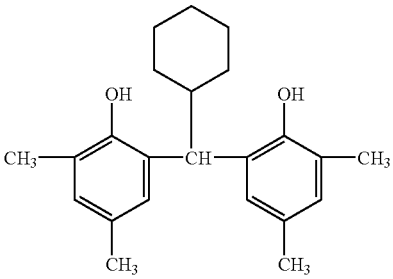
(1-13)
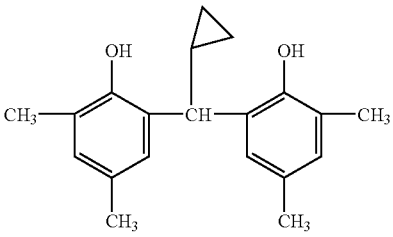

-continued
(1-14)
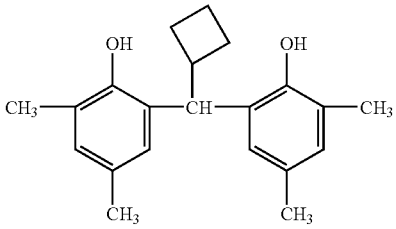
(1-15)
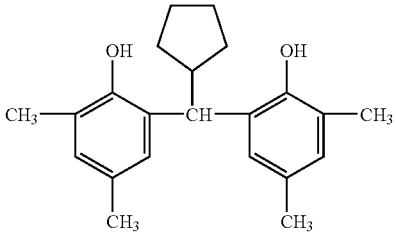
(1-16)
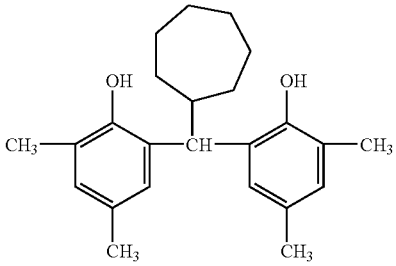
(1-17)
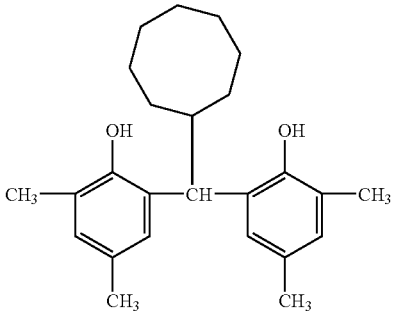
(1-18)
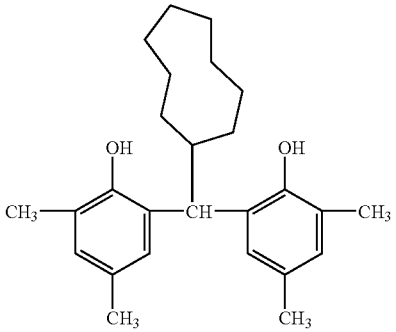
-continued
(1-19)
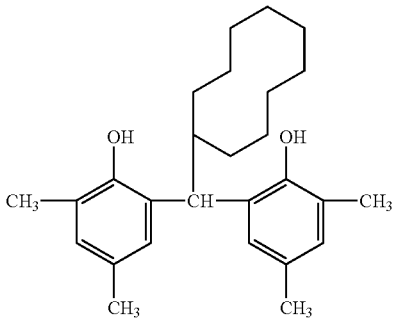
(1-20)
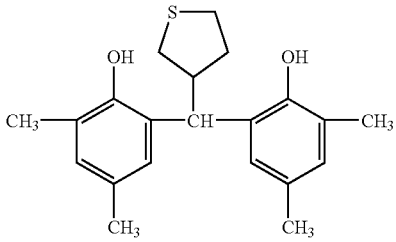
(1-21)
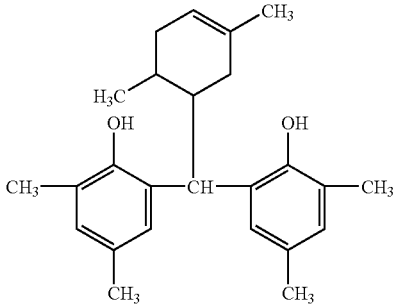
(1-22)
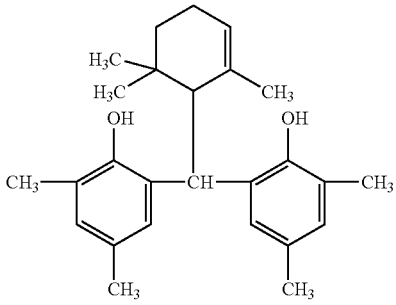
(1-23)
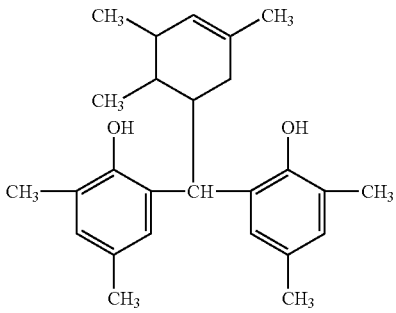

-continued
(1-24)
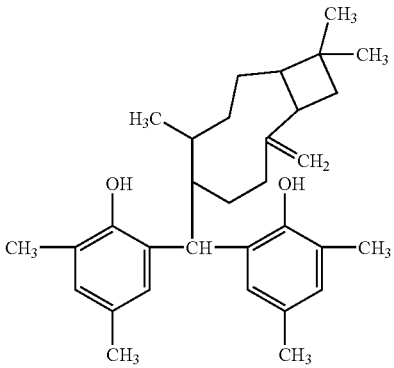
(1-25)
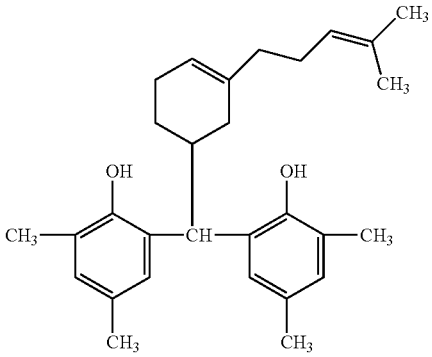
(1-26)
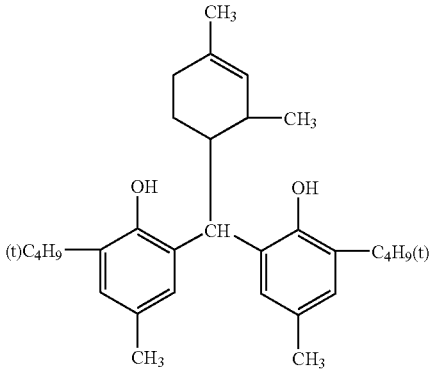
(1-27)
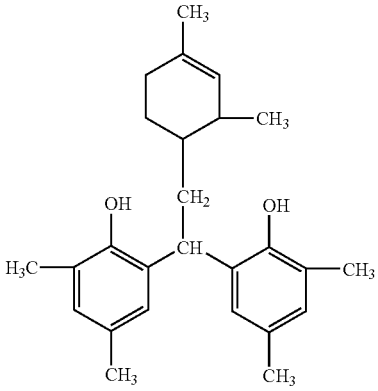
-continued
(1-28)
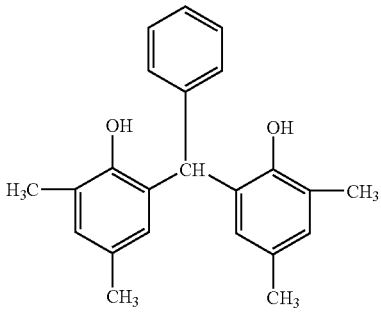
(1-29)
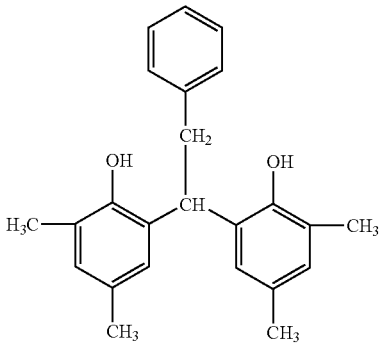
(1-30)
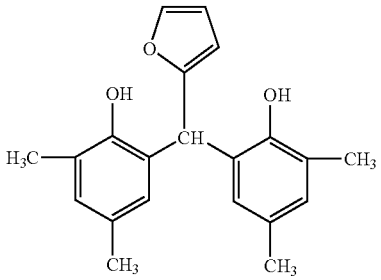
(1-31)
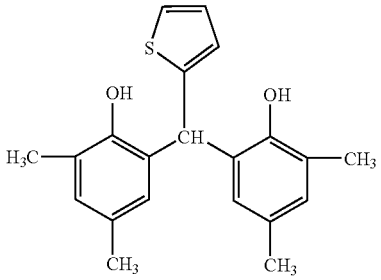
(1-32)
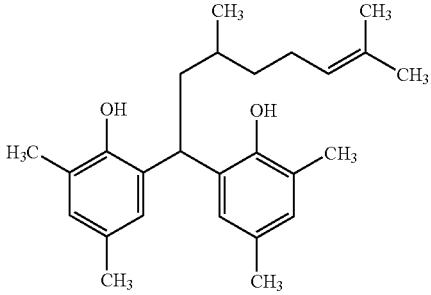

-continued
(1-33)
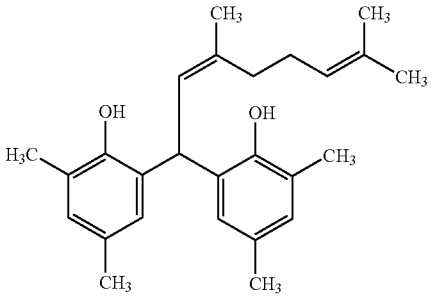
(1-34)
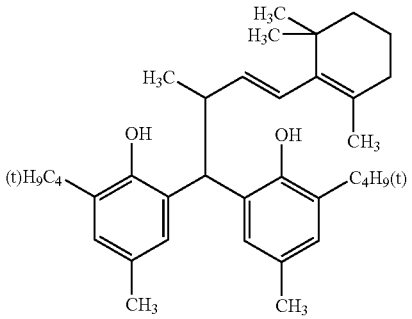
(1-35)
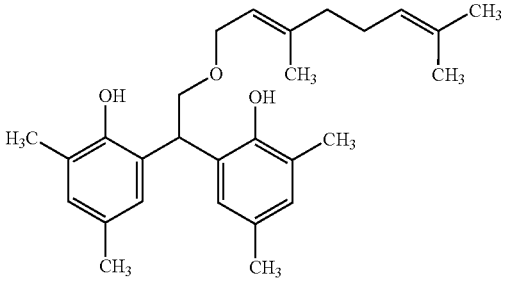
(1-36)
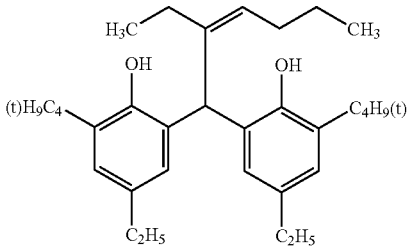
(1-37)
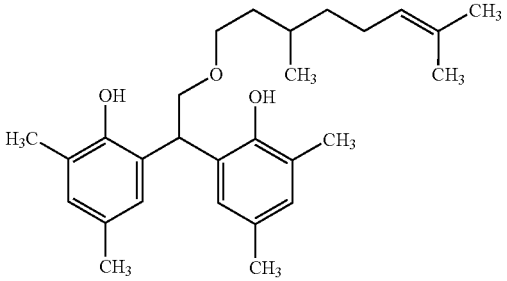
-continued
(1-38)
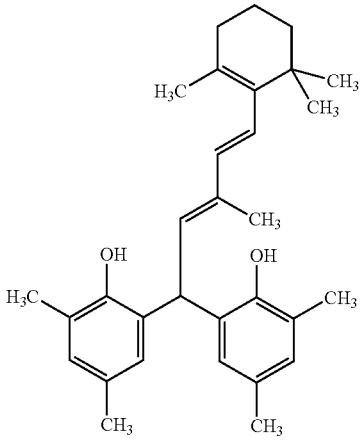
(1-39)
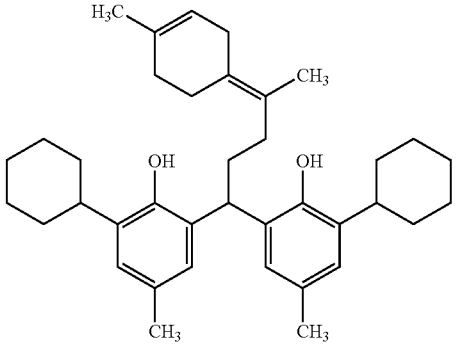
(1-40)
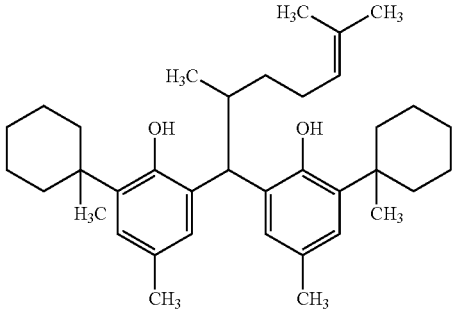
(1-41)
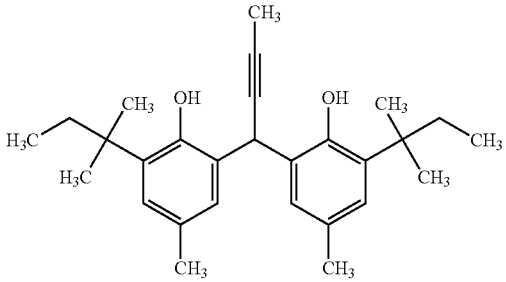

-continued
(1-42)
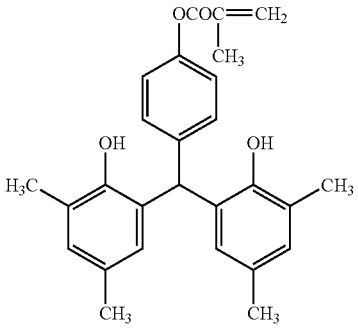
(1-43)
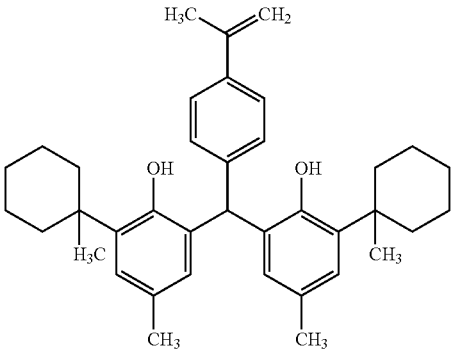
(1-44)
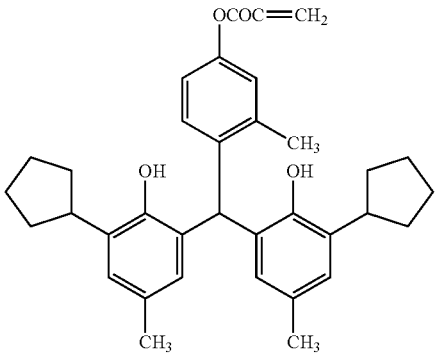
(1-45)
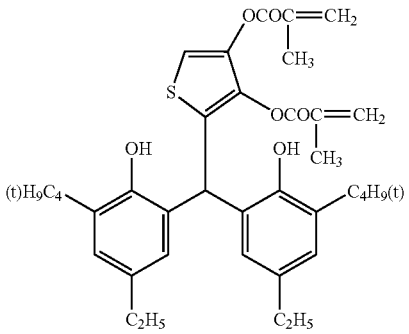
-continued
(1-46)
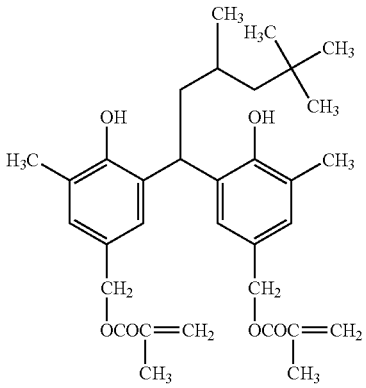
(1-47)
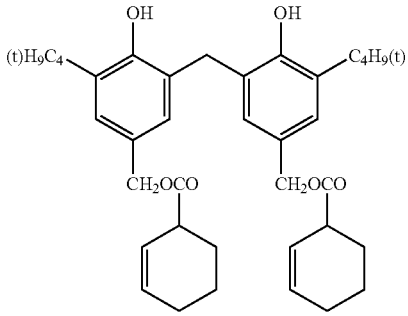
(1-48)
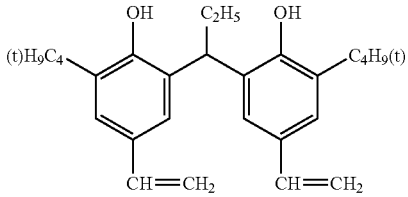
(1-49)
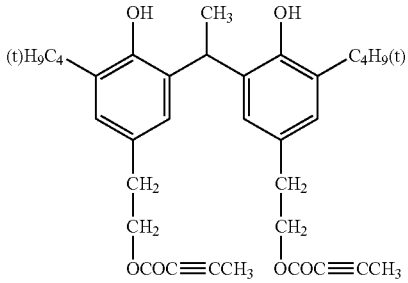
(1-50)
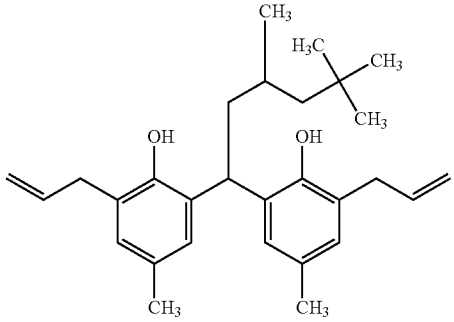

The compounds represented by the Formulas (A-1), (A-2) and (A-3) of the present invention can be easily synthesized by the methods well known in the art. The preferable synthesis scheme is displayed below by taking the case corresponding to the Formula (A-1) as an example.

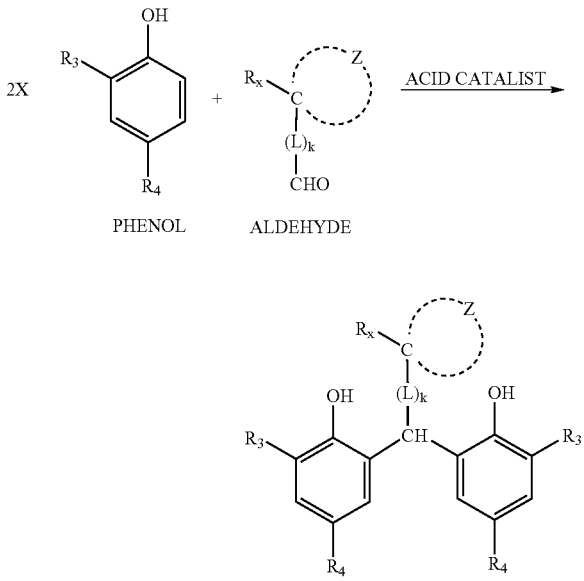

That is, the target compound corresponding to the Formula (A-1) can be obtained with a good yield by preferably dissolving or suspending two equivalents of phenol and one equivalent of aldehyde with no solvent or in an appropriate solvent, adding a catalytic amount of acid, and preferably reacting at the temperature of −20 to 120° C. for 0.5 to 60 hours. This is the same for the compounds represented by the Formula (A-2) or (A-3)

The organic solvents are preferably hydrocarbon type organic solvents, and specifically include benzene, toluene, xylene, dichloromethane, chloroform and the like. Preferably it is toluene. Furthermore, in terms of the yield, it is the most preferable to react with no solvent. As the acid catalysis, it is possible to any of inorganic and organic acids, but preferably used are concentrated hydrochloric acid, p-toluene sulfonate, and phosphoric acid. It is preferred that the catalysis is used at 0.001 to 1.5 equivalents based on the corresponding aldehyde. The reaction temperature is preferably around room temperature (15 to 25° C.), and the reaction time period is preferably from 3 to 20 hours.

The compounds represented by the Formula (A-4) of the invention (the synthetic schemes of 1-32 and 1-42 are described as the representatives) can be synthesized by the following methods.

SYNTHESIS OF (1-32)

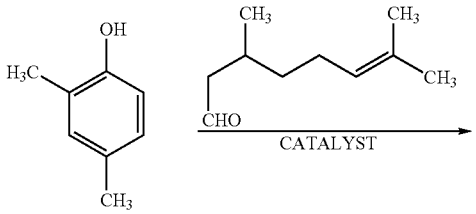

-continued

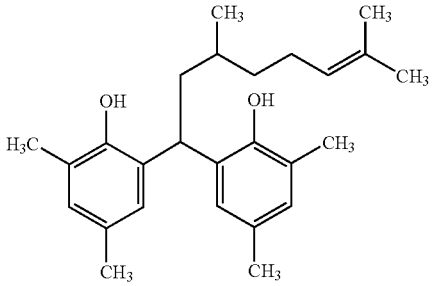

SYNTHESIS OF (1-42)

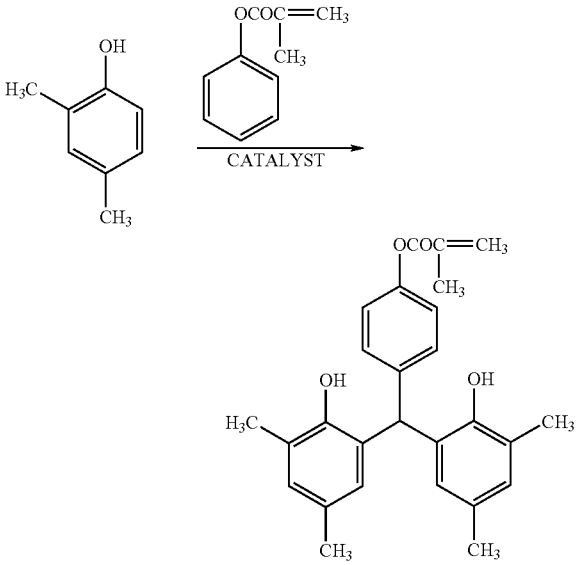

The compounds represented by the Formula (A-4) or (A-5) can be synthesized by reacting the phenol derivative and the aldehyde derivative in the solvent such as water, methanol, ethanol, acetonitrile, tetrahydrofuran, ethyl acetate, toluene and N,N-dimethylformamide using the catalysis such as hydrochloric acid, sulfuric acid and p-toluene sulfonate according the above scheme.

The reducing agents which the photothermographic imaging material contains are those which reduce the organic silver salt to form silver images. The reducing agents which can be combined with the reducing agent of the present invention are described in, for example, U.S. Pat. Nos. 3,770,448, 3,773,512, and 3,593,863, Research Disclosure (hereinafter, abbreviated as RD) 17029 and 29963, JP-A-11-119372 and JP-A-2002-62616.

The use amount of the reducing agent including the compounds represented by the Formulae (A-1) to (A-5) is preferably from $1\times10^{-2}$ to 10 mol, and especially preferably from $1\times10^{-2}$ to 1.5 mol per mol of the silver.

Binders suitable for the photothermographic imaging material of the invention are transparent or translucence, generally colorless, and include natural polymer synthetic resins, polymers, copolymers, and the other media which form film, for example, those described in [0069] of JP-A2001-330918. Among them, the binders preferable for the photosensitive layer of the photothermographic imaging material according to the invention are polyvinyl acetals, and the especially preferable binder is polyvinyl butyral. Details are described below. Further, for non-photosensitive layers such as a face coating layer and a base coating layer, especially a protection layer and a back coat layer, preferred are cellulose esters which are polymers with higher softening temperature, especially polymers such as triacetylcellulose and cellulose acetate butylate. The above binders can be used in combination of two or more if necessary. For the binder, it is preferable to use those at least one or more of polar group selected from —COOM, —$SO_3M$, —$OSO_3M$, —P═O$(OM)_2$, —O—P═$(OM)_2$ (M represents a hydrogen atom or an alkali metal base), —$N(R)_2$, —$N^+$ $(R_3)$ (R represents a hydrocarbon group), epoxy group, —SH, —CN and the like are introduced by copolymerization or addition reaction, and —$SO_3M$, and —$OSO_3M$ are especially preferable. The amount of such a polar group is from $10^{-1}$ to $10^{-8}$ mol/g, and preferably from $10^{-2}$ to $10^{-6}$ mol/g.

Such a binder is used in the effective range to function as the binder. The effective range can be easily determined by those skilled in the art. For example, as an index when at least retaining the organic silver salt at the image formation layer, a ratio of the binder to the organic silver salt is preferably from 15:1 to 1:2, and especially the range of 8:1 to 1:1 is preferable. That is, it is preferred that the amount of binder in the image formation layer is from 1.5 to 6 g/$m^2$. More preferably it is from 1.7 to 5 g/$m^2$. When it is less than 1.5 g/$m^2$, the density at an unexposed part is drastically increased and there are sometimes unusable cases.

A glass transition temperature Tg of the binder used in the invention is preferably 70° C. or above and 150° C. or below. Tg can be obtained by measuring with a differential thermometer, and an intersecting point of a baseline and a slope of an endothermic peak is rendered the glass transition temperature.

In the present invention, the glass transition temperature (Tg) is obtained by the method described in Brandwrap et al., "Polymer Handbook" III-139 to III-179 pages (1966, Willy and Sun Publisher).

When the binder is a copolymer resin, Tg is obtained by the following formula.

$$Tg\ (\text{copolymer})\ (^\circ\ \text{C.})=v_1Tg_1+v_2Tg_2+\ldots+v_nTg_n$$

The $v_1$, $v_2$ . . . $v_n$ represent a percentage by mass of a monomer in the copolymer, and $Tg_1$, $Tg_2$ . . . $Tg_n$ represent Tg (° C.) of a single polymer obtained from each monomer in the copolymer.

An accuracy of Tg calculated according to the above formula is ±5° C.

When using the binder with Tg of 70 to 105° C., the sufficient and maximum density can be obtained in the image formation, and thus it is preferable.

As the binder of the invention, Tg is from 70 to 105° C., the number average molecular weight is from 1,000 to 1,000,000, preferably from 10,000 to 500,000, and the polymerization degree is from about 50 to 1,000.

The polymers or copolymers comprising the ethylenic unsaturated monomer mentioned above as a component unit include those described in [0069] of JP-A-2001-330918.

Among them, the especially preferable examples include alkyl methacrylate esters, aryl methacrylate esters, styrenes and the like. In such polymer compounds, it is preferable to use the polymer compounds having acetal group. It is more preferable to be polyvinyl acetal having acetoacetal structure, and for example, it is possible to include polyvinyl acetal shown in U.S. Pat. Nos. 2,358,836, 3,003,879 and 2,828,204, and British Patent No. 771,155.

As the polymer compounds having the acetal group, especially preferred are the compounds represented by the following Formula (V).

(V)

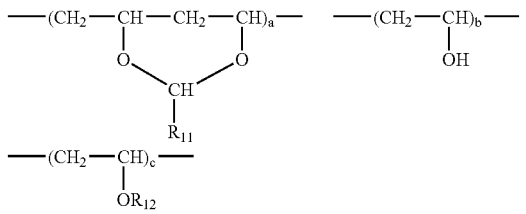

$R_{11}$ represents an unsubstituted alkyl, substituted alkyl, aryl or substituted aryl group, and is preferably a group other than aryl group. $R_{12}$ represents unsubstituted alkyl, substituted alkyl, unsubstituted aryl, substituted aryl group, —$COR_{13}$ or $ONHR_{13}$. $R_{13}$ is the same as defined $R_{11}$.

The unsubstituted alkyl groups represented by $R_{11}$, $R_{12}$ and $R_{13}$ are preferably those with 1 to 20 carbons, and more preferably those with 1 to 6 carbons. These may be linear or branched, and preferably linear alkyl groups are preferable. Such substituents include, for example, methyl, ethyl, n-propyl, isopropyl, n-butyl, isobutyl, t-butyl, n-amyl, t-amyl, n-hexyl, cyclohexyl, n-hepsyl, n-octyl, t-octyl, 2-ethylhexyl, n-nonyl, n-decyl, n-dodecyl, n-octadecyl and the like. Methyl or propyl group is especially preferable.

The unsubstituted aryl groups are preferably those with 6 to 20 carbons, and for example include phenyl, naphthyl groups and the like. The groups capable of being substituted to the above alkyl or aryl group include alkyl groups (e.g., methyl, n-propyl, t-amyl, t-octyl, n-nonyl, dodecyl groups, etc.), aryl groups (e.g., phenyl group, etc.), nitro, hydroxy, cyano, sulfo groups, alkoxy groups (e.g., methoxy group, etc.), aryloxy groups (e.g., phenoxy group, etc.), acyloxy groups (e.g., acetoxy group, etc.), acylamino groups (e.g., acetylamino group, etc.), sulfonamide groups (e.g., methanesulfonamide group, etc.), sulfamoyl groups (e.g., methylsulfamoyl group, etc.), halogen atoms (e.g., fluorine, chlorine, bromine atoms), carboxy, carbamoyl groups (e.g., methylcarbamoyl group, etc.), alkoxycarbonyl groups (e.g., methoxycarbonyl group, etc.), sulfonyl groups (e.g., methylsulfonyl group, etc.) and the like. When these substituents are two or more, they may be the same or different. The total carbon number of substituted alkyl group is preferably from 1 to 20, and the total carbon number of substituted aryl group is preferably from 6 to 20.

As $R_{12}$, preferred is —$COR_{13}$ ($R_{13}$ is an alkyl or aryl group) or —$CONR_{13}$ ($R_{13}$ is an aryl group). And, a, b and c is values showing the mass of respective repeat units by mol %, a is in the range of 40 to 86 mol %, b is in the range of 0 to 30 mol %, c is in the range of 0 to 60 mol %, which represent the numbers to be a+b+c=100 mol %. Especially preferably, a is in the range of 50 to 86 mol %, b is in the range of 5 to 25 mol %, and c is in the range of 0 to 40 mol %. Each repeat unit having each composition ratio of a, b and c may be made up of the same or different components.

The polymer compounds represented by the above Formula (V) can be synthesized by the general method for synthesis described in "Vinyl Acetate Resins" edited by Ichiro Sakurai (1962, Kobunshi Kagaku Kankokai).

As polyurethane resins which can be used in the invention, it is possible to use those known in the art where the structure is polyester polyurethane, polyether polyurethane, polyetherpolyester polyurethane, polycarbonate polyurethane, polyesterpolycarbonate polyurethane, polycaprolactone polyurethane and the like. Also, it is preferable to have at least one OH group at each end of polyurethane molecule and thus total two or more OH groups. Since OH groups form three dimensional network structure by crosslinking with polyisocyanate which is a hardening agent, it is more preferable to include more groups in the molecules. Especially, when OH groups are located at the molecular ends, the reactivity to the hardening agent is high, and thus it is preferable. Polyurethane has preferably 3 or more OH groups at the molecular ends, and it is especially preferable to have 4 or more. When polyurethane is used in the invention, it is preferred that the glass transition temperature is from 70 to 105° C., elongation after fracture is from 100 to 2000% and breaking stress for link chain is from 0.5 to 100 $N/mm^2$.

These polymer compounds (polymers) may be used alone or in blend of two or more. The above polymer is used as the main binder for the image formation layer of the invention. The main binder here is referred to a "state where the above polymer occupies 50% or more by mass of the total binders of the image formation layer". Therefore, the other polymers may be blended in the range of less than 50% by mass of the total binders. These polymers is not especially limited as long as they are solvents where the polymer of the invention is solubilized. More preferably included are polyvinyl acetate, polyacryl resins, urethane resins and like.

In the present invention, an organic gelling agent may be contained in the image formation layer. The organic gelling agent herein is referred to compounds such as polyvalent alcohols having a function which makes fluidity of the system disappear or lower by adding to an organic liquid to impart an yield value to the system.

In the present invention, it is also the preferable aspect that an coating solution for the image formation layer contains polymer latex in aqueous dispersion. In this case, it is preferred that 50% or more by mass of the total binders of the coating solution for the image formation layer is polymer latex in aqueous dispersion.

Further, when the image formation layer according to the invention contains polymer latex, it is preferred that 50% or more by mass of the total binders in the image formation layer is the polymer latex, and more preferably the polymer latex is 70% or more by mass.

"Polymer latex" according to the invention is one where water-insoluble hydriphobic polymer is dispersed in an aqueous dispersion medium as fine particles. The dispersion state may be any of one where the polymer is emulsified in the dispersion medium, emulsified and polymerized one, micelle dispersion, or one where hydriphilic structures are partially present in the molecule and molecular chains per se are in molecular dispersion.

The average particle diameter of the dispersed particles is preferably from 1 to 50000 nm, and more preferably in the range of about 5 to 1000 nm. The particle diameter distribution is not especially limited, and the particles may have a broad particle diameter distribution or a particle diameter distribution of monodisperse.

The polymer latex according to the invention may be so-called nucleus/shell type latex in addition to the polymer latex with common uniform structure. In this case, there are sometimes preferable cases when the glass transition temperature is different in the nucleus and the shell. A minimum film forming temperature (MFT) of the polymer latex according to the invention is preferably from −30 to 90° C., and more preferably from about 0 to 70° C. Also, a film forming aid may be added to control the minimum film forming temperature. The film forming aid used for the invention is also called a plasticizer, an organic compound (typically organic solvent) which reduces the minimum film forming temperature of the polymer latex, and for example, described in "Chemistry of Synthetic Latex (written by Soichi Muroi, published by Kobunshi Kanko, 1970)".

Polymer types used for the polymer latex are acryl, vinyl acetate, polyester, polyurethane, rubber type, vinyl chloride, vinyliden chloride and polyolefin resins, or copolymers thereof and the like. The polymers may be linear polymers, branched polymers or crosslinked polymers. Further, the polymers may be so-called homopolymers where a single monomer is polymerized or copolymers where two or more types of monomers are polymerized. The copolymers may be random copolymers or block copolymers. The molecular weight of the polymer is typically from 5000 to 1000000, and preferably from about 10000 to 100000 by number average molecular weight. When the molecular weight is too small, dynamic strength of the photosensitive layer is insufficient, and when it is too large, it is not preferable because film-making ability is poor.

The polymer latex with equilibrium water content of 0.01 to 2% or less by mass at 25° C. and 60% RH is preferable, and more preferable are those with 0.01 to 1% by mass. For the definition of and the method for measurement of the equilibrium water content, it is possible to refer to, for example, "Kobunshi Kogaku Koza 14, Kobunshi Zairyo Shikenho (edited by Society of Polymer Science, Japan, Chijinshokan).

Specific examples of the polymer latex include latex of methyl methacrylate/ethyl methacrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer, and the like.

These polymers may be used alone or in blend of two or more if necessary. As polymer types of the polymer latex, it is preferred that carboxylic acid ingredient such as acrylate or methacrylate ingredient is contained at about 0.1 to 10% by mass.

Furthermore, hydriphilic polymers such as gelatin, polyvinyl alcohol, methylcellulose, hydroxypropylcellulose, carboxymethylcellulose, and hydroxypropylmethylcellulose may be added in the range of 50% or less by mass based on total binders if necessary. It is preferred that the addition amount of these hydriphilic polymers is 30% or less by mass based on the total binders of the photosensitive layer.

In the preparation of the coating solution for the image formation layer according to the invention, concerning an order of the addition of the organic silver salt and the polymer latex in aqueous dispersion, either one may be added precedently, or they may be added simultaneously, but preferably the polymer latex is added later.

Furthermore, it is preferred that the organic silver salt and further the reducing agent have been mixed before the addition of the polymer latex. Further, in the present invention, after mixing the organic silver salt and the polymer latex, there is problematic in that when the temperature with time is too low, a coating face is impaired whereas when it is too high, the photographic fog is increased, and thus, it is preferred that the coating solution after mixing is retained at 35° C. to 65° C. for the following time period. Moreover, it is preferred to retain at 35° C. to 60° C., and especially, it is preferred to retain at 35° C. to 55° C. for time elapsing. To maintain such a temperature, a liquid preparation bath for the coating solution could be kept warm.

Concerning the coating of the coating solution for the image formation layer according to the invention, it is preferable to use the coating solution 30 min to 24 hours after mixing the organic silver salt and the polymer latex, more preferably the coating solution is left 60 min to 12 hours after the mixing, and it is especially preferable to use the coating solution 120 min to 10 hours after the mixing.

Here, "after mixing" is referred to subsequence of adding the organic silver salt and the polymer latex in aqueous dispersion and added materials being dispersed evenly.

In the present invention, it is well known that the use of a crosslinker for the above binder improves film adherence and reduces development unevenness, and there are also effects that the photographic fog in storage and the production of printout silver after the development are inhibited.

As the crosslinkers used in the invention, it is possible to use various crosslinkers conventionally used as photographic materials such as aldehyde, epoxy, ethyleneimine, vinylsulfone, sulfonate ester, acryloyl, carbodiimide, and silane type crosslinkers described in JP-A-50-96216, but preferred are isocyanate, silane, epoxy type compounds or acid anhydride shown below.

The above isocyanate type crosslinkers are isocyanates and addition bodies (adduct bodies) thereof having at least two isocyanate groups, and further specifically include aliphatic diisocyanates, aliphatic diisocyanates having cyclic groups, benzene diisocyanates, naphthalene diisocyanates, biphenyl isocyanates, diphenylmethane diisocyanates, triphenylmethane diisocyanates, triisocyanates, tetraisocyanates, addition bodies of these isocyanates and addition body of these isocyanates with bivalent or trivalent polyalcohol.

As specific examples, it is possible to utilize isocyanate compounds described in pages 10 to 12 of JP-56-5535.

Besides, the addition body of isocyanate and polyalcohol especially improves interlayer adhesiveness, and is high in ability to prevent occurrences of interlayer peeling, displacement of images and cells. Such isocyanate may be placed in any parts of photothermal photographic materials. For example, in a support (especially, when the support is paper, it can be contained in the size composition thereof), it can be added to any layer of the photosensitive layer side of the support such as the photosensitive layer, surface protection layer, intermediate layer, anti-halation layer and under coating layer, and can be added to one or two or more layers of these layers.

Further, as thioisocyanate type crosslinkers which can be used in the invention, useful are also the compounds having thioisocyanate structure corresponding to the above isocyanates.

The amount of the above crosslinker used in the invention is typically from 0.001 to 2 mol per mol of the silver, and preferably in the range of 0.005 to 0.5 mol per mol of the silver.

It is preferred that the isocyanate and thioisocyanate compounds which can be contained in the invention are the compounds having the function as the above crosslinker, but a good result is obtained by even the compound having only one of the functional group.

Examples of the silane compounds which can be used as the crosslinker in the invention include the compounds represented by the Formulae (1) to (3) disclosed in JP-A-2001-264930.

The epoxy compounds which can be used as the crosslinker in the invention could be those having one or more epoxy groups, and the number of epoxy groups, molecular weight and the others are not limited. It is preferred that epoxy group is contained in the molecule as glycidyl group via ether and imino bonds. Also, the epoxy compound may be any of monomer, oligomer and polymer, the number of epoxy groups present in the molecule is typically from about 1 to 10, and preferably from 2 to 4. When the epoxy compound is polymer, it may be either of homopolymer or copolymer, and the preferable range of the number average molecular weight thereof is from about 2000 to 20000.

Further, acid anhydride used for the invention is the compound having at least acid anhydride group represented by the following structure formula.

—CO—O—CO—

The acid anhydride used for the invention could be having one or more of such acid anhydride groups, and the number of acid anhydride groups, molecular weight and the others are not limited.

The above epoxy compounds and acid anhydride may be used alone or in combination of two or more. The addition amount thereof is not especially limited, but the range of $1\times10^{-6}$ to $1\times10^{-2}$ mol/m$^2$ is preferable, and the range of $1\times10^{-5}$ to $1\times10^{-3}$ mol/m$^2$ is more preferable.

In the present invention, the epoxy compound and acid anhydride can be added to any layer of the photosensitive layer side of the support such as the photosensitive layer, surface protection layer, intermediate layer, anti-halation layer and under coating layer, and can be added to one or two or more layers of these layers.

In the present invention, the use of a silver saving agent can further enhance the effects of the invention.

The silver saving agent used in the invention is referred to the compounds capable of reducing the silver amount required for obtaining the constant silver image density. Various action mechanisms for this reduction are thought, but preferred are the compounds having the function to enhance covering power of development silver. Here, the covering power of development silver is referred to optical density per unit amount of the silver.

As the silver saving agent, preferable examples include hydrazine derivative compounds represented by the following Formula (H), vinyl compounds represented by the following Formula (G), and quaternary onium compounds represented by the following Formula (P).

(H)

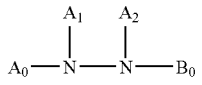

(G)

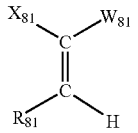

(P)

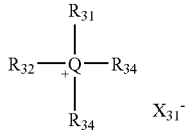

In the Formula (H), $A_0$ represents an aliphatic group, aromatic group, heterocyclic group or -$G_0$-$D_0$-group which may have substituents, respectively, $B_0$ represents a blocking group, $A_1$ and $A_2$ both represent hydrogen atoms or one represents a hydrogen atom and the other represents an acyl, sulfonyl or oxalyl group. Here, $G_0$ represents —CO—, —COCO—, —CS—, —C(=$NG_1D_1$)-, —SO—, —$SO_2$— or —P(O)($G_1D_1$) group, $G_1$ represents a simple bond, —O—, —S— or —N($D_1$) group, $D_1$ represents an aliphatic, aromatic, heterocyclic group or hydrogen atom, and when multiple $D_1$ are present in the molecule, they may be the same or different. $D_0$ represents a hydrogen atom, aliphatic, aromatic, heterocyclic, amino, alkoxy, aryloxy, alkylthio or arylthio group. Preferable $D_0$ includes hydrogen atom, alkyl, alkoxy and amino groups.

In the Formula (H), the aliphatic groups represented by $A_0$ are preferably those with 1 to 30 carbons, especially preferably linear, branched or cyclic alkyl groups with 1 to 20 carbons, and include, for example, methyl, ethyl, t-butyl, octyl, cyclohexyl, and benzyl groups. These may be further substituted with appropriate substituents (e.g., aryl, alkoxy, aryloxy, alkylthio, arylthio, sulfoxy, sulfonamide, sulfamoyl, acylamino, ureido groups, etc.)

In the Formula (H), the aromatic group represented by $A_0$ is preferably monocyclic or condensed cyclic aryl group, and for example, includes benzene or naphthalene ring. The heterocyclic group represented by $A_0$ is preferably monocyclic or condensed cyclic heterocyclic group containing at least one heteroatom selected from nitrogen, sulfur and oxygen atoms, and for example includes imidazole, tetrahydrofuran, morpholine, pyridine, pyrimidine, quinoline, thiazole, benzothiazole, thiophene, and furan rings. The aromatic and heterocyclic and -$G_0$-$D_0$ groups of $A_0$ may have substituents. As $A_0$, especially preferred are aryl group and -$G_0$-$D_0$ group.

Further, in the Formula (H), it is preferred that $A_0$ comprises at lease one of anti-diffusion group and silver halide absorption group. As the anti-diffusion group, preferred is ballast group usually used in additives for unmoving photographs such as coupler, and the ballast groups include alkyl, alkenyl, alkynyl, alkoxy, phenyl, phenoxy, alkylphenoxy groups and the like, which are photographically inert. It is preferred that total number of carbons at substituted moiety is 8 or more.

In the Formula (H), the silver halide absorption facilitating groups include thio urea, thiourethane, mercapto, thioether, thione, heterocyclic, thioamide heterocyclic, mercapto heterocyclic groups or absorption groups described in JP-A-64-90439.

In the Formula (H), $B_0$ represents a blocking group, and is preferably -$G_0$-$D_0$ group. $G_0$ represents —CO—, —COCO—, —CS—, —C(=$NG_1D_1$)-, —SO—, —$SO_2$— or —P(O)($G_1D_1$) group, and preferable $G_0$ includes —CO— and —COCO— groups. $G_1$ represents a simple bond, —O—, —S— or —N($D_1$) group, $D_1$ represents an aliphatic, aromatic, heterocyclic group or hydrogen atom, and when multiple $D_1$ are present in the molecule, they may be the same or different. $D_0$ represents a hydrogen atom, aliphatic, aromatic, heterocyclic, amino, alkoxy, aryloxy, alkylthio or arylthio group, and preferable $D_0$ includes hydrogen atom, alkyl, alkoxy and amino groups. $A_1$ and $A_2$ both represent hydrogen atoms, or one represents a hydrogen atom and the other represents an acyl group (acetyl, trifluoroacetyl, benzoyl, etc.), sulfonyl group (methanesulfonyl, toluene sulfonyl, etc.) or oxalyl group (ethoxalyl).

These compounds represented by the Formula (H) can be readily synthesized by the methods known in the art. For example, they can be synthesized in reference to U.S. Pat. Nos. 5,464,738 and 5,496,695.

The other hydrazine derivatives which can be preferably used are the compounds H-1 to H-29 described in columns 11 to 20 of U.S. Pat. No. 5,545,464 and the compounds 1 to 12 described in columns 9 to 11 of U.S. Pat. No. 5,464,738. These hydrazine derivatives can be synthesized by the methods known in the art.

In the Formula (G), $X_{81}$ and $R_{81}$ are represented in the form of cis, but the form where $X_{81}$ and $R_{81}$ are trans is included in the Formula (G). This is the same in the structure representation of the specific compounds.

In the Formula (G), $X_{81}$ represents an electron withdrawing group, and $W_{81}$ represents hydrogen atom, alkyl, alkenyl, alkynyl, aryl, hetero ring groups, halogen atom, acyl, thioacyl, oxalyl, oxyoxalyl, thiooxalyl, oxamoyl, oxycarbonyl, thiocarbonyl, carbamoyl, thiocarbamoyl, sulfonyl, sulfinyl, oxysulfinyl, thiosulfinyl, sulfamoyl, oxysulfinyl, thiosulfinyl, sulfamoyl, phosphoryl, nitro, imino, N-carbonylimino, N-sulfonylimino, dicyanoethylene, ammonium, sulfonium, phosphonium, pyrilium, and immonium groups.

$R_{81}$ represents halogen atom, hydroxyl, alkoxy, aryloxy, hetero ring oxy, alkenyloxy, acyloxy, alkoxycarbonyloxy, aminocarbonyloxy, mercapto, alkylthio, arylthio, hetero ring thio, alkenylthio, acylthio, alkoxycarbonyl thio, aminocarbonyl thio groups, organic or inorganic salt of hydroxyl or mercapto group (e.g., sodium, potassium, silver salts, etc.), amino, alkylamino, cyclic amino (e.g., pyrolidino), acylamino, oxycarbonylamino, hetero ring groups (nitrogen-containing 5 to 6-membered cyclic ring, e.g., benztriazolyl, imidazolyl, triazolyl, tetrazolyl, etc.), ureido and sulfonamide groups. $X_{81}$ and $W_{81}$, $X_{81}$ and $R_{81}$ may be bound one another to form a cyclic structure. Rings which $X_{81}$ and $W_{81}$ form include, for example, pyrazolone, pyrazolidinone, cyclopentanedione, β-ketolactone, β-ketolactam and the like.

Further describing for the Formula (G), the electron withdrawing group represented by $X_{81}$ is the substituent where a substituent constant σp can be a positive value. Specifically included are substituted alkyl groups (halogen substituted alkyl etc.), substituted alkenyl groups (cyanovinyl, etc.), substituted/unsubstituted alkynyl groups (trifluoromethylacetylenyl, cyanoacetylenyl, etc.), substituted aryl groups (cyanophenyl, etc.), substituted/unsubstituted hetero ring groups (pyridyl, triazyl, benzoxazolyl, etc.), halogen atoms, cyano group, acyl groups (acetyl, trifluoroacetyl, formyl, etc.), oxalyl groups (methyloxalyl, etc.), oxyoxalyl groups (ethoxalyl, etc.), thiooxalyl groups (ethylthiooxalyl, etc.), oxamoyl groups (methyloxamoyl, etc.), oxycarbonyl groups (ethoxycarbonyl, etc.), carboxyl groups, thiocarbonyl groups (ethylthiocarbonyl, etc.), carbamoyl, thiocarbamoyl, sulfonyl, sulfinyl groups, oxysulfonyl groups (ethoxysulfonyl, etc.), thio sulfonyl groups (ethylthiosulfonyl, etc.), sulfamoyl, oxysulfinyl groups (methoxysulfinyl, etc.), thiosulfinyl groups (methylthiosulfinyl, etc.), sulfinamoyl, phosphoryl, nitro, imino groups, N-carbonylimino groups (N-acetylimino, etc.), N-sulfonylimino groups (N-methanesulfonylimino, etc.), dicyanoethylene, ammonium, sulfonium, phosphonium, pyrilium and immonium, and comprised are hetero rings where ammonium, sulfonium, phosphonium and immonium form the ring. The substituents with the σp value of 0.30 or more are especially preferable.

The alkyl groups represented by $W_{81}$ include methyl, ethyl, trifluoromethyl and the like, the alkenyl groups include vinyl, halogen substituted vinyl, cyanovinyl, and the like, the alkynyl groups include acetylenyl, cyanoacetylenyl and the like, the aryl groups include nitrophenyl, cyanophenyl, pentafluorophenyl, and the like, and the hetero rings include pyridyl, pyrimidyl, triazyl, succinimide, tetrazolyl, triazolyl, imidazolyl, benzoxazolyl and the like. As $W_{81}$, the electron withdrawing group with positive σp value is preferable, and further the value is preferably 0.30 or more.

In the above substituents of $R_{81}$, preferably included are hydroxyl, mercapto, alkoxy, alkylthio groups, halogen atoms, organic or inorganic salt of hydroxyl or mercapto group, and hetero ring, more preferably included are hydroxyl, alkoxy, organic or inorganic salt of hydroxyl or mercapto group and hetero ring, and especially preferably included is organic or inorganic salt of hydroxyl or mercapto group. Hereinafter, the compound examples preferably used in the invention are shown.

A1

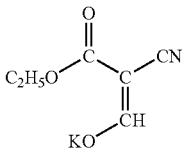

A2

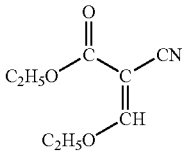

A3

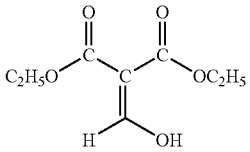

A4

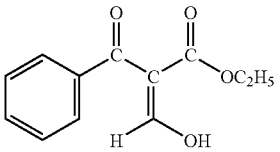

A5

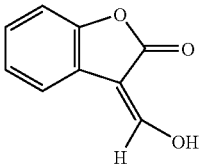

A6

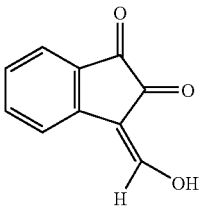

A7

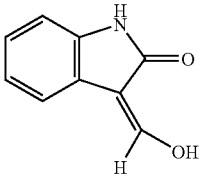

-continued

A8

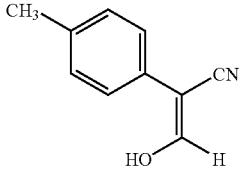

A9

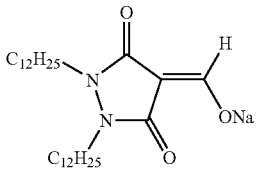

A10

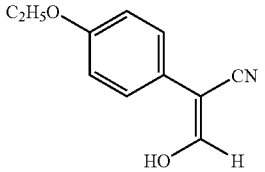

In the Formula (P), Q represents a nitrogen or phosphorus atom, $R_{31}$, $R_{32}$, $R_{33}$ and $R_{34}$ each represent hydrogen atoms or substituents, and $X_{31}^-$ represents anion. Besides, $R_{31}$ to $R_{34}$ may be linked one another to form a ring.

The substituents represented by $R_{31}$ to $R_{34}$ include alkyl groups (methyl, ethyl, propyl, butyl, hexyl, cyclohexyl, etc.), alkenyl groups (allyl, butenyl, etc.), alkynyl groups (propargyl, butynyl, etc.), aryl groups (phenyl, naphthyl, etc.), heterocyclic groups (piperidinyl, piperadinyl, morpholinyl, pyridyl, furyl, thienyl, tetrahydrofuryl, tetrahydrothienyl, sulfolanyl, etc.), amino groups and the like.

The rings which $R_{31}$ to $R_{34}$ can be linked one another to form include piperidine, morpholine, piperazine, quinuclidine, pyridine, pyrrole, imidazole, triazole, tetrazole rings and the like.

The groups represented by $R_{31}$ to $R_{34}$ may have substituents such as hydroxyl, alkoxy, aryloxy, carboxyl, sulfo, alkyl and aryl groups. $R_{31}$, $R_{32}$, $R_{33}$ and $R_{34}$ are preferably hydrogen atoms and alkyl groups.

Anions represented by $X_{31}^-$ include inorganic and organic anions such as halogen ion, sulfate ion, nitrate ion, acetate ion and p-toluene sulfonate ion.

The above quaternary onium compounds can be readily synthesized according to the methods known in the art, and for example, the above tetrazolium compounds can refer to the method described in Chemical Review, Vol. 55 page 335 to 483. The addition amount of the above silver saving agent is from $10^{-5}$ to 1 mol, and preferably in the range of $10^{-4}$ to $5\times10^{-1}$ mol per mol of the organic silver salt.

In the present invention, it is preferred that at least one type of the silver saving agent is the silane compound.

As the silane compounds used as the silver saving agent in the invention, preferred are alkoxy silane compounds or salts thereof having two or more primary or secondary amino groups as described in JP-2001-192698.

Here, having two or more primary or secondary amino groups indicates comprising two or more of only primary amino groups, two or more of only secondary amino groups, and further one or more of the primary and secondary amino groups, respectively. The salt of alkoxy silane compound indicate an addition compound of an organic or inorganic acid capable of forming onium salt with amino group and the alkoxy silane compound.

Such alkoxy silane compounds or salts thereof can include those described below, but in the invention, as long as it is the alkoxy silane compound or the salt thereof having two or more intramolecular primary or secondary amino groups, it is not limited to these compounds.

(10)-1

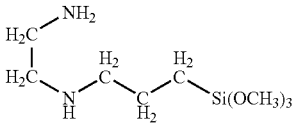

(10)-2

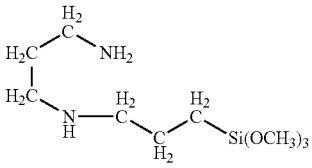

(10)-3

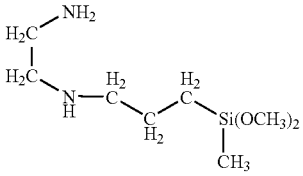

(10)-4

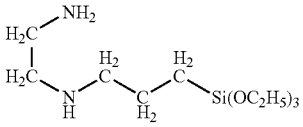

(10)-5

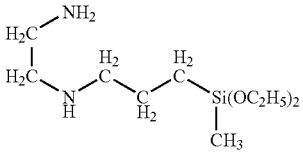

(10)-6

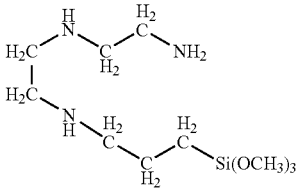

(10)-7

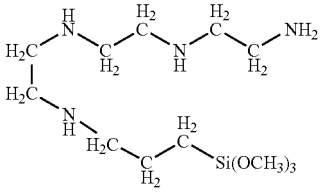

(10)-8

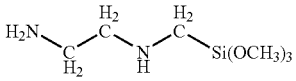

-continued (10)-9

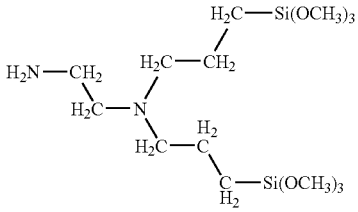

(10)-10

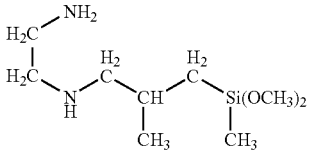

(10)-11

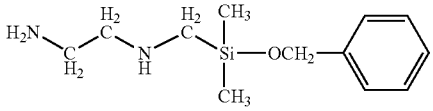

(10)-12

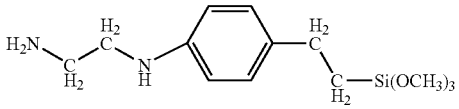

In these compounds, as the alkoxy group which forms alkoxy silane, the alkoxy group made up of saturated hydrocarbon is preferable, and further, methoxy, ethoxy and isopropoxy groups are preferable because of being more excellent in storage stability. Further, for the purpose of reducing sensitivity variation due to the storage condition before the thermal development, more preferable are the compounds having no unsaturated hydrocarbon in the molecule. Besides, these alkoxy silane compounds or the salts thereof may be used alone or in combination of two or more.

Further, it is preferred that the image formation layer contains Schiff base formed from dehydrated condensation reaction of the alkoxy silane compound having at least one or more primary amino group with the ketone compound.

The use of such Schiff base can save the amount of silver, and affords the images where the photographic fog is low, sensitivity variation is low and gamma does not extremely rise regardless the storage condition before the thermal development. Furthermore, since the primary amine moiety is precedently blocked, when a ketone type solvent is used in the preparation of an image formation layer forming coating liquid described below, it is possible to inhibit the sensitivity variation due to elapsed time after the preparation of the coating liquid.

The ketone compound used for forming Schiff base with the above alkoxy silane compound can be used with no special limitation, but in terms of an odor issue caused when the image is formed by an image formation method described below, those with boiling point of 150° C. or below are preferable, and further those with boiling point of 100° C. or below are more preferable.

Such a Schiff base can include the compounds shown below, but it is not limited thereto as long as it is the Schiff base formed from the dehydrated condensation reaction of alkoxy silane compound having one or more primary amino groups with the ketone compound.

In the above compounds, for the purpose further saving the silver amount, Schiff base having one or more secondary amino groups in the molecule is more preferable. These Schiff bases may be used alone or in combination of two or more.

When alkoxy silane compound or the salt thereof or Schiff base is added in the image formation layer as the silver saving agent, it is preferable to typically add at the range of 0.00001 to 0.05 mol based on 1 mol of the silver. Also when alkoxy silane compound or the salt thereof and Schiff base are added in the image formation layer, both are in the same range.

However, when the addition amount of the above alkoxy silane compound and Schiff base based on 1 mol of the silver slightly increases, there are some cases where the image density at the unexposed part formed by the image formation method described below becomes high. Thus, for the purpose of moderating dependency of the addition amount of alkoxy silane compound or Schiff base to be added based on 1 mol of the silver, it is preferable to further add isocyanate compound having two or more isocyanate groups into the molecule of the image formation layer. As isocyanate compound, it is possible to use the isocyanate compounds used as the crosslinker described above.

Described are a photographic fog inhibitor and an image stabilizer used for the photothermographic imaging material of the invention.

Since as the reducing agent, mainly used is the reducing agent such as bisphenols and sulfonamidephenols having proton, it is preferable to contain compounds capable of inactivating the reducing agent by producing active species capable of withdrawing these hydrogen atoms. Suitably, preferred is the compound as colorless photooxidation substance capable of producing free radicals as reaction active species at exposure.

Therefore, it may be any compound as long as it is the compound having these functions, but organic free radical made up of multiple atoms is preferable. It may be the compound having any structure as long as it is the compound having such functions and which cause no special adverse effect on the photothermographic imaging material.

Further, the compounds which produce these free radicals are preferably those having carbocyclic or heterocyclic aromatic groups in order to make produced free radicals have stability capable of contacting sufficiently to react with and inactivate the reducing agent.

Representatives of these compounds can include biimidazolyl compounds and iodonium compounds.

The addition amount of the above biimidazolyl compound or iodonium compound is from 0.001 to 0.1 mol/$m^2$, and preferably in the range of 0.005 to 0.5 mol/$m^2$. The compound can be contained in any component layer in the imaging material of the invention, but it is preferable to be contained in the vicinity of the reducing agent.

Hereinafter, described is polymer having halogen radical releasing group used in the invention. The halogen radical releasing group is the group which releases halogen radicals by heating or light radiation, and for example can be represented by the following Formula (13).

(13)

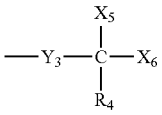

In the formula, $X_5$ and $X_6$ represent halogen atoms, and are fluorine, chlorine, bromine and iodine atoms, preferably chlorine, bromine and iodine atoms, more preferably chlorine and bromine atoms and especially preferably bromine atoms which may be the same or different.

$R_4$ represents a hydrogen atom, halogen atom or substituent, and the substituents include, for example, alkyl, aryl, cycloalkyl, alkenyl, cycloalkenyl, alkynyl, amino, acyl, acyloxy, acylamino, sulfonylamino, sulfamoyl, carbamoyl, alkylthio, sulfonyl, alkylsulfonyl, sulfinyl, cyano, hetero ring groups and the like. Preferably, it is a halogen atom, and especially preferably a bromine atom.

$Y_3$ represents a linkage group, and for example includes —$SO_2$—, —CO—, —NHCO—, —OCO—, N($R_5$)$SO_2$— and the like. $R_5$ represents a substituent. The substituents represented by $R_5$ include halogen atom, alkyl, cycloalkyl, alkenyl, cycloalkenyl, alkynyl, acyloxy, alkylthio, carboxyl, acylamino, acyl, trifluoromethyl groups and the like.

In the Formula (11), the halogen atoms represented by $X_1$ and $X_2$ are fluorine, chlorine, bromine and iodine atoms, preferably chlorine, bromine and iodine atoms, more preferably chlorine and bromine atoms and especially preferably bromine atoms, which may be the same or different one another.

$R_{10}$ represents a halogen atom, and is preferably a chlorine, bromine or iodine atom, more preferably a chlorine or bromine atom and especially preferably a bromine atom.

$Y_1$ represents a linkage group, and for example includes —$SO_2$—, —N($R_6$)CO—, and —OCO—, and $R_6$ represents a substituent. The substituents represented by $R_6$ can include the substituents of the $R_5$, and p represents an integer of 1 to 3.

$A_1$ represents alkylene, cycloalkylene, alkenylene or alkynylene group. These groups may further have substituents, and as the substituents, it is possible to use those described as the substituents on the ring in the Formula (A-1). Also when there are two or more substituents, they may be the same or different. But, they do not have aryl or heteroaryl group as a part of the substituent, and n represents 0 or 1.

$Z_1$ represents an ethylenic unsaturated group, ethyleneimino group or epoxy group, and the ethylenic unsaturated groups include methylene, propylene groups and the like. Preferably it is the ethylenic unsaturated group, and more preferably methylene group.

Hereinafter, specific examples of the compounds represented by the Formula (11) are shown, but the invention is not limited thereto.

11-1

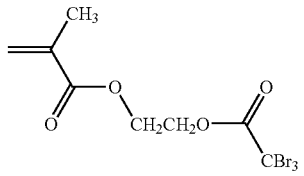

11-2

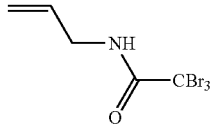

-continued
11-3
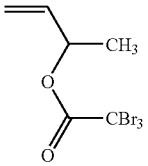
11-4
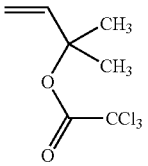
11-5
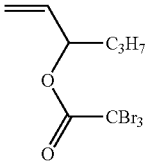
11-6
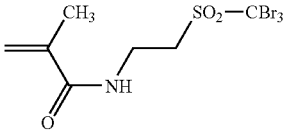
11-7
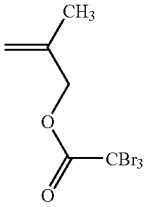
11-8
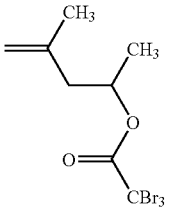
11-9
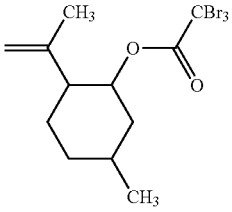
11-10
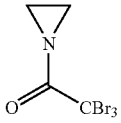
-continued
11-11
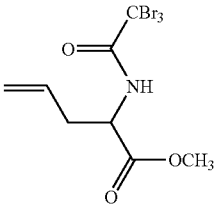
11-12
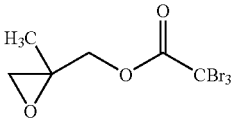
11-13
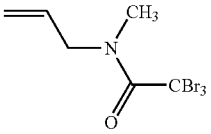
11-14
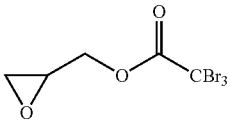
11-15
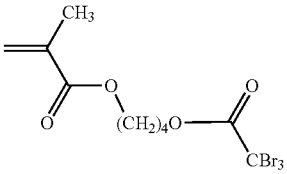
11-16
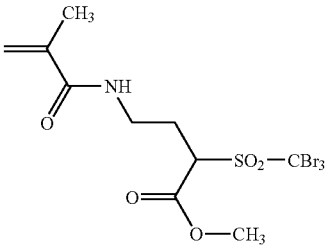
11-17
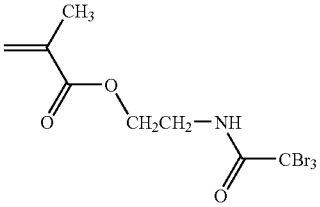
11-18
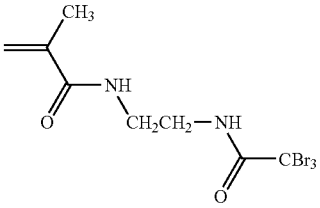

-continued 11-19

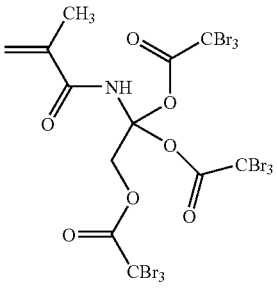

11-20

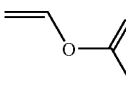

11-21

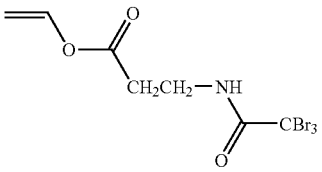

11-22

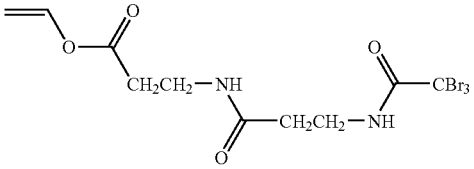

In the Formula (12), the halogen atoms represented by $X_3$ and $X_4$ are fluorine, chlorine, bromine and iodine atoms, preferably chlorine, bromine and iodine atoms, more preferably chlorine and bromine atoms, and especially preferably bromine atoms, which may be the same or different one another.

$R_{20}$ represents a halogen atom or substituent, and the substituents can include the substituents of the $R_4$.

$Y_2$ represents —N($R_{21}$)CO— or —OCO—, and $R_{21}$ represents a substituent. The substituents represented by $R_{21}$ can include the substituents of the $R_5$, and q represents an integer of 1 to 3.

$A_2$ represents an aromatic group or hetero ring group. The aromatic group is monocyclic or condensed cyclic aryl group with 6 to 30 carbons, preferably monocyclic or condensed cyclic aryl group with 6 to 20 carbons, and more preferably phenyl or naphthyl group. The hetero ring groups include, for example, pyridyl, pyrazinyl, pyrimidyl, benzothiazole, benzimidazole, thiadiazolyl, quinolyl, isoquinolyl groups and the like. These aromatic group and hetero ring groups may have substituents, and as the substituents, it is possible to use those described as the substituents on the ring in the Formula (A-1).

Further, when there are two or more substituents, they may be the same or different, and m represents 0 or 1.

$Z_2$ represents an ethylenic unsaturated group, ethyleneimino group or epoxy group, and the ethylenic unsaturated groups include, for example methylene, propylene groups and the like. Preferably it is the ethylenic unsaturated group, and more preferably methylene group.

Hereinafter, specific examples of the compounds represented by the Formula (12) are shown, but the invention is not limited thereto.

12-1

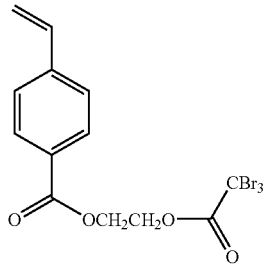

12-2

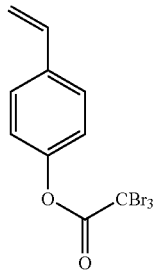

12-3

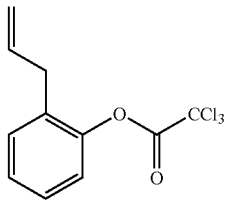

12-4

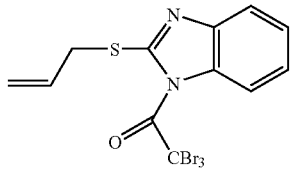

12-5

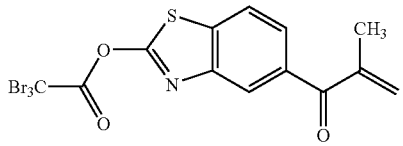

12-6

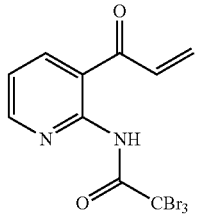

-continued 12-7

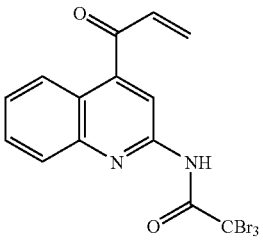

12-8

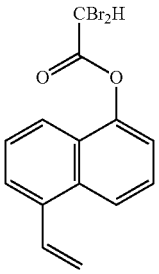

12-9

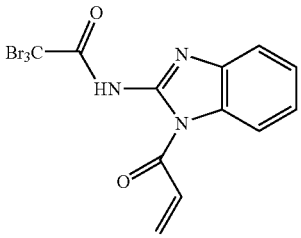

12-10

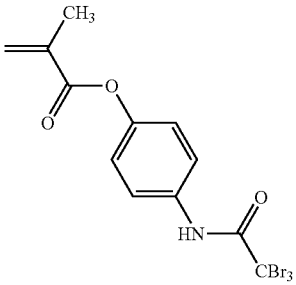

-continued 12-11

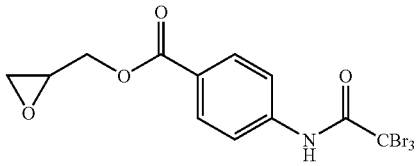

12-12

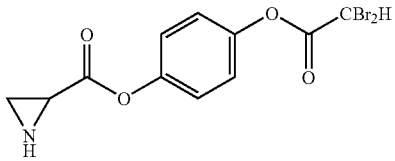

12-13

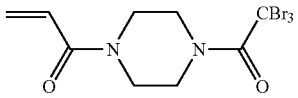

12-14

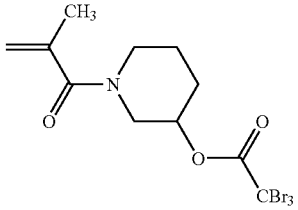

12-15

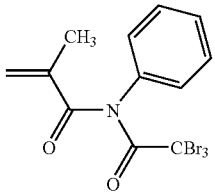

Next, included are specific examples of copolymerization polymer compounds having repeat units derived from the compounds represented by the Formula (11) or (12), but the invention is not limited thereto.

TABLE 1

| EXEMPLIFIED COMPOUND No. | MONOMER (a) OF FORMULA (11) OR (12) | COPOLYMERIZATION MONOMER (b) | CONTENT (MASS %) OF MONOMER UNIT (a) | NUMBER AVERAGE MOLECULAR WEIGHT |
|---|---|---|---|---|
| P-1 | 11-1 | — | 100 | 5000 |
| P-2 | 11-1 | B | 25 | 8000 |
| P-3 | 11-17 | — | 100 | 4000 |
| P-4 | 11-17 | E | 40 | 7000 |
| P-5 | 11-20 | SYNTHETIC EXAMPLE 4 | 21 | 15000 |
| P-6 | 11-20 | B | 34 | 10000 |
| P-7 | 11-20 | E | 48 | 8000 |
| P-8 | 12-2 | — | 100 | 3000 |
| P-9 | 12-2 | E | 63 | 6000 |
| P-10 | 12-8 | E | 42 | 11000 |
| P-11 | 12-8 | B | 13 | 50000 |
| P-12 | 12-10 | — | 100 | 5000 |
| P-13 | 12-10 | B | 35 | 4500 |

B: butyl acrylate
E: ethyl acrylate

Content of the monomer unit (a) represented in Table 1 is a value obtained from the following formula when an absorbance per mg at 254 nm of the compound represented by the Formula (11) or (12) is rendered absM, and an absorbance per mg at 254 nm is rendered absP of the polymer compound having the repeat unit derived from the monomer of the compound represented by the Formula (11) or (12).

$$\text{Content of monomer unit } (a) = absP/absM \times 100$$

The polymer compound having the repeat unit derived from the monomer of the compound represented by the Formula (11) or (12) used for the invention may be used alone or in combination of two or more.

Concerning the synthesis of the compounds having the ethylenic unsaturated group, the ethyleneimino group or the epoxy group and polymers thereof, for example, they can be readily synthesized by the use of the methods described in textbooks such as Shin Jikken Kagaku Koza (Maruzen). Hereinafter, shown are synthetic examples of the compounds represented by the Formula (11) or (12), and the polymer compounds having the repeat unit derived from the monomer thereof, but the invention is not limited thereto.

Synthetic Example 1. Synthesis of Example Compound 11-1

Triethylamine (5.8 g), dichloromethane (25 ml), and 2-hydroxyethyl of methacrylic acid (5.0 g) were sequentially mixed, and a solution where tribromoacetyl chloride (12.1 g) was dissolved in 10 ml of dichloromethane was dripped thereto under ice cooling. After dripping and then stirring at room temperature for 3 hours, 100 ml of ethyl acetate was added, and an organic layer was washed with 50 ml of 1N hydrochloric acid, 50 ml of an aqueous solution of saturated sodium hydrogen carbonate and 50 ml of saturated brine in order. After drying on magnesium sulfate, filtration and subsequent concentration under reduced pressure yielded crude crystal. Recrystallization with ethanol yielded the target 11-1 (11.0 g)

Synthetic Example 2. Synthesis of Example Compound 12-2

Triethylamine (6.3 g), dichloromethane (25 ml), and 4-vinylphenol (5.0 g) were sequentially mixed, and a solution where tribromoacetyl chloride (14.4 g) was dissolved in 10 ml of dichloromethane was dripped thereto under ice cooling. After dripping and then stirring at room temperature for 3 hours, 100 ml of ethyl acetate was added, and an organic layer was washed with 50 ml of 1N hydrochloric acid, 50 ml of an aqueous solution of saturated sodium hydrogen carbonate and 50 ml of saturated brine in order. After drying on magnesium sulfate, filtration and subsequent concentration under reduced pressure yielded crude crystal. Recrystallization with ethanol yielded the target 12.2 (13.2 g).

Synthetic Example 3. Synthesis of Homopolymer Having Repeat Unit of Example Compound 11-1

Under a nitrogen atmosphere, 10 g of the example compound 11-1, 80 g of dehydrated tetrahydrofuran and 0.3 g of boron trifluoride-diethyl ether complex were sequentially mixed, and refluxed with heating for 10 hours. After cooling, concentration under reduced pressure was carried out, residue was dissolved in tetrahydrofuran, and purification with reprecipitation using methanol was carried out to yield 5 g of homopolymer with number average molecular weight of 5000.

Synthetic Example 4. Synthesis of Copolymer having at Least One Repeat Unit of Example Compound 11-20

Decane butyral (10 g)(#2000-L, polymerization degree about 300), 300 ml of toluene and 2.5 g of pyridine were sequentially mixed, and under ice cooling, a solution where 18 g of tribromoacetyl chloride was dissolved in 20 ml of toluene was dripped thereto. After dripping and then stirring at room temperature for 3 hours, 500 ml of ethyl acetate was added, and an organic layer was washed with 50 ml of 1N hydrochloric acid, 50 ml of an aqueous solution of saturated sodium hydrogen carbonate and 50 ml of saturated brine in order. After drying on magnesium sulfate, filtration and subsequent concentration under reduced pressure were carried out. Residue was dissolved in methylethylketone, and purification with reprecipitation using hexane was carried out to yield 19 g of copolymer with number average molecular weight of 20000. By measuring an absorbance of the copolymer at 254 nm, it was confirmed that the content of vinyl tribromoacetate unit was 21% (% by mass).

The polymer compound having the repeat unit derived from the monomer of the compound represented by the Formula (11) or (12) can be added to the photosensitive layer comprising silver halide emulsion or the non-photosensitive layer, but it is preferable to add to the layer adjacent to the photosensitive layer and/or the non-photosensitive layer. Further, when the polymer compound having the repeat unit derived from the monomer of the compound represented by the Formula (11) or (12) is added to the imaging material, the addition amount thereof is not especially limited, but is from about $10^{-4}$ to 1.0 mol per mol of silver halide, and in particular is preferably in the range of $10^{-3}$ to 0.3 mol per mol of silver halide as the monomer unit (a).

The polymer compound having the repeat unit derived from the monomer of the compound represented by the Formula (11) or (12) according to the invention can be used by dissolving in an appropriate organic solvent, for example, alcohols (methanol, ethanol, propanol, fluorinated alcohol), ketones (acetone, methylethylketone), dimethylformamide, dimethylsulfoxide, methyl cellosolve and the like. Also, it can be incorporated by an emulsified dispersion method already well known. For example, it can be dissolved in the organic solvent with high boiling point such as dibutyl phthalate, tricresil phosphate, glyceryl triacetate, or diethyl phthalate, and cosolvent such as ethyl acetate or cyclohexane, mechanically emulsified to make an emulsified dispersion, and added to the desired component layer.

Further, by the method known as a solid dispersion method, for example, the polymer compound having the repeat unit derived from the monomer of the compound represented by the Formula (11) or (12) can be made into aqueous particulate dispersion using dispersion means such as a ball mill, colloid mill or ultrasonic dispersion machine, and added optionally.

Next, described is the polymer having at least one repeat unit of the Formula (15) in polyvinyl butyral.

In the Formula (15), $X_9$ and $X_{10}$ represent halogen atoms, and are fluorine, chlorine, bromine and iodine atoms, preferably chlorine, bromine and iodine atoms, more preferably chlorine and bromine atoms and especially preferably bromine atoms, which may be the same or different.

$R_8$ represents a hydrogen atom, a halogen atom or a substituent, and the substituents include those which are the same as defined substituents represented by $R_4$ in the Formula (13).

$L_2$ represents a bivalent linkage group, the linkage groups include —CO—, —$SO_2$—, and the like, further $L_2$ may form the linkage group by binding to a group selected from —S—, NH—, —CO—, and —O— via an alkyl group, and r represents an integer of 1 or more.

Hereinafter, shown are specific examples of the polymer compounds having at least one repeat unit of the Formula (15) in polyvinyl butyral, but the invention is not limited thereto.

15-1

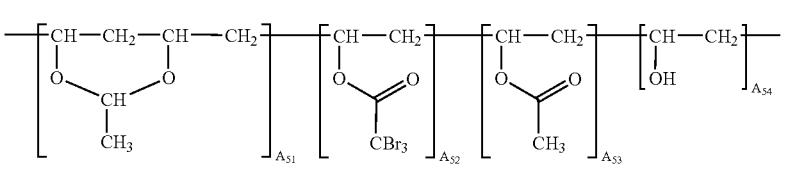

NUMBER AVERAGE MOLECULAR WEIGHT 20000
COMPOSITION (MASS %) $A_{51}$:$A_{52}$:$A_{53}$:$A_{54}$ = 70:22:2:6

15-2

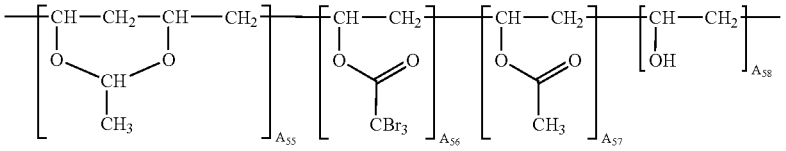

NUMBER AVERAGE MOLECULAR WEIGHT 60000
COMPOSITION (MASS %) $A_{55}$:$A_{56}$:$A_{57}$:$A_{58}$ = 65:29:0:5:5.5

15-3

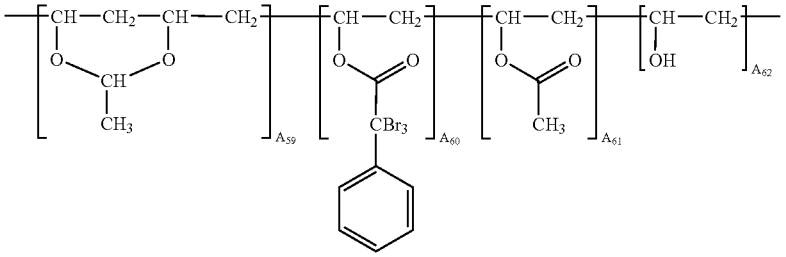

NUMBER AVERAGE MOLECULAR WEIGHT 30000
COMPOSITION (MASS %) $A_{59}$:$A_{60}$:$A_{61}$:$A_{62}$ = 52:40:4:4

15-4

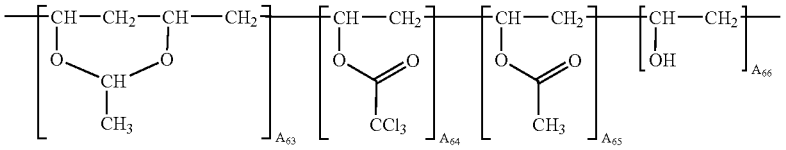

NUMBER AVERAGE MOLECULAR WEIGHT 30000
COMPOSITION (MASS %) $A_{63}$:$A_{64}$:$A_{65}$:$A_{66}$ = 57:39:2:2

15-5

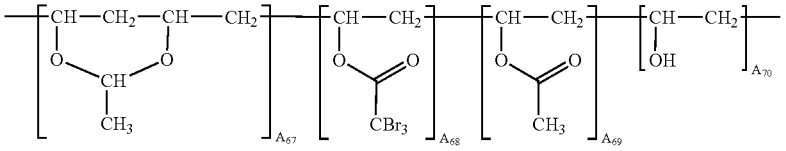

NUMBER AVERAGE MOLECULAR WEIGHT 100000
COMPOSITION (MASS %) $A_{67}$:$A_{68}$:$A_{69}$:$A_{70}$ = 60:33:2:5

15-6

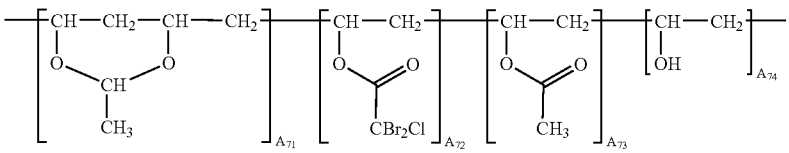

NUMBER AVERAGE MOLECULAR WEIGHT 25000
COMPOSITION (MASS %) $A_{71}$:$A_{72}$:$A_{73}$:$A_{74}$ = 80:12:2:6

-continued 15-7

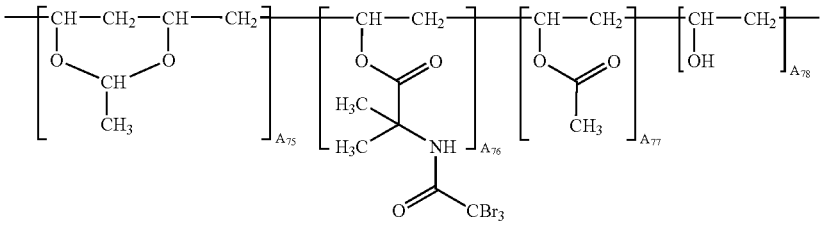

NUMBER AVERAGE MOLECULAR WEIGHT 20000
COMPOSITION (MASS %) $A_{75}:A_{76}:A_{77}:A_{78}$ = 78:21:2:6

15-8

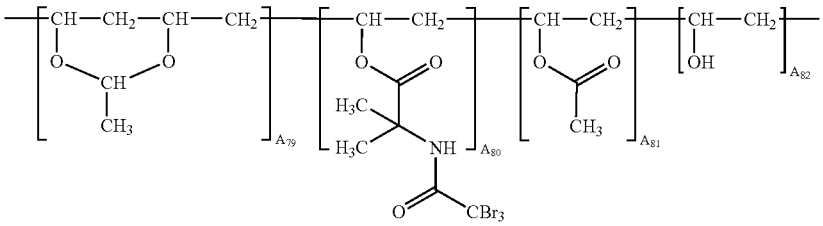

NUMBER AVERAGE MOLECULAR WEIGHT 60000
COMPOSITION (MASS %) $A_{79}:A_{80}:A_{81}:A_{82}$ = 70:25:1:4

15-9

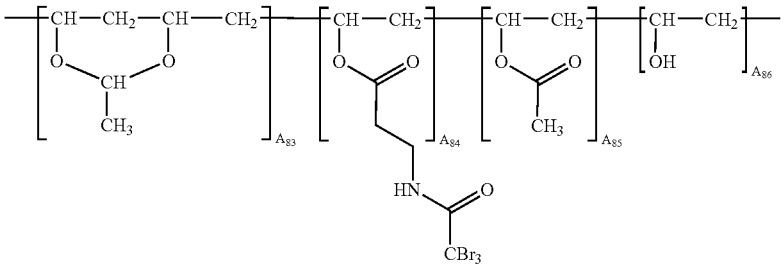

NUMBER AVERAGE MOLECULAR WEIGHT 100000
COMPOSITION (MASS %) $A_{83}:A_{84}:A_{85}:A_{86}$ = 76:23:0:5:0:5

15-10

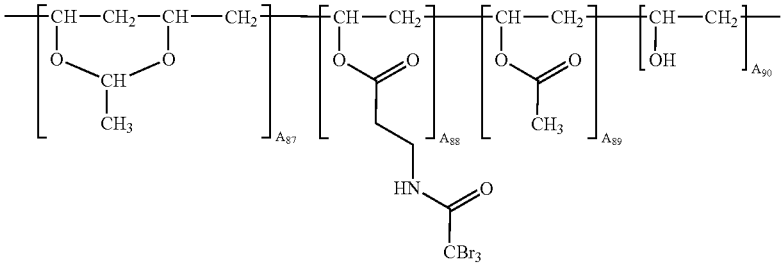

NUMBER AVERAGE MOLECULAR WEIGHT 27000
COMPOSITION (MASS %) $A_{87}:A_{88}:A_{89}:A_{90}$ = 71:20:3:6

Synthetic Example 5. Synthesis of Example Compound 15-1

Decane butyral (10 g) (#2000-L, polymerization degree about 300), 300 ml of toluene and 2.5 g of pyridine were sequentially mixed, and under ice cooling, a solution where 18 g of tribromoacetyl chloride was dissolved in 20 ml of toluene was dripped thereto. After dripping and then stirring at room temperature for 3 hours, 500 ml of ethyl acetate was added, and an organic layer was washed with 50 ml of 1N hydrochloric acid, 50 ml of an aqueous solution of saturated sodium hydrogen carbonate and 50 ml of saturated brine in order. After drying on magnesium sulfate, filtration and subsequent concentration under reduced pressure were carried out. Residue was dissolved in methylethylketone, and purification with reprecipitation using hexane was carried out to yield 19 g of copolymer with number average molecular weight of 20000. By measuring an absorbance of the copolymer at 254 nm, it was confirmed that the content of vinyl tribromoacetate unit was 22% (% by mass).

The polymer compounds having at least one repeat unit of the Formula (15) in polyvinyl butyral can be added to the photosensitive layer comprising silver halide emulsion or the non-photosensitive layer, but it is preferable to add to the layer adjacent to the photosensitive layer and/or the non-photosensitive layer. Further, when the polymer compounds having at least one repeat unit of the Formula (15) in polyvinyl butyral is added to the imaging material, the addition amount thereof is not especially limited, but is from about $10^{-4}$ to 1.0 mol per mol of silver halide, and in particular is preferably in the range of $10^{-3}$ to 0.3 mol per mol of silver halide as the monomer unit (a).

The polymer compounds having at least one repeat unit of the Formula (15) in polyvinyl butyral according to the invention can be used by dissolving in an appropriate organic solvent, for example, alcohols (methanol, ethanol, propanol, fluorinated alcohol), ketones (acetone, methylethylketone), dimethylformamide, dimethylsulfoxide, methyl cellosolve and the like. Also, it can be incorporated by an emulsified dispersion method already well known. For example, it can be dissolved in the organic solvent with high boiling point such as dibutyl phthalate, tricresil phosphate, glyceryl triacetate, or diethyl phthalate, and cosolvent such as ethyl acetate or cyclohexane, mechanically emulsified to make an emulsified dispersion, and added to the desired component layer.

Further, by the method known as a solid dispersion method, for example, the polymer compounds having at least one repeat unit of the Formula (15) in polyvinyl butyral can be made into aqueous particulate dispersion using dispersion means such as a ball mill, colloid mill or ultrasonic dispersion machine, and added optionally.

The number average molecular weight (Mn) of the polymer represented by the Formula (11), (12), or (15) used in the invention is preferably 2000 or more and 150000 or less, and more preferably 3000 or more and 100000 or less.

Further, in the present invention, the good results are obtained by combining the compound capable of releasing halogen atoms as active species in addition to the above compounds.

Specific examples of these compounds which produce active halogen atoms can include the organic polyhalogen compounds described in [0083] to [0088] of JP-A-2002-169249.

Next, described is a photographic fog inhibitor preferably used in the invention. The photographic fog inhibitors preferably used in the invention can include, for example, the compounds a to j described in [0012] of JP-A-8-314059, thiosulfonate esters A to K described in [0028] of JP-A-7-209797, the compound examples (1) to (44) described in from page 14 of JP-A-55-140833, the compounds (I-1) to (I-6) described in [0063] and (C-1) to (C-3) in [0066] of JP-A-2001-13627, the compounds (III-1) to (III-108) described in [0027] of JP-A-2002-90937, the compounds VS-1 to VS-7, the compounds HS-1 to HS-5 described in [0013] of JP-A-6-208192 as the compounds of vinylsulfones and/or β-halosulfones, the compounds KS-1 to KS-8 described in JP-A-2000-330235 as sulfonylbenzotriazole compounds, and the compounds PR-01 to PR-08 described in JP-T-2000-515995 as propenenitrile compounds.

The above photographic fog inhibitor is generally used at the amount of at least 0.001 mol per mol of the silver. Typically, the range thereof is from 0.01 to 5 mol per mol of the silver, and preferably from 0.02 to 0.6 mol per mol of the silver.

In addition to the above compounds, the compound conventionally known as the photographic fog inhibitor may be comprised in the photothermographic imaging material of the invention, and may be the compound capable of producing the same reaction active species as the above compounds or may be the compound with different inhibition mechanism. For example, included are the compounds described in U.S. Pat. Nos. 3,589,903, 4,546,075, 4,452,885, JP-A-59-57234, U.S. Pat. Nos. 3,874,946, 4,756,999, JP-A-9-288328, and JP-A-9-90550. Additionally, the other photographic fog inhibitors include the compounds disclosed in U.S. Pat. No. 5,028,523, EP Nos. 600,587, 605,981, and 631,176.

When the reducing agent used for the invention has aromatic hydroxy group (—OH), especially in the case of bisphenols, it is preferable to combine a non-reducing compound having a group capable of forming hydrogen bond with these groups.

In the present invention, especially preferable specific examples of hydrogen bonding compounds include the compounds (II-1) to (II-40) described in [0061] to [0064] of JP-A-2002-90937.

The photothermographic imaging materials of the invention are those where photographic images are formed by thermal development, and it is preferred that a toning agent which regulates color tone of the silver if necessary is usually contained in (organic) binder matrix at the dispersed state.

The suitable toning agents used for the invention are disclosed in RD 17029, U.S. Pat. Nos. 4,123,282, 3,994,732, 3,846,136 and 4,021,249, and for example, include the followings.

Included are imides (e.g., succinimide, phthalimide, naphthalimide, N-hydroxy-1,8-naphthalimide); mercaptans (e.g., 3-mercapto-1,2,4-triazole); phthalazine derivatives or metallic salts of these derivatives (e.g., phthalazine, 4-(1-naphthyl) phthalazine, 6-chlorophthalazine, 5,7-dimethyloxyphthalazine and 2,3-dihydro-1,4-phthalazione); the combination of phthalazine and phthalic acid (e.g., phthalic acid, 4-methylphthalic acid, 4-nitrophthalic acid and tetrachlorophthalic acid); and the combination of phthalazine, maleic acid anhydride and at least one compound selected from phthalic acid, 2,3-naphthalene dicarboxylate or o-phenylenic acid derivatives and anhydrides thereof (e.g., phthalic acid, 4-methylphthalic acid, 4-nitrophthalic acid and tetrachlorophthalic acid anhydride). Especially preferable toning agents are phthalazine or the combination of phthalazine with phthalic acid, phthalic acid anhydride.

Besides, concerning the color tone of output images for medical diagnosis, conventionally it has been said that diagnosis and observation results with exact recording images are obtained for readers of Roentgen pictures more easily on an image tone with cool tone. Here, the image tone with cool tone is referred to blue black tone where pure black tones or black images are tinged with blue whereas the image tone with warm tone is referred to warm black tone where the black images are tinged with brown.

The terms for the color tone, "cooler tone" and "warmer tone" are obtained from hue angle $h_{ab}$ at the minimum density Dmin and an optical density=1.0. The hue angle $h_{ab}$ is obtained by the following formula using color coordinates a*, b* of color space L*a*b* which is the color space having perceptually nearly uniform paces and is recommended by International Commission on Illumination (CIE, Commission Internationale de l'Eclairage(CIE)") in 1976.

$$h_{ab}=\tan^{-1}(b^*/a^*)$$

In the present invention, when used as medical images, the range of preferable $h_{ab}$ is $180°<h_{ab}<270°$, more preferably $200°<h_{ab}<270°$, and most preferably $220°<h_{ab}<260°$.

In the present invention, in order to improve film transport property and environmental aptitude (accumulation in vivo) in a thermal development apparatus, fluorochemical surfactants represented by the Formula (A-8) are used.

In the Formula (A-8), Rf represents a fluorine atom-containing substituent, and the fluorine atom-containing substituents include, for example, alkyl groups with 1 to 25 carbons (e.g., methyl, ethyl, butyl, octyl, dodecyl and octadecyl groups, etc.), or alkenyl groups (e.g., propenyl, butenyl, nonenyl and dodecenyl groups, etc.).

$L_1$ represents a bivalent linkage group containing no fluorine atom, and the bivalent linkage groups containing no fluorine atom include, for example, alkylene groups (e.g., methylene, ethylene, butylene groups, etc.), alkyleneoxy groups (methyleneoxy, ethyleneoxy, butyleneoxy groups, etc.), oxyalkylene groups (e.g., oxymethylene, oxyethylene, oxybutylene groups, etc.), oxyalkyleneoxy groups (e.g., oxymethyleneoxy, oxyethyleneoxy, oxyethyleneoxyethyleneoxy groups, etc.), phenylene, oxyphenylene, phenyloxy, oxyphenyloxy groups or the combination thereof.

A represents an anion group or a salt group thereof, and for example, includes carboxylic acid group or the salt group thereof (sodium, potassium and lithium salts), sulfonic acid group or the salt group thereof (sodium, potassium and lithium salts), and phosphoric acid group or the salt group thereof (sodium, and potassium salts).

Y represents a bivalent to tetravalent linkage group having no fluorine atom, and for example, includes atomic groups which are bivalent to tetravalent linkage group having no fluorine atom and made up of mainly carbon and nitrogen atoms, and n1 and m1 represent integers of 0 or 1, and preferably 1.

The fluorochemical surfactants represented by the Formula (A-8) can be obtained by further introducing the anion group (A) for example by sulfate esterification to the compound (alkanol compound with partial Rf) obtained by the addition reaction or the condensation reaction of a fluorine atom-introducing alkyl compound (e.g., the compounds having trifluoromethyl, pentafluoroethyl, perfluorobutyl, perfluorooctyl and perfluorooctadecyl groups) and an alkenyl compound (e.g., perfluorohexenyl and perfluorononenyl groups) with 1 to 25 carbons, with a trivalent to hexavalent alkanol compound introducing no fluorine atom, an aromatic compound or a hetero compound having 3 to 4 hydroxy groups introducing no fluorine atom.

The above trivalent to hexavalent alkanol compound includes glycerine, pentaerythritol, 2-methyl-2-hydroxymethyl-1,3-propanediol, 2,4-dihydroxy-3-hydroxymethylpentene, 1,2,6-hexanetriol, 1,1,1-tris(hydroxymethyl)propane, 2,2-bis(butanol)-3, aliphatic triol, tetramethylolmethane, D-sorbitol, xylitol, D-mannitol and the like.

Further, the aromatic compound and hetero compound with the above 3 to 4 hydroxy groups include 1,3,5-trihydroxybenzene and 2,4,6-trihydroxypyridine.

Hereinafter, shown are preferable specific examples of the fluorochemical surfactants represented by the Formula (A-8).

SF-1

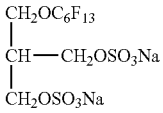

-continued

SF-2

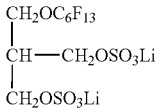

SF-3

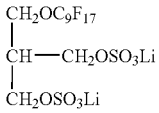

SF-4

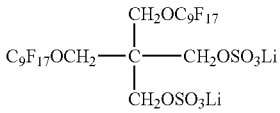

SF-5

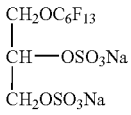

SF-6

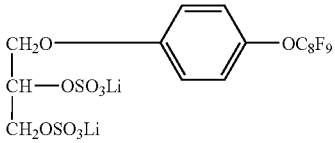

SF-7

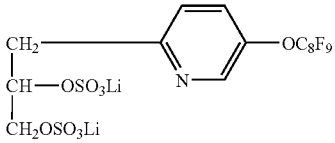

SF-8

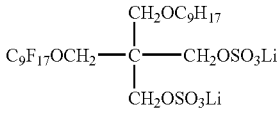

SF-9

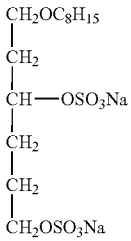

SF-10

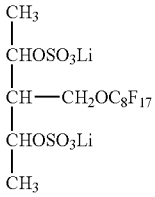

SF-11

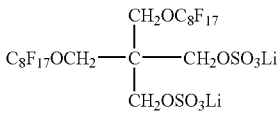

-continued

SF-12

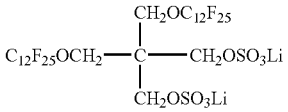

SF-13

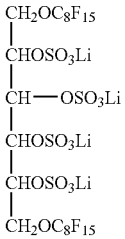

SF-14

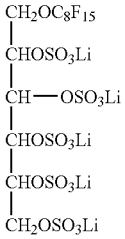

SF-15

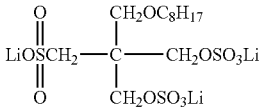

SF-16

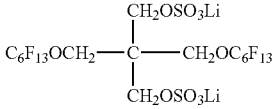

SF-17

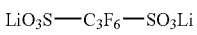

SF-18

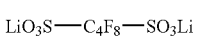

The fluorochemical surfactants represented by the Formula (A-8) of the invention can added to the coating solution according to the methods known in the art. That is, it can be added by dissolving in polar solvents such as alcohols such as methanol and ethanol, ketones such as methylethylketone and acetone, methylsulfoxide, and dimethylformamide. Further, it can be added by making into fine particles of 1 μm or less and dispersing in water or the organic solvent by sand mill dispersion, jet mill dispersion, ultrasonic dispersion and homogenizer dispersion. Numerous technologies are disclosed for fine particle dispersion technology, and the dispersion can be carried out according to these technologies. It is preferred that the fluorochemical surfactant represented by the Formula (A-8) is added to the protection layer of the outermost layer.

The addition amount of the fluorochemical surfactant represented by the Formula (A-8) of the invention is preferably from $1\times10^{-8}$ to $1\times10^{-1}$ mol per $m^2$, and especially preferably from $1\times10^{-5}$ to $1\times10^{-2}$ mol per $m^2$. When it is less than the former range, electrostatic property is not obtained whereas when it is over the former range, temperature dependency is high and storage stability under high temperature is deteriorated.

In the photothermographic imaging material of the invention, it is preferred that Lb/Le is 1.5 or more and 10 or less when the average particle diameter of matting agents comprised in an outermost face at the side having the image formation layer is made Le (μm), and that comprised in an outermost face at the side having the back coat layer is made Lb (μm). Density unevenness at thermal development can be improved by making Lb/Le this range.

In the present invention, it is preferred that organic or inorganic powder is used as the matting agent in the outer layer of the photothermographic imaging material (side of the image formation layer, also when non-photosensitive layer is installed at an opposite side of the image formation layer with interleaving the support) to control the object of the invention and surface roughness. As the powder used in the invention, it is preferable to use the powder with Mohs hardness of 5 or more. As the powder, it is possible to use by appropriately selecting inorganic or organic powders known in the art. The inorganic powders can include, for example, titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, cerium oxide, corundum, artificial diamond, pomegranate stone, garnet, mica, silica stone, silicon nitride, silicon carbide and the like. The organic powders can include, for example, powders of polymethylmethacrylate, polystyrene, teflon and the like. In these, preferred are the inorganic powders such as $SiO_2$, titanium oxide, $\alpha$-$Al_2O_3$, $\alpha$-$Fe_2O_3$, $\alpha$-FeOOH, $Cr_2O_3$, mica and the like, and especially preferable is $SiO_2$.

In the present invention, it is preferred that the powder has been surface-treated with Si compound and/or Al compound. When the powder with such surface treatment is used, it is possible to make the surface state of an uppermost layer good. For the content of the Si and/or Al, preferably Si is from 1 to 10% and Al is from 1 to 10%, and more preferably Si is from 0.1 to 5% and Al is 0.1 to 5%, and especially preferably Si is 0.1 to 2% and Al is 0.1 to 2% by mass based on the powder. Also it is better that the mass ratio of Si to Al is Si<Al. The surface treatment can be carried out by the method described in JP-A-2-83219. The average particle diameter of the powder in the invention means the average diameter in spherical powder, the average long axis length in needle-shaped powder, and the average value of maximum diagonal lines in the platy face in plate-shaped powder. It can be easily obtained from the measurement by electron microscopy.

The average particle diameter of the above organic or inorganic powder is preferably from 0.5 to 10 μm, and more preferably from 1.0 to 8.0 μm.

The average particle diameter of the organic or inorganic powder comprised in the outermost layer at the side of the photosensitive layer is typically from 0.5 to 8.0 μm, preferably from 1.0 to 6.0 μm, and more preferably from 2.0 to 5.0 μm. The addition amount is typically from 1.0 to 20%, preferably from 2.0 to 15%, and more preferably from 3.0 to 10% by mass based on the amount of the binders used for the outermost layer (a hardening agent is included in the binder amount). The average particle diameter of the organic or inorganic powder comprised in the outermost layer at the opposite side of the photosensitive layer with interleaving the support is typically from 2.0 to 15.0 μm, preferably from 3.0 to 12.0 μm, and more preferably from 4.0 to 10.0 μm. The addition amount is typically from 0.2 to 10%, preferably from 0.4 to 7%, and more preferably from 0.6 to 5% by mass based on the amount of the binders used for the outermost layer (a hardening agent is included in the binder amount).

Further, a variation coefficient of particle size distribution is preferably 50% or less, more preferably 40% or less and especially preferably 30% or less.

Here, the variation coefficient of particle size distribution is a value represented by the following formula.

{(Standard deviation of particle diameters)/(Mean value of particle diameters)}×100

An addition method of the organic or inorganic powder may be the method for coating by precedently dispersing in the coating solution or the method where after coating the coating solution, the organic or inorganic powder is sprayed before the completion of drying. Further, when multiple types of the powders are added, both methods may be combined.

Materials of the support used for the photothermographic imaging material according to the invention include various polymer materials, glass, wool fabrics, cotton fabrics, paper, metals (e.g., aluminium) and the like, but flexible sheets or those capable of being made into rolls are suitable in terms of handling as information recording materials. Therefore, as the support in the photothermographic imaging material of the invention, preferred are plastic films (e.g., cellulose acetate film, polyester film, polyethylene terephthalate film, polyethylene naphthalate film, polyamide film, polyimide film, cellulose triacetate film or polycarbonate film), and in the invention, the biaxially stretched polyethylene terephthalate film is especially preferable. A thickness of the support is from about 50 to 300 μm, and preferably from 70 to 180 μm.

In the present invention, it is possible to include conductive compounds such as metal oxide and/or conductive polymer in the component layer to improve the electrostatic property. These may be contained in any layer, but preferably is comprised in the backing layer, the surface protection layer at the side of the photosensitive layer, the under coating layer and the like. In the present invention, preferably used are the conductive compounds described in columns 14 to 20 of U.S. Pat. No. 5,244,773.

Among others, in the invention, it is preferable to contain the conductive metal oxide in the surface protection layer at the side of the backing layer. It has been found that this further enhances the effects of the invention (especially, transport property at the thermal development). Here, the conductive metal oxide is crystalline metal oxide particle. Those comprising oxygen defect and those comprising heterogenous atoms at a small amount which form donors for the metal oxide used are especially preferable because they are highly conductive in general. In particular, the latter is especially preferable because they do not give the photographic fog to the silver halide emulsion. As examples of the metal oxide, preferred are ZnO, $TiO_2$, $AnO_2$, $Al_2O_3$, $In_2O_3$, $SiO_2$, MgO, BaO, $MoO_3$, $V_2O_5$ and the like, or composite oxides thereof, and in particular ZnO, $TiO_2$ and $SnO_2$ are preferable. As examples comprising heterogenous atoms, for example, the addition of Al, In to ZnO, the addition of Sb, Nb, P, halogen elements to $SnO_2$, and the addition of Nb, Ta to $TiO_2$ are effective. The addition amount of these heterogenous atoms is preferably in the range of 0.01 to 30 mol %, and the range of 0.1 to 10 mol % is especially preferable. Further also, to improve fine particle dispersibility and transparency, silicon compounds may be added at making fine particles. The metal oxide fine particles used for the invention have conductivity, and volume resistivity thereof is $10^7$ Ωcm or less, and especially $10^5$ Ωcm or less. These oxides are described in JP-A-56-143431, JP-A-56-120519, and JP-A-58-62647. Further also, the conductive materials by making the above metal oxides adhere to the other crystalline metal oxide particles or fibrous matters (e.g., titanium oxide) may be used, as described in JP-B-59-6235.

The particle size which can be utilized is preferably 1 μm or less, but when it is 0.5 μm or less, stability after the dispersion is good and the particles are easy-to-use. Further, to make light scattering small as possible, when the conductive particles of 0.3 μm or less are utilized, it becomes possible to form the clear imaging material, and thus it is extremely preferable. Further, when the conductive metal oxide is needle-shaped or fibrous, it is preferred that the length is 30 μm or less and the diameter is 1 μm or less, and especially preferable is that the length is 10 μm or less, the diameter is 0.3 μm or less and a length/diameter ratio is 3 or more. Besides, $SnO_2$ is commercially available from Ishihara Sangyo Co. Ltd., and it is possible to use SNS10M, SN-100P, SN-100D, FSS10M and so on.

The photothermographic imaging material of the invention has the image formation layer which is at least one layer of the photosensitive layer on the support. Only the image formation layer may be formed on the support, but it is preferred that at least one layer of the non-photosensitive layer is formed on the image formation layer. For example, it is preferred that the protection layer is installed on the image formation layer for the purpose of protecting the image formation layer, and the back coat layer is installed at the opposite side of the support to prevent sticking between the photothermographic imaging materials or at the photothermographic imaging material roll. As the binders used for these protection layer and back coat layer, selected are polymers where the glass transition temperature is higher than that in the image formation layer and scratch and deformation unlikely occur, such as cellulose acetate and cellulose acetate butylate from the binders.

For adjusting gradation, two or more of the image formation layers may be placed at one side of the support, or one or more may be placed at both side of the support.

In the photothermographic imaging material according to the invention, it is preferred that a filter layer is formed at the same side or the opposite side of the image formation layer, or dyes or pigments are contained in the image formation layer in order to control the amount or wavelength distribution of light transmitting the image formation layer.

As the dyes used in the invention, it is possible to use the compounds known in the art, which absorb light in various wavelength areas depending on color sensitivity of the photothermographic imaging material.

For example, in the case of making the photothermographic imaging material according to the invention an image recording material by infrared light, it is preferable to use squalirium dye having thiopyrylium nuclei (herein called thiopyrylium squalirium dye) and squalirium dye having pyrylium nuclei (herein called pyrylium squalirium dye) as disclosed in JP-A-2001-83655, and thiopyrylium chroconium dye or pyrylium chroconium dye which are similar to squalirium dyes.

The compounds having squalirium nuclei are the compound having 1-cyclobutene-2-hydroxy-4-one in the molecular structure, and the compounds having chroconium nuclei are the compounds having 1-cyclopentene-2-hydroxy-4,5-dione in the molecular structure. Here, the hydroxy groups may be dissociated. Hereinafter, herein, these dyes are collectively called squalirium dyes for convenience. As the dye, the compounds of JP-A-8-201959 are also preferable.

It is preferred that the photothermographic imaging material of the invention is formed by making the coating solutions where the materials of each component layer described above are dissolved or dispersed in the solvent, overlaying and coating these coating solutions in plurality simultaneously, and then performing the treatment with heat. Here, "overlaying and coating in plurality simultaneously" means that the coating solution of each component layer (e.g., photosensitive layer, protection layer) is made, coating and drying are not repeated for each layer when coated on the support, and each component layer can be formed in the state where overlaying and coating is simultaneously performed and the drying step can be also simultaneously performed. That is, an upper layer is installed before a remaining amount of the total solvent in a lower layer becomes 70% or less by mass.

The method where respective layers are overlaid and coated in plurality simultaneously is not especially limited, and for example, it is possible to use the methods known in the art such as a bar coater method, curtain coat method, immersion method, air knife method, hopper coating method, and extrusion coating method. In these, preferred is the coating manner of previous measure type called the extrusion coating method. The extrusion coating method is suitable for precise coating and organic solvent coating because there is no volatilization on a slide face such as a slide coating method. This coating method was described for the side having the photosensitive layer, but it is the same in the case of coating along with the under coating layer when the back coat layer is installed. The simultaneous overlaying and coating method in the photothermographic imaging material is described in JP-A-2000-15173 in detail.

In the present invention, for a coated silver amount, it is preferable to select an appropriate amount depending on the purpose of the photothermographic imaging material.

In the case of making an image for medical use a target, the amount is preferably 0.3 $g/m^2$ or more and 1.5 $g/m^2$ or less, and more preferably 0.5 $g/m^2$ or more and 1.5 $g/m^2$ or less. It is preferred that in the coated silver amount, the amount derived from the silver halide is from 2 to 18% based on the total silver amount. More preferably it is from 5 to 15%.

Also, in the present invention, a coating density of the silver halide particles of 0.01 μm or more (converted particle diameter of a corresponding sphere) is preferably $1\times10^{14}/m^2$ or more and $1\times10^{18}/m^2$ or less, and more preferably $1\times10^{15}/m^2$ or more and $1\times10^{17}/m^2$ or less.

Furthermore, the coating density of the non-photosensitive long chain aliphatic carboxylate silver is $1\times10^{-17}$ g or more and $1\times10^{-15}$ g or less, and more preferably $1\times10^{-16}$ g or more and $1\times10^{-14}$ g or less per silver halide particle of 0.01 μm or more (converted particle diameter of a corresponding sphere).

When coated in the condition within the above range, the preferable effects are obtained in terms of optical maximum density of silver image per constant coated silver amount, i.e., silver covering power and the color tone of the silver image.

In the present invention, it is preferred that the photothermographic imaging material contains the solvent at the range of 5 to 1000 $mg/m^2$ at the development. It is more preferable to adjust to be 100 to 500 $mg/m^2$. That makes the photothermographic imaging material with high sensitivity, low photographic fog and high maximum density.

The solvents include those described in [0030] of JP-A-2001-264930. But it is not limited thereto. Also these solvents can be used alone or in combination of several types.

The content of the above solvent in the photothermographic imaging material can be adjusted by condition changes such as temperature condition and the like in the drying step after the coating step. Further, the content of the solvent can be measured by gas chromatography under the condition suitable for detecting the contained solvent.

When the photothermographic imaging material of the invention is stored, it is preferable to store by housing in a wrapping body in order to prevent density change and occurrence of photographic fog with time. A void ratio in the wrapping body could be from 0.01 to 10%, and preferably from 0.02 to 5%. A nitrogen partial pressure in the wrapping body could be made 80% or more, and preferably 90% or more by performing nitrogen charging.

In the photothermographic imaging material of the invention, it is common to use laser beam when recording the image. At exposure of the photothermographic imaging material of the invention, it is desirable to use a proper light source for the color sensitivity imparted to the material. For example, when the material is made one which can be sensitive to the infrared light, it can be applied for any light sources in the infrared light area, but infrared semiconductor laser (780 nm, 820 nm) is preferably used in terms of points where laser power is high and the photothermographic imaging material can be made transparent.

In the present invention, it is preferred that the exposure is carried out by laser scanning exposure, but various methods can be employed for the exposure methods. For example, the first preferable method includes the method using a laser scanning exposure machine where angles made by an exposure face of the imaging material and the scanning laser beam do not substantially become perpendicular.

Here, "do not substantially become perpendicular" is referred to the angels of preferably 50° or more and 80° or less, more preferably 60° or more and 86° or less, still preferably 65° or more and 84° or less and most preferably 70° or more and 82° or less as the angle most closed to the perpendicular during the laser scanning.

The diameter of a beam spot on the exposure face of the imaging material when the laser beam is scanned on the imaging material is preferably 200 μm or less, and more preferably 100 μm or less. This is preferable in that the smaller spot diameter can reduce a shift angle from the perpendicular of a laser beam entry angle. A lower limit of the beam spot diameter is 10 μm. By performing the laser scanning exposure in this way, it is possible to reduce image quality deterioration due to reflected light such as an occurrence of interference fringe like unevenness.

Further, as the second method, it is also preferred that the exposure in the invention is carried out using a laser scanning exposure machine which emits the scanning laser beam which is vertical multiple mode. Compared to the scanning laser beam in vertical single mode, it further reduces the image quality deterioration such as the occurrence of interference fringe like unevenness.

To make the vertical multiple mode, the method by combining lights, the method by utilizing returned light and the method by loading high frequency superposition could be used. The vertical multiple mode means that the exposure wavelength is not a single, and typically the distribution of exposure wavelength could be 5 nm or more, and preferably 10 nm or more. An upper limit of the exposure wavelength is not especially limited, but typically is about 60 nm.

Furthermore, as the third method, it is preferable to form the image by scanning exposure using two or more laser beams.

Such an image recording method by utilizing multiple laser beams is the technology used for image writing means of laser printers and digital copying machines where the image with multiple lines are written by one scanning on the requisition of high resolution and high speed, and for example is known by JP-A-60-166916. This is the method where the laser beam emitted from the light source unit is deflected and scanned by polygon mirror, and the imaging is performed on the photosensitive body via fθ lens, and this is principally the same laser scanning optical apparatus as a laser imager and the like.

In the imaging of the laser beam on the photosensitive body in the image writing means of the laser printer and the digital copying machine, next laser beam is imaged with shifting by one line from the imaging site of one laser beam, for the use where multiple lines of the image are written by one scanning. Specifically, two light beam come close with an interval of some 10 μm order on an image face in a sub-scanning direction one another, when print density is 400 dpi (dpi indicates a dot number per inch, i.e., 2.54 cm), the pitch of two beams in the sub-scanning direction is 63.5 μm, and in the case of 600 dpi, it is 42.3 μm. Differently from the method which shifs by resolution segment to the sub-scanning direction in this way, in the invention, it is preferred that the image is formed by condensing two or more lasers with different entry angles on the exposure face at the same site. At that time, it is preferable to make the range of $0.9\times E \leqq En\times N \leqq 1.1\times E$ when an exposure energy on the exposure face is E when written by typical one laser beam (wavelength λ[nm]), and when N of laser beams used for the exposure heve the same wavelength (wavelength λ[nm]) and the same exposure energy (En). The energy is secured on the exposure face in this way, the reflection of each laser beam to the image formation layer is reduced because the exposure energy of the laser is low, and thus the occurrence of interference fringe is inhibited.

In the above, multiple laser beams with the same wavelength as λ were used, but those with different wavelength may be used. In this case, it is preferable to make the range $(\lambda-30)<\lambda_1, \lambda_2 \ldots \lambda_n \leqq (\lambda+30)$.

In the image recording methods of the above first, second and third aspects, as the laser used for the scanning exposure, it is possible to use by appropriately selecting solid lasers such as ruby laser, YAG laser and glass laser; gas lasers such as He—Ne laser, Ar ion laser, Kr ion laser, $CO_2$ laser, CO laser, He—Cd laser, $N_2$ laser and excimer laser; semiconductor laser such as InGap laser, AlGaAs laser, GaAsP laser, InGaAs laser, InAs laser, $CdSnP_2$ laser and GaSb laser; chemical lasers and pigment lasers generally well-known in conjugation with the use, but in these, it is preferable to use the laser beam by the semiconductor laser with wavelength of 600 to 1200 nm in terms of the maintenance and the size of light source. In the laser beam used for the laser imager and laser image setter, when scanned on the photothermographic imaging material, the beam spot diameter on the exposure face of the material is generally in the range of 5 to 75 μm as a minor axis diameter and 5 to 100 μm as a major axis diameter. For the laser beam scanning velocity, an optimal value by photothermographic imaging material can be set by sensitivity and laser power at a laser oscillation wavelength inherent for the photothermographic imaging material.

The thermal development apparatus of the invention is made up of a film supplying portion represented by a film tray, a laser image recording portion, a photothermographic portion where uniform and stable heat is supplied on whole area of the photothermographic imaging material, and a transport portion from the film supplying portion, via the laser recording, to discharge of the photothermographic imaging material where the image is formed by the thermal development out of the apparatus. A specific example of this aspect of the thermal development apparatus is shown in FIG. 1.

A thermal development apparatus 100 has a feeding portion 110 where a sheet-shaped photothermographic imaging material (photothermographic element or also referred to as film simply) is fed by one, an exposure portion 120 where the fed film F is exposed, a developing portion 130 where the exposed film is developed, a cooling portion 150 where the development is stopped, and an accumulating portion 160, and made up of multiple rollers such as a supplying roller pair 140 for supplying the film F from the feeding portion, a supplying roller pair 144 for delivering the film to the developing portion, and transport roller pairs 141, 142, 143 and 145 for smoothly transporting the film between the portions. The developing portion is made up of a heat drum 1 having multiple opposed rollers 2 capable of heating with retaining in adherence with a periphery as a heating means for the development of the film F, and a peeling tab 6 for peeling the developed film F and delivering to the cooling portion.

A transport velocity of the photothermographic imaging material is preferably in the range of 10 to 200 mm/sec.

The developing condition of the photothermographic imaging material of the invention varies depending on instruments, apparatus and means used, but typically, the development is carried out by heating the photothermographic imaging material exposed to an image at suitable high temperature. A latent image obtained after the exposure is developed by heating the photothermographic imaging material at moderately high temperature (from about 80 to 200° C., preferably from about 100 to 200° C.) for a sufficient time period (generally from about one second to about two minutes).

When the heating temperature is lower than 80° C., sufficient image density is not obtained in a short time, and when it is higher than 200° C., the binders are melted and adverse effects are given not only to the image itself but also to transport ability and a developing machine such as transfer to the rollers. The silver image is produced by an oxidation reduction reaction between the organic silver salt (functions as the oxidizing agent) and the reducing agent due to heating. This reaction process progresses with supplying no process liquid such as water from the outside.

As instruments, apparatus or means for heating, for example, a hot plate, iron, hot roller, typical heating means as a thermogenesis machine using carbon or white titanium may be used. More preferably, in the photothermographic imaging material with the protection layer, it is preferred that heating process is carried out by contacting the face at the side having the protection layer with the heating means in terms of performing uniform heating, heat efficiency and working property. It is preferred that the development is performed by transporting and heat processing with contacting the face at the side having the protection layer with the heat rollers.

EXAMPLES

Hereinafter, examples of the invention are described, but the embodiments of the invention is not limited thereto. Unless otherwise specified, "%" in the examples indicates "% by mass".

Example 1

<Manufacture of Support Given Under Coating>

Corona discharge at 12 W/m$^2$·min was given to both faces of polyethylene terephthalate with a thickness of 175 μm. The following under coating solution a-1 was appllied on one face such that a thickness of dried film was 0.6 μm and dried to provide an under coating layer A-1, and the following under coating solution b-1 was applied on the face at an opposite side such that the thickness of dried film was 0.6 μm and dried to provide an under coating layer B-1.

(Under Coating Solution a-1)

Solution obtained by diluting a copolymer latex solution (solid 30%) of butylacrylate/t-butylacrylate/styrene/2-hydroxyethylacrylate (30/20/25/25%) by 15 times.

(Under Coating Solution b-1)

Solution obtained by diluting a copolymer latex solution (solid 30%) of butylacrylate/styrene/glycidylacrylate (40/20/40%) by 15 times.

Subsequently, the corona discharge at 12 W/m$^2$·min was given to an upper surface of the under coating layer A-1 and the under coating layer B-1. The following under coating upper layer coating solution a-2 was applied on the under coating layer A-1 and dried to provide an under coating upper layer A-2, and the following under coating upper layer coating solution b-2 was applied on the under coating layer B-1 and dried to provide an under coating upper layer B-2 which has antistatic function. All numerical values of respective materials indicate applied amounts per m$^2$.

(Under Coating Upper Layer Coating Solution a-2)

| | |
|---|---|
| Copolymer of styrene/butadiene (1/2 mass ratio) | 0.4 g |
| Silica particles (average particle diameter 3 μm) | 0.05 g |

(Under Coating Upper Layer Coating Solution b-2)

| | |
|---|---|
| Copolymer of styrene/butadiene (1/2 mass ratio) | 0.4 g |
| Tin oxide fine particles (average particle diameter 16 nm) | 0.023 g |

<Manufacture of Photosensitive Layer Coating Solution>

<Preparation of Silver Halide Particle Emulsion A>

Inert gelatin (7.5 g) and potassium bromide (10 mg) were dissolved in 900 ml of water, the temperature and pH were adjusted at 28° C. and 3.0, respectively, and subsequently 370 ml of an aqueous solution comprising 74 g of silver nitrate and 370 ml of an aqueous solution comprising an equivalent mol to silver nitrate of potassium bromide and potassium iodide at a molar ratio of 98/2 were added over 10 min with retaining pAg at 7.7 by a controlled double jet method. Being synchronized with the addition of silver nitrate, $10^{-6}$ mol/mol of silver of sodium salt of hexachloroiridium (compound of the Formula (6): example compound 28) was added. Subsequently, 0.3 g of 4-hydroxy-6-methyl-1,3,3a,7-tetrazaindene (stabilizer) was added and the pH was adjusted at 5 with sodium hydroxide to yield cubic iodide bromide silver particles with an average particle size of 0.036 μm, a variation coefficient of projected diameter area of 8% and [100] face ratio of 87%. This emulsion was agglutinated and precipitated using gelatin flocculating agent, and after desalting treatment, water was added to make 160 ml.

(Preparation of Water Dispersion Organic Silver Salt)

Behenic acid (111.4 g), arachidic acid (83.3 g) and stearic acid (54.9 g) were dissolved in 3980 ml of pure water at 80° C. Next, with rapidly stirring, 540.2 ml of an aqueous solution of sodium hydroxide at 1.5 mol/L was added, 6.9 ml of concentrated nitric acid was added, and subsequently the temperature was cooled to 55° C. to yield a sodium organic acid solution. With retaining the temperature of this sodium organic acid solution at 55° C., the silver halide particle emulsion A (containing 0.038 mol of the silver) and 420 ml of pure water were added and stirred for 5 min. Next, 760.6 ml of a silver nitrate solution at 1 mol/L was added over 2 min, further stirred for 20 min, and water soluble salts were eliminated by filtration. Subsequently, washing with deionized water and filtration were repeated until conductivity of a filtrate becomes 2 μS/cm, and finally centrifugation and dehydration were carried out to dry.

At the same time, in the above preparation of the water dispersion organic silver salt, also performed was the preparation of the organic silver salt using potassium hydroxide in place of sodium hydroxide. As described in Tables 2 to 4 of the examples, the preparations using sodium hydroxide and potassium hydroxide were rendered NaOH method and KOH method, respectively.

<Coating of Photosensitive Layer Side>

The following respective layers were sequentially formed on the under coating upper layer A-2 of the support given the under coating layer to make the photothermographic imaging material. Drying was carried out at 45° C. for 1 min in each case. All the amounts of the materials in coating compositions are applied amounts per m$^2$.

(AH Layer Coating Composition)

| | |
|---|---|
| Binder: described in Table 2 | 0.8 g |
| C1 (dye) | $1.2 \times 10^{-5}$ mol |

(Photosensitive Layer Composition)

To form the photosensitive layer, a coating solution of the following composition was prepared, coated and dried to be the following applied amounts (per m$^2$). The preparation solution of the organic silver salt at the amount corresponding to 1.36 g/m$^2$ as the silver amount was mixed with the polymer binder.

| | |
|---|---|
| Binder: described in Table 2 | 5 g |
| Compound of the Formula (1): described in Table 2 | $3 \times 10^{-5}$ mol |
| Compound of the Formula (2): described in Table 2 | $2.4 \times 10^{-5}$ mol |
| Polyhalomethane compound of the Formula (5): (5) – 70 | $2 \times 10^{-4}$ mol |
| Z1 (Spectral sensitizing dye) | $2 \times 10^{-5}$ mol |
| Pyridinium hydrobromideperbromide (Antifoggant) | 0.3 mg |
| Isothiazolone (Antifoggant) | 1.2 mg |
| Reducing agent (Example compound 7–9) | 3.3 mmol |
| Phthalazine | $2 \times 10^{-4}$ mol |

(Surface Protection Layer)

The coating solution of the following composition was coated on the photosensitive layer to be the following applied amounts (per m$^2$), and dried to form the surface protection layer.

| | |
|---|---|
| Cellulose acetate butyrate | 2.0 g |
| 4-Methyl phthalic acid | 0.7 g |
| Tetrachlorophthalic acid | 0.2 g |
| Tetrachlorophthalic acid anhydride | 0.5 g |
| Silica matting agent (average particle diameter 5 μm) | 0.5 g |

As the binders, two types of polyacetal and copolymer of styrene and butadiene were used. In the case of polyacetal, methylethylketone was used as the organic solvent, and in the case of the copolymer of styrene and butadiene, water comprising 1% i-propanol and 1% ethanol was used as the solvent. Additives were added thereto, which was then dispersed and coated. As polyacetal, 98% of polyvinyl acetate with polymerization degree of 500 was saponified and 86% of residual hydroxyl groups was butyralized to use, which is referred to as PVB-1. Styrene/butadiene composition at a mass ratio of 1/2 was emulsified and copolymerized to make the copolymer of styrene/butadiene (referred to as "SB-1").

<Coating of BC Layer Side>

For the back face side, the coating solutions for the BC layer and the protection layer thereof prepared to be the following applied amounts (per $m^2$) were sequentially coated on the under coating upper layer B-2, and dried to form the BC and the protection layers.

(BC Layer Composition)

| | |
|---|---|
| PVB-1 (binder) | 1.8 g |
| C1 (dye) | $1.2 \times 10^{-5}$ mol |

(BC protection Layer Coating Solution)

| | |
|---|---|
| Cellulose acetate butyrate | 1.1 g |
| Matting agent (polymethylmethacrylate: average particle diameter 5 μm) | 0.12 g |

C1

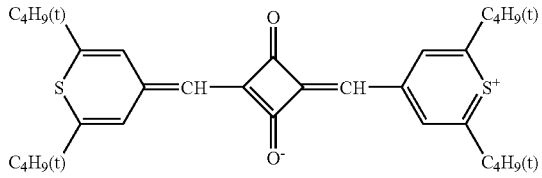

PVB-1

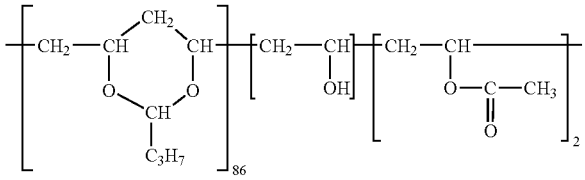

Z1

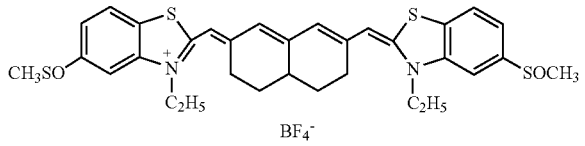

In this example, when PVB-1 was used as the binder, the crosslinker H2 was used. When SB-1 was used as the binder, the crosslinker CI-1 was used. The crosslinker was added to the AH layer, photosensitive layer, protection layer and BC layer. It was added at $2.8\times10^{-4}$ mol/$m^2$ in the photosensitive layer, $0.8\times10^{-4}$ mol/$m^2$ in the protection layer, $0.9\times10^{-4}$ mol/$m^2$ in the AH layer and $2.8\times10^{-4}$ mol/$m^2$ in the BC layer.

The photothermographic imaging materials 101 to 109 were made in this way.

<<Evaluation of Photographic Performance>>

Three sets of the above each photothermographic imaging material were prepared. A sample obtained by storing one under an atmosphere at 25° C. and RH 48% (relative humidity), then exposing it by a sensitometer for semiconductor laser exposure at 810 nm, and heating it at 120° C. for 8 seconds after the exposure was made a prompt sample (treatment is inscribed "prompt treatment"). Sensitivity and photographic fog which were photographic performance of the prompt sample were measured using a photographic densitometer. The sensitivity was evaluated by a reciprocal of a ratio of an exposure amount which gives 0.3 higher density than the density of photographic fog, and represented by a relative value where the sensitivity of the sample 101 was rendered 100.

Another sample was exposed by the sensitometer for laser exposure as with the above sample. The sample after the development was left on Schaukasten of 10,000 Lux for 20 hours, and then reduction of the maximum density (Δmax) as an index of light resistance which was one image storage stability was measured and simultaneously color tone was observed. The value of Δmax was represented by a reduced value obtained by measuring the maximum density of the prompt sample and the sample for light resistance test. Also, the color tone was rated on a scale of one to ten based on the following evaluation criteria.

10: Color tone with no problem

7: Color tone with no practical problem

5: Color tone slightly taking on yellow tinge with no problem

3: Offensive color tone with a possibility to be problematic

1: Color tone with practical problem where obviously remarkable changes are observed.

The other rating rank in the table exhibits a corresponding intermediate property. It was judged to be no problem if exhibiting 5 or more in the above rank.

The third sample was exposed by the sensitometer for laser exposure as with the first sample. The sample after the development was stored in a dark room at 55° C. and RH 20% for 3 days, and then the photographic fog (heat resistance, one image storage stability) was measured. As an index of the heat resistance which is one image storage stability, an increase of the photographic fog (Δfog) of the prompt sample and the sample after the heat resistance test was used.

Laser exposure and development processing were carried out in a room where the temperature and humidity were controlled at 25±1° C. and RH 48±1%, respectively. The lower the increased value of photographic fog and the reduced value of maximum density and the lower color tone changes are, the image storage stability is shown to be better. The results are together with in Table 2.

TABLE 2

| SAMPLE No. | COMPOUND OF FORMULA (1) | COMPOUND OF FORMULA (2) | TYPE OF BINDER | PHOTOGRAPHIC PERFORMANCE AT PROMPT TREATMENT: PHOTOGRAPHIC FOG | PHOTOGRAPHIC PERFORMANCE AT PROMPT TREATMENT: SENSITIVITY | IMAGE STABILITY: ΔPHOTOGRAPHIC FOG | IMAGE STABILITY: ΔMAX | IMAGE STABILITY: COLOR TONE | PREPARATION METHOD OF ORGANIC SILVER SALT | REMARKS |
|---|---|---|---|---|---|---|---|---|---|---|
| 101 | NONE | NONE | PVB-1 | 0.09 | 100 | 0.10 | 0.47 | 3 | NaOH method | Comp. |
| 102 | (1)-3 | NONE | PVB-1 | 0.07 | 101 | 0.07 | 0.28 | 4 | NaOH method | Comp. |
| 103 | NONE | (2)-4 | PVB-1 | 0.07 | 101 | 0.08 | 0.29 | 4 | NaOH method | Comp. |
| 104 | (1)-5 | (2)-6 | PVB-1 | 0.05 | 103 | 0.05 | 0.14 | 5 | NaOH method | Inv. |
| 105 | (1)-65 | (2)-1 | PVB-1 | 0.04 | 105 | 0.05 | 0.12 | 6 | NaOH method | Inv. |
| 106 | (1)-101 | (2)-2 | SB-1 | 0.05 | 104 | 0.04 | 0.13 | 6 | NaOH method | Inv. |
| 107 | (1)-133 | (2)-1 | PVB-1 | 0.03 | 107 | 0.03 | 0.10 | 6 | KOH method | Inv. |
| 108 | (1)-134 | (2)-1 | PVB-1 | 0.03 | 107 | 0.03 | 0.11 | 6 | KOH method | Inv. |
| 109 | (1)-73 | (2)-1 | SB-1 | 0.04 | 106 | 0.03 | 0.11 | 6 | KOH method | Inv. |

From Table 2, it is found that the samples using the compounds of the Formulae (1) and (2) of the invention are good in photographic performance (sensitivity and photographic fog) of the prompt treatment, and excellent in light resistance which is one image storage stability (prevention of reduction of maximum density and prevention of color tone changes) and heat resistance which is another image storage stability (prevention of photographic fog increase).

Example 2

The samples 201 to 208 were made and the performances were evaluated as is the case with the example 1. Here, the compound of the Formula (3) was added in the photosensitive layer to be $3\times10^{-5}$ mol/m$^2$. The photographic performance of prompt treatment and the photographic storage stability were tested as with the example 1.

Here, the relative sensitivity was represented by the relative value where the sensitivity of prompt treatment of the sample 201 was rendered 100. The results are shown in Table 3.

From Table 3, it is found that the samples combining the compounds of the Formulae (1), (2) and (3) of the invention are good in photographic performance (sensitivity and photographic fog) of the prompt treatment, and excellent in light resistance which is one image storage stability (prevention of reduction of maximum density and prevention of color tone changes) and heat resistance which is another image storage stability (prevention of photographic fog increase).

Example 3

The samples 301 to 308 were made and the performances were evaluated as is the case with the example 1. Here, the compound of the Formula (3) and hydrazine compound were added in the photosensitive layer to be $3\times10^{-5}$ mol/m$^2$, respectively. The photographic performance of prompt treatment and the photographic storage stability were tested as with the example 1. Here, the relative sensitivity was represented by the relative value where the sensitivity of prompt treatment of the sample 301 was rendered 100. The results are shown in Table 4.

TABLE 3

| SAMPLE No. | COMPOUND OF FORMULA (1) | COMPOUND OF FORMULA (2) | COMPOUND OF FORMULA (3) | TYPE OF BINDER | PHOTOGRAPHIC PERFORMANCE AT PROMPT TREATMENT: PHOTOGRAPHIC FOG | PHOTOGRAPHIC PERFORMANCE AT PROMPT TREATMENT: SENSITIVITY |
|---|---|---|---|---|---|---|
| 201 | (1)-11 | (2)-5 | NONE | PVB-1 | 0.05 | 100 |
| 202 | (1)-12 | (2)-10 | (3)-1 | PVB-1 | 0.06 | 103 |
| 203 | (1)-62 | (2)-1 | (3)-8 | PVB-1 | 0.05 | 106 |
| 204 | (1)-102 | (2)-7 | (3)-13 | PVB-1 | 0.05 | 108 |
| 205 | (1)-121 | (2)-8 | (3)-23 | SB-1 | 0.05 | 107 |
| 206 | (1)-133 | (2)-1 | (3)-30 | PVB-1 | 0.04 | 111 |
| 207 | (1)-135 | (2)-1 | (3)-24 | PVB-1 | 0.04 | 110 |
| 208 | (1)-76 | (2)-1 | (3)-1 | SB-1 | 0.05 | 110 |

| SAMPLE No. | IMAGE STABILITY: ΔPHOTOGRAPHIC FOG | IMAGE STABILITY: ΔMAX | IMAGE STABILITY: COLOR TONE | PREPARATION METHOD OF ORGANIC SILVER SALT | REMARKS |
|---|---|---|---|---|---|
| 201 | 0.06 | 0.16 | 5 | NaOH method | Inv. |
| 202 | 0.05 | 0.15 | 6 | NaOH method | Inv. |
| 203 | 0.06 | 0.13 | 7 | NaOH method | Inv. |
| 204 | 0.05 | 0.12 | 7 | NaOH method | Inv. |
| 205 | 0.05 | 0.14 | 7 | NaOH method | Inv. |
| 206 | 0.04 | 0.10 | 7 | KOH method | Inv. |
| 207 | 0.05 | 0.11 | 7 | KOH method | Inv. |
| 208 | 0.05 | 0.12 | 7 | KOH method | Inv. |

TABLE 4

| SAMPLE No. | COMPOUND OF FORMULA (1) | COMPOUND OF FORMULA (2) | COMPOUND OF FORMULA (3) | HYDRAZINE COMPOUND | TYPE OF BINDER | PHOTOGRAPHIC PERFORMANCE AT PROMPT TREATMENT: PHOTOGRAPHIC FOG | PHOTOGRAPHIC PERFORMANCE AT PROMPT TREATMENT: SENSITIVITY |
|---|---|---|---|---|---|---|---|
| 301 | (1)-15 | (2)-5 | (3)-2 | NONE | PVB-1 | 0.06 | 100 |
| 302 | (1)-16 | (2)-10 | NONE | 4-1 | PVB-1 | 0.06 | 101 |
| 303 | (1)-29 | (2)-4 | (3)-35 | 4-9 | PVB-1 | 0.05 | 105 |
| 304 | (1)-61 | (2)-1 | (3)-25 | 4-16 | PVB-1 | 0.06 | 108 |
| 305 | (1)-131 | (2)-2 | (3)-27 | 4-19 | SB-1 | 0.05 | 107 |
| 306 | (1)-133 | (2)-1 | (3)-14 | 4-6 | PVB-1 | 0.05 | 112 |
| 307 | (1)-133 | (2)-1 | (3)-10 | 4-11 | PVB-1 | 0.05 | 111 |
| 308 | (1)-133 | (2)-1 | (3)-38 | 4-14 | SB-1 | 0.06 | 110 |

| SAMPLE No. | IMAGE STABILITY: ΔPHOTOGRAPHIC FOG | IMAGE STABILITY: ΔMAX | IMAGE STABILITY: COLOR TONE | PREPARATION METHOD OF ORGANIC SILVER SALT | REMARKS |
|---|---|---|---|---|---|
| 301 | 0.06 | 0.15 | 6 | NaOH method | Inv. |
| 302 | 0.05 | 0.14 | 6 | NaOH method | Inv. |
| 303 | 0.06 | 0.11 | 7 | NaOH method | Inv. |
| 304 | 0.05 | 0.10 | 9 | NaOH method | Inv. |
| 305 | 0.06 | 0.12 | 8 | NaOH method | Inv. |
| 306 | 0.05 | 0.10 | 9 | KOH method | Inv. |
| 307 | 0.05 | 0.10 | 9 | KOH method | Inv. |
| 308 | 0.06 | 0.11 | 9 | KOH method | Inv. |

From Table 4, it is found that the samples combining the compounds of the Formulae (1), (2), (3) and the hydrazine compound of the invention are good in photographic performance (sensitivity and photographic fog) of the prompt treatment, and excellent in light resistance which is one image storage stability (prevention of reduction of maximum density and prevention of color tone changes) and heat resistance which is another image storage stability (prevention of photographic fog increase).

Example 4

<Manufacture of Support Given Under Coating for Photograph>

Corona discharge treatment at 8 W/m$^2$·min was given to both faces of a commercially available PET film with thickness of 175 μm and optical density of 0.170 (measured by a densitometer PDA-65 supplied from Konica Corporation) biaxially stretched and thermally fixed which was blue-colored with blue dye, the following under coating solution a-1 was applied on one side face such that the thickness of dried film is 0.8 μm, and was dried to make an under coating layer A-1. Further, the following under coating solution b-1 was applied on an opposite side face such that the thickness of dried film is 0.8 μm, and was dried to make an under coating layer B-1.

BLUE DYE

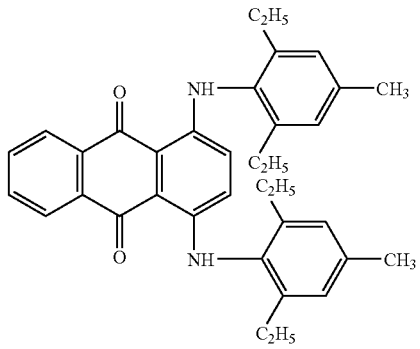

<Undercoating Solution a-1>

| | |
|---|---|
| Copolymer latex solution (solid 30%) of butylacrylate (30% by mass) t-butylacrylate (20% by mass) styrene (25% by mass) 2-hydroxyethylacrylate (25% by mass) | 270 g |
| (C-1) | 0.6 g |
| Hexamethylene-1,6-bis (ethylene urea) | 0.8 g |
| are filled up with water to 1 liter. | |

<Under Coating Solution b-1>

| | |
|---|---|
| Copolymer latex solution (solid 30%) of butylacrylate (40% by mass) styrene (20% by mass) glycidylacrylate (40% by mass) | 270 g |
| (C-1) | 0.6 g |
| Hexamethylene-1,6-bis (ethylene urea) | 0.8 g |
| are filled up with water to 1 liter. | |

Subsequently, the corona discharge treatment at 8 $W/m^2 \cdot min$ was given to upper surfaces of the under coating layers A-1 and B-1, the following under coating upper layer coating solution a-2 was applied on the under coating layer A-1 such that the thickness of dried film is 0.1 μm as the under coating upper layer A-2, and the following under coating upper layer coating solution b-2 was applied on the under coating layer A-1 such that the thickness of dried film is 0.4 μm as the under coating upper layer B-2 which has antistatic function.

<Under Coating Upper Layer Coating Solution a-2>

| | |
|---|---|
| Gelatin | mass corresponding to 0.4 $g/m^2$, |
| (C-1) | 0.2 g |
| (C-2) | 0.2 g |
| (C-3) | 0.1 g |
| silica particles (average particle diameter, 3 μm) | 0.1 g |
| are filled up with water to 1 liter. | |

<Under Coating Upper Layer Coating Solution b-2>

| | |
|---|---|
| Sb doped $SnO_2$ (SNS10M supplied from Ishihara Sangyo Co. Ltd.) | 60 g |
| latex solution of which component is (C-4) | 80 g |
| ammonium sulfate | 0.5 g |
| (C-5) | 12 g |
| Polyethyleneglycol | 6 g |
| are filled up with water to 1 liter. | |

(C-1)

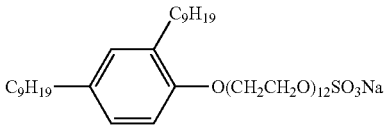

(C-2)

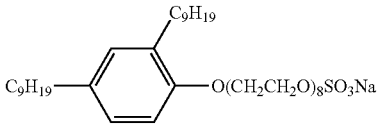

(C-3)

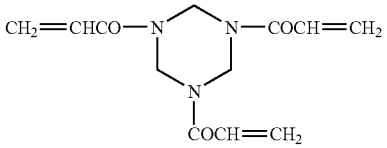

(C-4)

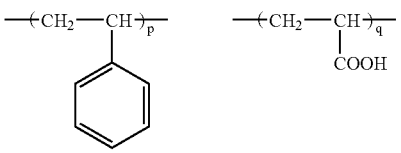

-continued

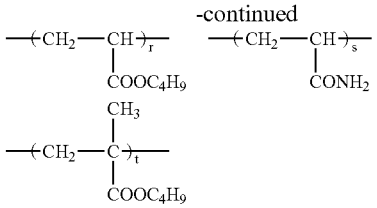

p:q:r:s:t = 40:5:10:5:40 (MASS RATIO)

(C-5)

THREE-IN-ONE MIXTURE OF

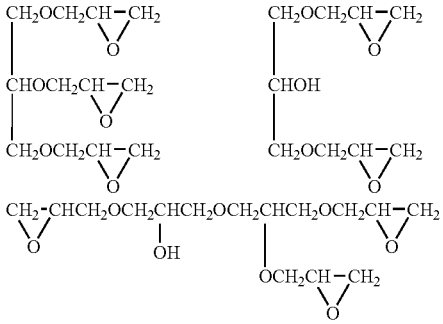

<Preparation of Back Coat Layer Coating Solution>

Cellulose acetate propionate (84.2 g) (Eastman Chemical Company, CAP 482-20) and polyester resin (4.5 g) (Bostic Inc., Vitel PE2200) were added and dissolved in methylethylketone (MEK) (830 g) with stirring. Next, 0.3 g of infrared dye 1 was added to the dissolved solution, further 4.5 g of fluorinated type surfactant (Asahi Glass Co., Ltd., Surflon KH40) and 2.3 g of fluorinated type surfactant (Dainippon Ink And Chemicals, Incorporated, Megafac F 120K) dissolved in 43.2 g of methanol were added, and thoroughly stirred until dissolved. Next, 2.5 g of oleyloleate was added. Finally, 75 g of silica (W. R. Grace & Co., Inc., Syloid 64X600) dispersed in methylethylketone at a concentration of 1% by mass using a dissolver type homogenizer was added, and stirred to prepare the back coat layer coating solution.

INFRARED DYE 1

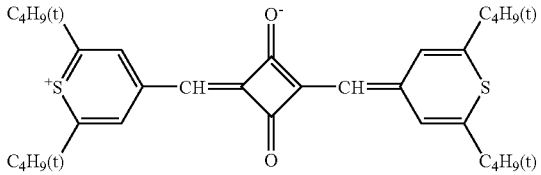

<Preparation of Back Coat Layer Protection Layer (Surface Protection Layer) Coating Solution>

| | |
|---|---|
| Cellulose acetate butylate (10% methylethylketone solution) | 15 g |
| Monodisperse silica (average particle diameter: 8 μm) with monodisperse degree of 15% (surface-treated with aluminium at 1% by mass based on total mass of silica) | 0.03 g |
| $C_8F_{17}(CH_2CH_2O)_{12}C_8F_{17}$ | 0.05 g |
| Fluorinated surfactant (SF-3) | 0.01 g |
| Stearic acid | 0.1 g |
| Oleyloleate | 0.1 g |
| α-alumina (Mohs hardness: 9) | 0.1 g |

<Preparation of Photosensitive Silver Halide Emulsion A>

| | |
|---|---|
| (A1) | |
| Phenylcarbamoyled gelatin | 88.3 g |
| compound (A) (10% methanol solution) | 10 ml |
| potassium bromide | 0.32 g |
| are filled up with water to 5429 ml. | |
| (B1) | |
| An aqueous solution of silver nitrate at 0.67 mol/L | 2635 ml |
| (C1) | |
| Potassium bromide | 51.55 g |
| potassium iodide | 1.47 g |
| are filled up with water to 660 ml | |
| (D1) | |
| Potassium bromide | 154.9 g |
| potassium iodide | 4.41 g |
| potassium hexacycloiridium (IV) acid (1% solution) | 0.93 ml |
| potassium hexacyanoiron (II) acid | 0.004 g |
| potassium hexachloroosmium (IV) acid | 0.004 g |
| are filled up with water to 1982 ml. | |
| (E1) | |
| Aqueous solution of potassium bromide at 0.4 mol/L amount to control the following silver potential | |
| (F1) | |
| Potassium hydroxide | 0.71 g |
| is filled up with water to 20 ml. | |
| (G1) | |
| Aqueous solution of 56% acetic acid | 18.0 ml |
| (H1) | |
| Sodium carbonate anhydride | 1.72 g |
| is filled up with water to 151 ml | |
| Compound (A) | |
| $HO(CH_2CH_2O)_n(CH(CH)_3CH_2O)_{17}(CH_2CH_2O)_mH$ (m + n = 5 to 7) | |

Using the mixing stirrer shown in JP-B-58-58288 and JP-B-58-58289, ¼ amount of the solution (B1) and total amount of the solution (C1) were added to the solution (A) with controlling the temperature at 20° C. and pAg at 8.09 by the simultaneous mixing method over 4 min 45 sec to perform the nuclear formation. After 1 min, the total amount of the solution (F1) was added. Using (E1), the pAg value was appropriately controlled in the meantime. After 6 hours, ¾ amount of the solution (B1) and the total amount of the solution ($D_1$) were added with controlling the temperature at 20° C. and pAg at 8.09 by the simultaneous mixing method over 14 min 15 sec. After stirring for 5 min, the temperature was elevated to 40° C. and the total amount of the solution (G1) was added to precipitate silver halide emulsion. Leaving 2000 ml of the precipitated portion, supernatant was eliminated, and 10 L of water was added to precipitate the silver halide emulsion again. Leaving 1500 ml of the precipitated portion, the supernatant was eliminated, 10 L of water was further added, then after stirring, the silver halide emulsion was precipitated again. Leaving 1500 ml of the precipitated portion, the supernatant was eliminated, subsequently, the solution (H1) was added, the temperature was elevated to 60° C., and the stirring was further performed for 120 min. Finally, pH was adjusted to 5.8 and water was added to become 1161 g per mol of the silver amount to yield the photosensitive silver halide emulsion A.

This emulsion was made up of monodisperse cubic iodide bromide silver particles with average particle size of 25 nm, variation coefficient of particle sizes of 12% and [100] face ratio of 92%.

<Preparation of Photosensitive Silver Halide Emulsion B>

The preparation was carried out as is the case with the preparation of photosensitive silver halide emulsion A, except that the temperature at addition by the simultaneous mixing method was changed to 40° C. This emulsion was made up of monodisperse cubic iodide bromide silver particles with average particle size of 50 nm, variation coefficient of particle sizes of 12% and [100] face ratio of 92%.

<Preparation of Powder Organic Silver Salt A>

Behenic acid (130.8 g), arachidic acid (67.7 g), stearic acid (43.6 g), and palmitic acid (2.3 g) were dissolved in 4720 ml of pure water at 80° C. Next, 540.2 ml of an aqueous solution of sodium hydroxide at 1.5 mol/L was added, and 6.9 ml of concentrated nitric acid was added, and subsequently the mixture was cooled to 55° C. to yield sodium fatty acid solution. With retaining the temperature of this sodium fatty acid solution at 55° C., 36.2 g of the above photosensitive silver halide emulsion A, 9.1 g of the above photosensitive silver halide emulsion B and 450 ml of pure water were added and stirred for 5 min.

Next, 468.4 ml of silver nitrate solution at 1 mol/L was added over 2 min, and stirred for 10 min to yield an organic silver salt dispersion. Subsequently, the resultant organic silver salt dispersion was transferred to a water washing vessel, deionized water was added, stirred, left to separate the organic silver salt by surfacing, and lower water-soluble salts were eliminated. Subsequently, water washing and discharging water were repeated until a conductivity of the discharged water became 2 μS/cm, water was discharged by centrifugation, and then the resultant cake-shaped organic silver salt was dried using a flash dryer, Flash Jet Dryer (supplied from Seishin Enterprise Co., Ltd.) by the operation condition of nitrogen gas atmosphere and dryer inlet hot wind until a water content became 0.1% to yield the dried powder organic silver salt A.

An infrared moisture meter was used for the measurement of the water content in the organic silver salt composition.

<Preparation of Predispersing Solution>

As the image formation layer binder, a predispersing solution A was prepared by dissolving 14.57 g of —$SO_3K$ group-containing polyvinyl butyral (Tg: 75° C., 0.2 mmol/g of —$SO_3K$ is contained) in 1457 g of methylethylketone, gradually adding 500 g of the powder organic silver salt A with stirring by a dissolver DISPERMAT CA-40M type supplied from VMA-GETZMANN, and thoroughly mixing.

<Preparation of Photosensitive Emulsion Dispersion 1>

A photosensitive emulsion dispersion 1 was prepared by supplying the predispersing solution A to a media type dispersion machine DISPERMAT SL-C12EX type (supplied from VMA-GETZMANN) in which zirconia beads (Toreselam, supplied from Toray Industries Inc.) with diameter of 0.5 mm were filled at 80% of inner volume such that a staying time in a mill is 1.5 min using a pump, and performing dispersion at a mill peripheral velocity of 8 m/s.

<Preparation of Stabilizer Solution>

A stabilizer solution was prepared by dissolving 1.0 g of a stabilizer 1 and 0.31 g of potassium acetate in 4.97 g of methanol.

<Preparation of Infrared Sensitizing Dye Solution A>

An infrared sensitizing dye solution A was prepared by dissolving 19.2 g of the infrared sensitizing dye, 1.488 g of 2-chloro-benzoic acid, 2.779 g of the stabilizer 2 and 365 mg of 5-methyl-2-mercaptobenzimidazole in 31.3 ml of MEK in a dark place.

<Preparation of Addition Solution a>

An addition solution A was made by dissolving the reducing agent (the compound and amount described in Tables 5 and 6), the compound (the compound and amount described in Tables 5 and 6) represented by the Formula (2), 1.54 g of 4-methyl phthalate and 0.48 g of the infrared dye in 110 g of MEK.

<Preparation of Addition Solution b>

An addition solution b was made by dissolving 1.56 g of the Antifoggant described in Tables 5 and 6 and 3.43 g of phthalazine in 40.9 g of MEK.

<Preparation of Addition Solution c>

An addition solution c was made by dissolving 0.5 g the vinyl compound Al represented by the Formula (G) as a silver saving agent in 39.5 g of MEK.

<Preparation of Addition Solution d>

An addition solution d was made by dissolving 1 g of Supersensitizer 1 in 9 g of MEK.

<Preparation of Addition Solution e>

An addition solution e was made by dissolving 1.0 g of potassium p-toluene thiosulfonate in 9.0 g of MEK.

<Preparation of Addition Solution f>

An addition solution f was made by dissolving 1.0 g of vinylsulfone-containing Antifoggant, $(CH_2{=}CH{-}SO_2CH_2)_2CHOH$ in 9.0 g of MEK.

STABILIZER 1

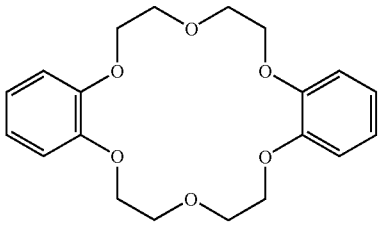

STABILIZER 2

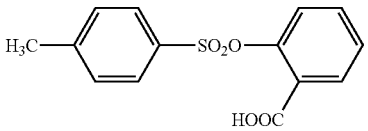

ANTIFOGGANT 2

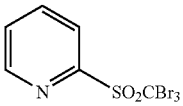

INFRARED SENSITING DYE

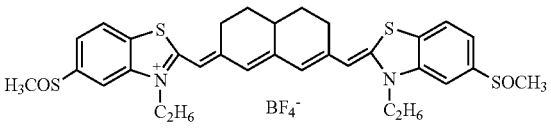

SUPERSENSITIZER 1

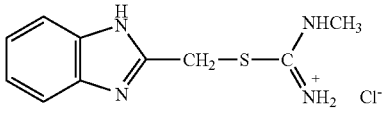

<Preparation of Image Formation Layer Coating Solution>

Under an inert gas atmosphere (97% nitrogen), the photosensitive emulsion dispersion 1 (50 g) and 15.11 g of MEK were kept at 21° C. with stirring, 1000 μm of a chemical sensitizer S-5 (0.5% methanol solution) was added, after 2 min, 390 μl of the Antifoggant 1 (10% methanol solution) was added, and stirred for one hour. Further, 494 μl of calcium bromide (10% methanol solution) was added, stirred for 10 min, subsequently, a gold sensitizer Au-5 at the amount corresponding to 1/20 mol of the above organic chemical sensitizer was added, and further stirred for 20 min. Subsequently, 167 ml of the stabilizer solution was added, stirred for 10 min, then 1.32 g of the infrared sensitizing dye solution A was added, and stirred for one hour. Subsequently, the temperature was lowered to 13° C. and the stirring was performed for additional 30 min. With holding the temperature at 13° C., 6.4 g of the addition solution d, 0.5 g of the addition solution e, 0.5 g of the addition solution f, and 13.31 g of the binder used for the predispersing solution A were added, stirred for 30 min, then 1.084 g of tetrachlorophthalic acid (9.4% by mass in MEK solution) was added, and stirred for 15 min. The image formation layer coating solution was obtained by sequentially adding and stirring 12.43 of the addition solution a, 1.6 ml of Desmodur N3300/aliphatic isocyanate supplied from Mobey (10% MEK solution), 4.27 g of the addition solution b and 4.0 g of the addition solution c with further continuing to stir.

CHEMICAL SENSITIZER S-5

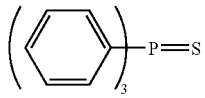

Au-5

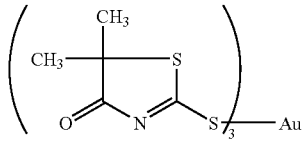

ANTIFOGGANT 1

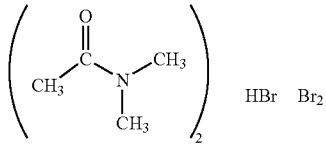

<Preparation of Image Formation Layer Protection Layer Lower Layer (Surface Protection Layer Lower Layer)>

| | |
|---|---|
| Acetone | 5 g |
| Methylethylketone | 21 g |
| Cellulose acetate butylate | 2.3 g |
| Methanol | 7 g |
| Phthalazine | 0.25 g |
| Monodisperse silica with monodisperse degree of 15% (average particle diameter: 3 μm) (surface-treated with aluminium at 1% by mass based on total mass of silica) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorinated surfactant (SF-17) | 0.01 g |
| Stearic acid | 0.1 g |
| Butyl stearate | 0.1 g |
| α-Alumina (Mohs hardness: 9) | 0.1 g |

<Preparation of Image Formation Layer Protection Layer Upper Layer (Surface Protection Layer Upper Layer)>

| | |
|---|---|
| Acetone | 5 g |
| Methylethylketone | 21 g |
| Cellulose acetate butylate | 2.3 g |
| Methanol | 7 g |
| Phthalazine | 0.25 g |
| Monodisperse silica with monodisperse degree of 15% (average particle diameter: 3 μm) (surface-treated with aluminium at 1% by mass based on total mass of silica) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorinated surfactant (SF-17) | 0.01 g |
| Stearic acid | 0.1 g |
| Butyl stearate | 0.1 g |
| α-Alumina (Mohs hardness: 9) | 0.1 g |

<Manufacture of Photothermographic Imaging Material>

The back coat layer coating solution and the back coat layer protection layer coating solution prepared above were coated on the under coating upper layer B-2 by an extrusion coater at a coating velocity of 50 m/min such that the thickness of each dried film was 3.5 μm. The drying was carried out over 5 min using dried wind with drying temperature at 100° C. and dew point at 10° C.

The photothermographic imaging materials No. 1 to No. 48 shown in Tables 5 and 6 were manufactured by simultaneously overlaying and coating the image formation layer coating solution and the image formation layer protection layer (surface protection layer) coating solution on the under coating upper layer A-2 using the extrusion coater at the coating velocity of 50 m/min. The coating was carried out such that a coated silver amount is 1.2 g/m$^2$ in the image formation layer and the thickness of dried film is 2.5 μm (surface protection layer upper layer: 1.3 μm, surface protection layer lower layer: 1.2 μm) in the image formation protection layer (surface protection layer). Subsequently, the drying was carried out for 10 min using the dried wind with drying temperature 75° C. and dew point at 10° C.

<Exposure and Development Processing>

The photothermographic imaging materials No. 1 to No. 48 manufactured above were cut into half-cut size ((14×2.54) cm×(17×2.54) cm), and then processed by the following procedure using the photothermographic processing apparatus shown in FIG. 1.

The photothermographic imaging material F was taken out from the film tray C, transported to the laser exposure portion 121, and subsequently given exposure by laser scanning using an exposure machine where semiconductor laser (maximum output is made 70 mW by joining two of maximum output 35 mW per one) with vertical multiple mode of wavelength 810 nm at high frequency superposition is made an exposure source, from the side of the image formation layer face. At that time, the image was formed by making the angle of the exposure face of the photothermographic imaging material F and the exposure laser beam L 75°. Subsequently, the photothermographic imaging material F was transported to the developing portion 130, the heat drum 1 heated at 125° C. for 15 sec to perform thermal development such that the protection layer at the side of the image formation layer of the photothermographic imaging material F was in contact with the surface of the drum, and then photothermographic imaging material was taken out of the apparatus. At that time, the transport velocity from the feeding portion 110 to the exposure portion 121, the transport velocity at the exposure portion and the transport velocity at the developing portion were 20 mm/sec, respectively. The exposure and the development were carried out in the room adjusted at 23° C. and 50% RH.

<Image Density>

The value at the maximum density part of the image obtained in the above condition is measured by a photographic densitometer and shown as the image density.

<Silver Color Tone>

Silver color tone after the processing was visually evaluated by printing X-ray photographs of the chest and using Schaukasten. As a standard sample, the film of wet processing for the laser imager supplied from Konica Corporation was used, and the relative color tone to the standard sample was visually evaluated with the following criteria by 0.5 increment.

5: Same tone as the standard sample
4: Preferable tone similar to the standard sample
3: Level with no practical problem although the tone is slightly different from the standard sample
2: Tone clearly different from the standard sample
1: Undesirable tone different from the standard sample <Light Radiated Image Stability>

The obtained imaging material was given the exposure and development processing as with the above, then attached on Schaukasten with luminance of 1000 Lux and left for 10 days, and subsequently the change of the image was evaluated with the following criteria by 0.5 increment.

5: Nearly no change
4: Slight tone change is observed
3: Tone change and increase of photographic fog are partially observed
2. Tone change and increase of photographic fog are considerably observed
1: Tone change and increase of photographic fog are noticeable, occurrence of strong density unevenness on whole area <Image Stability at Storage with High Temperature>

The obtained imaging material was given the exposure and development processing as with the above, then stored at 50° C. and at humidity of 55% for one day, subsequently the density of the photographic fog part was measured, and the increase of photographic fog before and after the storage was evaluated.

Δmin (Increase of photographic fog)=(Photographic fog after the storage at 50° C.)−(Photographic fog immediately after the development)

<Photographic Fog Property with Time>

The manufactured photothermographic imaging material was placed in a sealed container where an inside was maintained at 25° C. and humidity of 55%, and subsequently stored at 55° C. for 7 days (forcible elapsed time). As comparison, the same photothermographic imaging material was stored in a light shielding container at 25° C. and humidity of 55% for 7 days. The same processing as that used for sensitometry evaluation was given to these materials, and the density at the part of photographic fog was measured.

The Photographic Fog Property with Time of the Imaging Material was Observed by Calculating Δmin (Increase of photographic fog)=(Photographic fog with forcible elapsed time)−(Photographic fog with elapsed time for comparison)

The courses and results are shown in Tables 5 and 6.

TABLE 5

| SAMPLE No. | TYPE OF PHOTOGRAPHIC FOG INHIBITOR USED FOR SOLUTION b | TYPE AND AMOUNT OF COMPOUND OF FORMULA (2) | TYPE AND AMOUNT OF REDUCING AGENT (g) | IMAGE DENSITY | SILVER TONE |
|---|---|---|---|---|---|
| 1 | P-2 | (2-1) = 0.159 g | (1-1) = 4.20, (1-11) = 23.78 | 4.5 | 5.0 |
| 2 | P-2 | (2-1) = 0.159 g | (1-1) = 4.20, (1-23) = 23.78 | 4.5 | 5.0 |
| 3 | P-2 | (2-1) = 0.159 g | (1-1) = 4.20, (1-31) = 23.78 | 4.3 | 4.5 |
| 4 | P-2 | (2-1) = 0.159 g | (1-1) = 4.20, (1-32) = 23.78 | 4.3 | 4.5 |
| 5 | P-2 | (2-1) = 0.159 g | (1-1) = 4.20, (1-44) = 23.78 | 4.3 | 4.5 |
| 6 | P-2 | (2-1) = 0.159 g | (1-1) = 4.20, (1-46) = 23.78 | 4.3 | 4.5 |
| 7 | P-2 | (2-1) = 0.159 g | (1-1) = 4.20, (1-49) = 23.78 | 4.3 | 4.5 |
| 8 | P-7 | (2-1) = 0.159 g | (1-1) = 4.20, (1-11) = 23.78 | 4.5 | 5.0 |
| 9 | P-7 | (2-1) = 0.159 g | (1-1) = 4.20, (1-32) = 23.78 | 4.3 | 4.5 |
| 10 | P-7 | (2-1) = 0.159 g | (1-1) = 4.20, (1-46) = 23.78 | 4.3 | 4.5 |
| 11 | P-11 | (2-1) = 0.159 g | (1-1) = 4.20, (1-11) = 23.78 | 4.5 | 5.0 |
| 12 | P-11 | (2-1) = 0.159 g | (1-1) = 4.20, (1-32) = 23.78 | 4.3 | 4.5 |
| 13 | P-11 | (2-1) = 0.159 g | (1-1) = 4.20, (1-46) = 23.78 | 4.3 | 4.5 |
| 14 | (5-1) | (2-1) = 0.159 g | (1-1) = 4.20, (1-11) = 23.78 | 4.7 | 5.0 |
| 15 | (5-1) | (2-1) = 0.159 g | (1-1) = 4.20, (1-23) = 23.78 | 4.7 | 5.0 |
| 16 | (5-1) | (2-1) = 0.159 g | (1-1) = 4.20, (1-31) = 23.78 | 4.5 | 4.5 |
| 17 | (5-1) | (2-1) = 0.159 g | (1-1) = 4.20, (1-32) = 23.78 | 4.5 | 4.5 |
| 18 | (5-1) | (2-1) = 0.159 g | (1-1) = 4.20, (1-44) = 23.78 | 4.5 | 4.5 |
| 19 | (5-1) | (1-1) = 0.159 g | (1-1) = 4.20, (1-46) = 23.78 | 4.5 | 4.5 |
| 20 | (5-1) | (2-1) = 0.159 g | (1-1) = 4.20, (1-49) = 23.78 | 4.5 | 4.5 |
| 21 | (5-2) | (2-1) = 0.159 g | (1-1) = 4.20, (1-23) = 23.78 | 4.5 | 5.0 |
| 22 | (5-3) | (2-1) = 0.159 g | (1-1) = 4.20, (1-31) = 23.78 | 4.3 | 4.5 |
| 23 | (5-5) | (2-1) = 0.159 g | (1-1) = 4.20, (1-32) = 23.78 | 4.3 | 4.5 |
| 24 | (5-7) | (2-1) = 0.159 g | (1-1) = 4.20, (1-44) = 23.78 | 4.3 | 4.5 |
| 25 | (5-8) | (2-1) = 0.159 g | (1-1) = 4.20, (1-46) = 23.78 | 4.3 | 4.5 |
| 26 | ANTIFOGGANT 2 | NONE | (1-1) = 4.20, (1-11) = 23.78 | 3.4 | 3.5 |
| 27 | ANTIFOGGANT 2 | NONE | (1-1) = 4.20, (1-32) = 23.78 | 3.2 | 3.5 |
| 28 | ANTIFOGGANT 2 | NONE | (1-1) = 4.20, (1-46) = 23.78 | 3.2 | 3.5 |
| 29 | P-2 | NONE | (2*) | 3.2 | 2.0 |

| SAMPLE No. | PHOTO RADIATION IMAGE STABILITY | HIGH TEMPERATURE IMAGE STABILITY | PHOTOGRAPHIC FOG WITH TIME | REMARKS |
|---|---|---|---|---|
| 1 | 5.0 | 0.004 | 0.003 | Inv. |
| 2 | 5.0 | 0.004 | 0.003 | Inv. |
| 3 | 4.5 | 0.006 | 0.005 | Inv. |
| 4 | 4.5 | 0.005 | 0.005 | Inv. |
| 5 | 4.5 | 0.005 | 0.005 | Inv. |
| 6 | 4.5 | 0.005 | 0.005 | Inv. |
| 7 | 4.5 | 0.005 | 0.005 | Inv. |
| 8 | 5.0 | 0.004 | 0.003 | Inv. |
| 9 | 4.5 | 0.005 | 0.005 | Inv. |
| 10 | 4.5 | 0.005 | 0.005 | Inv. |
| 11 | 5.0 | 0.004 | 0.003 | Inv. |
| 12 | 4.5 | 0.005 | 0.005 | Inv. |
| 13 | 4.5 | 0.005 | 0.005 | Inv. |
| 14 | 5.0 | 0.004 | 0.003 | Inv. |
| 15 | 5.0 | 0.004 | 0.003 | Inv. |
| 16 | 4.5 | 0.005 | 0.004 | Inv. |
| 17 | 4.5 | 0.005 | 0.005 | Inv. |
| 18 | 4.5 | 0.005 | 0.005 | Inv. |
| 19 | 4.5 | 0.005 | 0.005 | Inv. |
| 20 | 4.5 | 0.005 | 0.005 | Inv. |
| 21 | 5.0 | 0.004 | 0.003 | Inv. |
| 22 | 4.5 | 0.005 | 0.004 | Inv. |
| 23 | 4.5 | 0.005 | 0.004 | Inv. |
| 24 | 4.5 | 0.005 | 0.004 | Inv. |
| 25 | 4.5 | 0.005 | 0.004 | Inv. |
| 26 | 4.0 | 0.006 | 0.005 | Comp. |
| 27 | 4.0 | 0.006 | 0.005 | Comp. |
| 28 | 4.0 | 0.006 | 0.005 | Comp. |
| 29 | 2.0 | 0.012 | 0.006 | Comp. |

(2*): 1,1-bis (2-hydroxy-3,5 dimethylphenyl)-3,5,5 trimethylhexane

TABLE 6

| SAMPLE No. | TYPE OF PHOTOGRAPHIC FOG INHIBITOR USED FOR SOLUTION b | TYPE AND AMOUNT OF COMPOUND OF FORMULA (2) | TYPE AND AMOUNT OF REDUCING AGENT (g) | IMAGE DENSITY | SILVER TONE |
|---|---|---|---|---|---|
| 30 | P-2 | (2-1) = 0.159 g | (1-1) = 4.20, (1-11) = 23.78 | 4.5 | 5.0 |
| 31 | P-7 | (2-1) = 0.159 g | (1-1) = 4.20, (1-11) = 23.78 | 4.5 | 5.0 |
| 32 | P-10 | (2-1) = 0.159 g | (1-1) = 4.20, (1-11) = 23.78 | 4.5 | 5.0 |
| 33 | P-12 | (2-1) = 0.159 g | (1-1) = 4.20, (1-11) = 23.78 | 4.5 | 5.0 |
| 34 | P-4 | (2-9) = 0.159 g | (1-1) = 4.20, (1-11) = 23.78 | 4.5 | 5.0 |
| 35 | P-9 | (2-9) = 0.159 g | (1-1) = 4.20, (1-11) = 23.78 | 4.5 | 5.0 |
| 36 | P-5 | (2-13) = 0.159 g | (1-1) = 4.20, (1-11) = 23.78 | 4.3 | 4.5 |
| 37 | P-11 | (2-13) = 0.159 g | (1-1) = 4.20, (1-11) = 23.78 | 4.3 | 4.5 |
| 38 | (5-1) | (2-1) = 0.159 g | (1-1) = 4.20, (1-11) = 23.78 | 4.7 | 5.0 |
| 39 | (5-3) | (2-1) = 0.159 g | (1-1) = 4.20, (1-11) = 23.78 | 4.7 | 5.0 |
| 40 | (5-8) | (2-1) = 0.159 g | (1-1) = 4.20, (1-11) = 23.78 | 4.7 | 5.0 |
| 41 | (5-5) | (2-9) = 0.159 g | (1-1) = 4.20, (1-11) = 23.78 | 4.7 | 5.0 |
| 42 | (5-2) | (2-13) = 0.159 g | (1-1) = 4.20, (1-11) = 23.78 | 4.5 | 4.5 |
| 43 | P-2 | (2-1) = 0.159 g | (2*) = 27.98 | 4.5 | 4.0 |
| 44 | ANTIFOGGANT 2 | (2-1) = 0.159 g | (2*) = 27.98 | 3.8 | 4.0 |
| 45 | P-2 | NONE | (2*) = 27.98 | 4.3 | 2.5 |

| SAMPLE No. | PHOTO RADIATION IMAGE STABILITY | HIGH TEMPERATURE IMAGE STABILITY | PHOTOGRAPHIC FOG WITH TIME | REMARKS |
|---|---|---|---|---|
| 30 | 5.0 | 0.004 | 0.003 | Inv. |
| 31 | 5.0 | 0.004 | 0.003 | Inv. |
| 32 | 5.0 | 0.004 | 0.003 | Inv. |
| 33 | 5.0 | 0.004 | 0.003 | Inv. |
| 34 | 5.0 | 0.004 | 0.003 | Inv. |
| 35 | 5.0 | 0.004 | 0.003 | Inv. |
| 36 | 4.5 | 0.004 | 0.003 | Inv. |
| 37 | 4.5 | 0.004 | 0.003 | Inv. |
| 38 | 5.0 | 0.004 | 0.003 | Inv. |
| 39 | 5.0 | 0.004 | 0.003 | Inv. |
| 40 | 5.0 | 0.004 | 0.003 | Inv. |
| 41 | 5.0 | 0.004 | 0.003 | Inv. |
| 42 | 4.5 | 0.004 | 0.003 | Inv. |
| 43 | 3.5 | 0.005 | 0.003 | Inv. |
| 44 | 2.5 | 0.006 | 0.005 | Comp. |
| 45 | 2.5 | 0.006 | 0.004 | Comp. |

(2*): 1,1-bis (2-hydroxy-3,5 dimethylphenyl)-3,5,5 trimethylhexane

From Tables 5 and 6, it is obvious that the photothermographic imaging materials of the invention are higher density and more excellent in silver color tone, light radiated image stability, image stability at storage with high temperature, and photographic fog property with time as compared with the photothermographic imaging materials for comparison.

In the above, the examples of the present invention are explained. However, it is needless to say that the present invention is not limited to such examples, but various modifications are possible in a range within the scope of the present invention.

According to the present invention, it is possible to provide photothermographic imaging materials with high sensitivity and low photographic fog, which are excellent in image storage stability after the photothermographic process. Further, according to the present invention, a photothermographic imaging material which is high density and excellent in silver color tone, light radiated image stability, image stability at storage with high temperature and photographic fog property with time, and a image formation method using the photothermographic imaging material can be obtained.

The entire disclosure of Japanese Patent Application Nos. 2002-310910, 2002-312555 and 2003-199555 filed on Oct. 25, 2002, Oct. 28, 2002 and Jul. 22, 2003, respectively, including specification, claims, drawings and summary are incorporated herein by reference in its entirety.

What is claimed is:

1. A photothermographic imaging material comprising:

a support;

a photosensitive layer containing photosensitive silver halide particles on at least one face of the support; and a non-photosensitive layer provided on a side of the support where the photosensitive layer is provided;

wherein at least one of the photosensitive layer and the non-photosensitive layer contains silver behenate, a reducing agent, a compound represented by the following Formula (1) and a compound represented by the following Formula (2a),

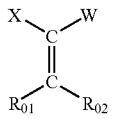

(1)

-continued (2a)

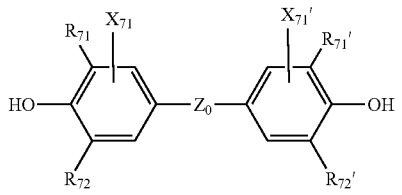

wherein in the Formula (1), the X represents an electron withdrawing group, the W represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, an —S-oxalyl group, an oxamoyl group, an oxycarbonyl group, an —S-carbonyl group, a carbamoyl group, a thiocarbamoyl group, a sulfonyl group, a sulfinyl group, an oxysulfonyl group, an —S-sulfonyl group, a sulfamoyl group, an oxysulfinyl group, an —S-sulfinyl group, a sulfinamoyl group, a phosphoryl group, a nitro group, an imino group, an N-carbonylimino group, an N-sulfonylimino group, an ammoniuxn group, a sulfonium group, a phosphonium group, a pyrilium group or an immonium group, the $R_{01}$ represents an hydroxyl group or a salt of the hydroxyl group, and the $R_{02}$ represents a methyl group, an ethyl group, a —$C(CH_3)_3$ group, a cyclohexyl group, a propyl group, or a —$CH(CH_3)_2$ group, and in the Formula (2a), the $Z_0$ represents an —S— group or a —$C(R_{73})(R_{73}')$— group, each of the $R_{73}$ and the $R_{73}'$ represents a hydrogen atom or a substituent, each of the $R_{71}$, the $R_{72}$, the $R_{71}'$ and the $R_{72}'$ represents a substituent, and each of the $X_{71}$ and the $X_{71}'$ represents a hydrogen atom or a substituent.

2. The material of claim 1, wherein each of the X and the W is substantially free from a formyl group.

3. The material of claim 2, wherein at least one of the X and the W represents a cyano group, or the X and the W are bound one another to form a cyclic structure.

4. The material of claim 2, wherein at least one of the photosensitive layer and the non-photosensitive layer contains a compound represented by the following Formula (3), (3)

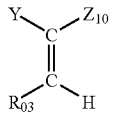

wherein the Y represents an electron withdrawing group, the $Z_{10}$ represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, an —S-oxalyl group, an oxamoyl group, an oxycarbonyl group, an —S-carbonyl group, a carbamoyl group, a thiocarbainoyl group, a sulfonyl group, a sulfinyl group, an oxysulfonyl group, an —S-sulfonyl group, a sulfamoyl group, an oxysulfinyl group, an —S-sulfinyl group, a sulfinamoyl group, a phosphoryl group, a nitro group, an imino group, an N-carbonylimino group, an N-sulfonylimino group, an aminonium group, a sulfonjuin group, a phosphonium group, a pyrilium group or an immonium group, and the $R_{03}$ represents a halogen atom, an oxy group, a thio group, an amino group or a heterocyclic group.

5. The material of claim 3, wherein at least one of the photosensitive layer and the non-photosensitive layer contains a compound represented by the following Formula (3), (3)

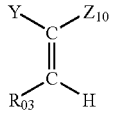

wherein the Y represents an electron withdrawing group, the $Z_{10}$ represents a hydrogen atom, an alkyl group, an alkenyl group, an alkynyl group, an aryl group, a heterocyclic group, a halogen atom, a cyano group, an acyl group, a thicacyl group, an oxalyl group, an oxyoxalyl group, an —S-oxalyl group, an oxainoyl group, an oxycarbonyl group, an —S-carbonyl group, a carbamoyl group, a thiocarbamoyl group, a sulfonyl group, a sulfinyl group, an oxysulfonyl group, an —S-sulfonyl group, a sulfamoyl group, an oxysulfinyl group, an —S-sulfinyl group, a sulfinamoyl group, a phosphoryl group, a nitro group, an imino group, an N-carbonylimino group, an N-sulfonylimino group, an ammonium group, a sulfonium group, a phosphonium group, a pyrilium group or an immonium group, and the $R_{03}$ represents a halogen atom, an oxy group, a thio group, an amino group or a heterocyclic group.

6. The material of claim 2, wherein at least one of the photosensitive layer and the non-photosensitive layer contains a hydrazine compound.

7. The material of claim 3, wherein at least one of the photosensitive layer and the non-photosensitive layer contains a hydrazine compound.

8. The material of claim 4, wherein at least one of the photosensitive layer and the non-photosensitive layer contains a hydrazine compound.

9. The material of claim 5, wherein at least one of the photosensitive layer and the non-photosensitive layer contains a hydrazine compound.

10. The material of claim 2, wherein the organic silver salt is prepared from organic acid potassium salt obtained from potassium hydroxide and organic acid.

11. The material of claim 3, wherein the organic silver salt is prepared from organic acid potassium salt obtained from potassium hydroxide and organic acid.

12. The material of claim 4, wherein the organic silver salt is prepared from organic acid potassium salt obtained from potassium hydroxide and organic acid.

13. The material of claim 5, wherein the organic silver salt is prepared from organic acid potassium salt obtained from potassium hydroxide and organic acid.

14. The material of claim 6, wherein the organic silver salt is prepared from organic acid potassium salt obtained from potassium hydroxide and organic acid.

15. The material of claim 7, wherein the organic silver salt is prepared from organic acid potassium salt obtained from potassium hydroxide and organic acid.

16. The material of claim 8, wherein the organic silver salt is prepared from organic acid potassium salt obtained from potassium hydroxide and organic acid.

17. The material of claim 9, wherein the organic silver salt is prepared from organic acid potassium salt obtained from potassium hydroxide and organic acid.

18. A photothermographic imaging material comprising:

a support;

a photosensitive layer containing organic silver, silver halide and reducing agent, the photosensitive layer being provided on the support;

a polymer containing at least one repeated unit of an aliphatic monomer having a halogen radical releasing group; and a compound represented by the following Formula (2), (2)

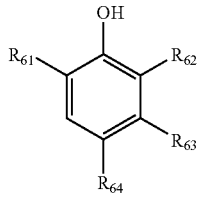

wherein the $R_{61}$ represents a substituted or unsubstituted alkyl group, the $R_{62}$ represents a hydrogen atom, a substituted or unsubstituted alkyl group or a substituted or unsubstituted acylamino group, the $R_{61}$ and the $R_{62}$ being free from 2-hydroxyphenylmethyl group, the $R_{63}$ represents a hydrogen atom or a substituted or unsubstituted alkyl group, and the $R_{64}$ represents a substituent capable of being substituted to benzene ring.

19. The material of claim 18, wherein the aliphatic monomer having the halogen radical releasing group is a monomer (11)

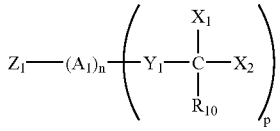

represented by the following Formula (11), wherein each of the $X_1$ and the $X_2$ represents independently a halogen atom, the $R_{10}$ represents a hydrogen atom or a halogen atom, the $Y_1$ represents a bivalent linkage group, the p represents an integer of 1 to 3, the $A_1$ represents an alkylene group, a cycloalkylene group, an alkenylene group or an alkynylene group, the n represents 0 or 1, and the $Z_1$ represents an ethylenic unsaturated group, an ethyleneimino group or an epoxy group.

20. The material of claim 18, wherein the compound represented by the Formula (2) is a compound represented by the following Formula (2a), (2a)

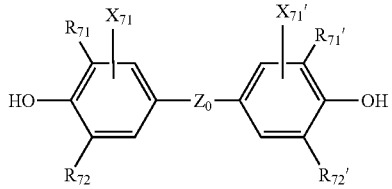

wherein the $Z_0$ represents an —S— group or a —C($R_{73}$)($R_{73}$')— group, each of the $R_{73}$ and the $R_{73}$' represents a hydrogen atom or a substituent, each of the $R_{71}$, the $R_{72}$, the $R_{71}$' and the $R_{72}$' represents a substituent, and each of the $X_{71}$ and the $X_{71}$' represents a hydrogen atom or a substituent.

21. The material of claim 19, wherein the compound represented by the Formula (2) is a compound represented by the following Formula (2a), (2a)

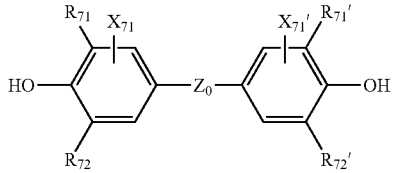

wherein the $Z_0$ represents an —S— group or a —C($R_{73}$)($R_{73}$')— group, each of the $R_{73}$ and the $R_{73}$' represents a hydrogen atom or a substituent, each of the $R_{71}$, the $R_{72}$, the $R_{71}$' and the $R_{72}$' represents a substituent, and each of the $X_{71}$ and the $X_{71}$' represents a hydrogen atom or a substituent.

22. The material of claim 18, wherein a glass transition temperature Tg of the binder is between 70° C. and 150° C.

23. The material of claim 18, further comprising at least one compound selected from the following Formula (A-8), $$(Rf\text{-}(L_1)_{n1}\text{-})_p\text{-}(Y)_{m1}\text{-}(A)_q \quad \text{(A-8)}$$

wherein the Rf represents a fluorine atom-containing substituent, the $L_1$ represents a bivalent linkage group free from a fluorine atom, the Y represents a bivalent to tetravalent linkage group free from a fluorine atom, the A represents an anion group or a salt group thereof, each of the n1 and the m1 represents an integer of 0 or 1, the p represent an integer of 1 to 3, and the q represents an integer of 1 to 3, and when the q is 1, the n1 and the m1 are not 0 simultaneously.

24. The material of claim 18, wherein a side of a layer including the photosensitive layer of the material contains at least one silver saving agent selected from a vinyl compound, a hydrazine derivative, a silane compound and quaternary onium salt.

25. The material of claim 18, containing silver halide having a mean particle size of 10 nm to 40 nm as the silver halide.

26. The material of claim 18, containing silver halide having a mean particle size of 10 nm to 40 nm and silver halide having a mean particle size of 45 nm to 100 nm as the silver halide.

27. The material of claim 18, containing silver halide chemically sensitized by a chalcogen compound as the silver halide.

28. The material of claim 18, an amount of silver contained in the photosensitive layer is between 0.3 and 1.5 $g/m^2$.

29. A photothermographic imaging material comprising:

a support;

a photosensitive layer containing organic silver, silver halide and reducing agent, the photosensitive layer being provided on the support;

a polymer containing at least one repeated unit of a monomer represented by the following Formula (12); and (12)

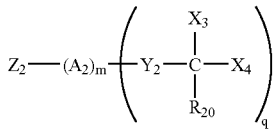

(2)

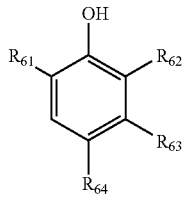

a compound represented by the following Formula (2), wherein in the Formula (12), each of the $X_3$ and the $X_4$ represents independently a halogen atom, the $R_{20}$ represents a hydrogen atom, a halogen atom or a substituent, the $Y_2$ represents —$N(R_{21})CO$— or —OCO—, the $R_{21}$ represents a hydrogen atom, a halogen atom or a substituent, the q represents an integer of 1 to 3, the $A_2$ represents an aromatic group or hetero ring group, the m represents 0 or 1, the $Z_2$ represents an ethylenic unsaturated group, an ethyleneimino group or epoxy group, and in the Formula (2), the $R_{61}$ represents a substituted or unsubstituted alkyl group, the $R_{62}$ represents a hydrogen atom, a substituted or unsubstituted alkyl group or a substituted or unsubstituted acylamino group, the $R_{61}$ and the $R_{62}$ being free from 2-hydroxyphenylmethyl group, the $R_{63}$ represents a hydrogen atom or a substituted or unsubstituted alkyl group, and the $R_{64}$ represents a substituent capable of being substituted to benzene ring.

30. The material of claim 29, wherein the compound represented by the Formula (2) is a compound represented by the following (2a)

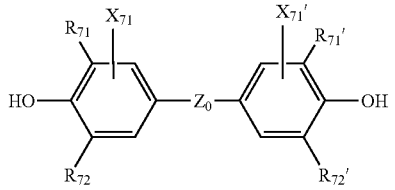

Formula (2a), wherein the $Z_0$ represents an —S— group or a —$C(R_{73})(R_{73}')$— group, each of the $R_{73}$ and the $R_{73}'$ represents a hydrogen atom or a substituent, each of the $R_{71}$, the $R_{72}$, the $R_{71}'$ and the $R_{72}'$ represents a substituent, and each of the $X_{71}$ and the $X_{71}'$ represents a hydrogen atom or a substituent.

31. The material of claim 29, further comprising at least one compound selected from the following Formula (A-8), $$(Rf\text{-}(L_1)_{n1}\text{-})_p\text{-}(Y)_{m1}\text{-}(A)_q \quad \text{(A-8)}$$

wherein the Rf represents a fluorine atom-containing substituent, the $L_1$ represents a bivalent linkage group free from a fluorine atom, the Y represents a bivalent to tetravalent linkage group free from a fluorine atom, the A represents an anion group or a salt group thereof, each of the n1 and the m1 represents an integer of 0 or 1, the p represent an integer of 1 to 3, and the q represents an integer of 1 to 3, and when the q is 1, the n1 and the m1 are not 0 simultaneously.

32. The material of claim 29, wherein a side of a layer including the photosensitive layer of the material contains at least one silver saving agent selected from a vinyl compound, a hydrazine derivative, a silane compound and quaternary onium salt.

33. A photothermographic imaging material comprising:

a support;

a photosensitive layer containing organic silver, silver halide and reducing agent, the photosensitive layer being provided on the support;

a polymer containing at least one repeated unit represented by the following Formula (15) in polyvinyl butyral; and (15)

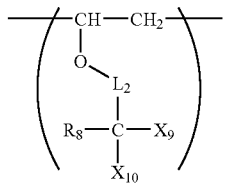

a compound represented by the following Formula (2), wherein in the Formula (15), each of the $X_9$ and the $X_{10}$ represents a halogen atom, the $R_8$ represents a hydrogen atom, a halogen atom or a substituent, the $L_2$ represents a bivalent linkage group, and the r represents an integer of 1 or more, and (2)

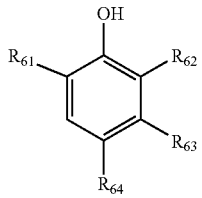

in the Formula (2), the $R_{61}$ represents a substituted or unsubstituted alkyl group, the $R_{62}$ represents a hydrogen atom, a substituted or unsubstituted alkyl group or a substituted or unsubstituted acylamino group, the $R_{61}$ and the $R_{62}$ being free from 2-hydroxyphenylmethyl group, the $R_{63}$ represents a hydrogen atom or a substituted or unsubstituted alkyl group, and the $R_{64}$ represents a substituent capable of being substituted to benzene ring.

34. The material of claim 33, wherein the compound represented by the Formula (2) is a compound represented by the following Formula (2a), (2a)

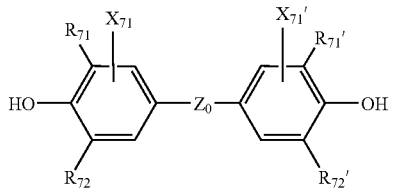

wherein the $Z_0$ represents an —S— group or a —C($R_{73}$)($R_{73}$')— group, each of the $R_{73}$ and the $R_{73}$' represents a hydrogen atom or a substituent, each of the $R_{71}$, the $R_{72}$, the $R_{71}$' and the $R_{72}$' represents a substituent, and each of the $X_{71}$ and the $X_{71}$' represents a hydrogen atom or a substituent.

35. The material of claim 33, further comprising at least one compound selected from the following Formula (A-8), $$(Rf\text{-}(L_1)_{n1}\text{-})_p\text{-}(Y)_{m1}\text{-}(A)_q \quad \text{(A-8)}$$

wherein the Rf represents a fluorine atom-containing substituent, the $L_1$ represents a bivalent linkage group free from a fluorine atom, the Y represents a bivalent to tetravalent linkage group free from a fluorine atom, the A represents an anion group or a salt group thereof, each of the n1 and the m1 represents an integer of 0 or 1, the p represent an integer of 1 to 3, and the q represents an integer of 1 to 3, and when the q is 1, the n1 and the m1 are not 0 simultaneously.

36. The material of claim 33, wherein a side of a layer including the photosensitive layer of the material contains at least one silver saving agent selected from a vinyl compound, a hydrazine derivative, a silane compound and quaternary onium salt.

* * * * *